US009865366B2

(12) United States Patent
Lehnert et al.

(10) Patent No.: US 9,865,366 B2
(45) Date of Patent: Jan. 9, 2018

(54) SHIELDED PACKAGING SYSTEM FOR RADIOACTIVE WASTE

(71) Applicant: EnergySolutions, LLC, Salt Lake City, UT (US)

(72) Inventors: Robert Allen Lehnert, San Jose, CA (US); Brandon Damon Thomas, San Jose, CA (US); Steven Edward Sisley, San Jose, CA (US)

(73) Assignee: EnergySolutions, LLC, Salt Lake City, UT (US)

( * ) Notice: Subject to any disclaimer, the term of this patent is extended or adjusted under 35 U.S.C. 154(b) by 409 days.

(21) Appl. No.: 14/328,578

(22) Filed: Jul. 10, 2014

(65) Prior Publication Data

US 2016/0012926 A1 Jan. 14, 2016

(51) Int. Cl.

| | |
|---|---|
| ***G21F 5/12*** | (2006.01) |
| ***G21F 5/012*** | (2006.01) |
| ***G21F 5/06*** | (2006.01) |
| *G21F 5/14* | (2006.01) |

(52) U.S. Cl.

CPC ..... *G21F 5/12* (2013.01); *G21F 5/012* (2013.01); *G21F 5/06* (2013.01); *G21F 5/14* (2013.01)

(58) Field of Classification Search

USPC ..... 250/506.1, 507.1, 505.1; 376/272, 170, 376/435; 419/10, 28, 29

See application file for complete search history.

(56) References Cited

U.S. PATENT DOCUMENTS

| | | | | |
|---|---|---|---|---|
| 4,050,604 | A * | 9/1977 | Flanders | B65D 7/24 206/599 |
| 4,251,321 | A * | 2/1981 | Crowther | G21C 3/30 376/435 |
| 5,035,342 | A | 7/1991 | Houghton | |
| 5,515,405 | A | 5/1996 | Gilmore et al. | |
| 6,169,777 | B1 | 1/2001 | Yoshizawa et al. | |
| 2003/0028065 | A1* | 2/2003 | Matsunaga | G21F 5/008 588/16 |
| 2004/0011971 | A1 | 1/2004 | Nicholson et al. | |
| 2006/0057013 | A1 | 3/2006 | Ohsono et al. | |
| 2006/0214120 | A1* | 9/2006 | Huang | G21F 1/10 250/506.1 |
| 2010/0230619 | A1* | 9/2010 | Tamaki | G21F 5/005 250/506.1 |
| 2010/0272225 | A1* | 10/2010 | Singh | G21F 5/10 376/272 |
| 2011/0317794 | A1* | 12/2011 | Venneri | G21C 3/328 376/170 |
| 2013/0322589 | A1* | 12/2013 | Bracey | G21F 5/008 376/272 |

FOREIGN PATENT DOCUMENTS

WO 2013155520 A1 10/2013

OTHER PUBLICATIONS

PCT International Search Report for PCT International Application No. PCT/US15/18787, dated Jun. 18, 2015 (2 pp.).

* cited by examiner

*Primary Examiner* — Kiet T Nguyen
(74) *Attorney, Agent, or Firm* — Holland & Hart LLP

(57) ABSTRACT

A packaging system for radioactive waste is robust, highly functional, and can be used for nearly all radioactive waste streams that require shielded packaging. The packaging system includes a modular container that is configured to receive modular shielding inserts. The packaging system can be used to store, transport, and dispose of radioactive waste.

44 Claims, 54 Drawing Sheets

SHIELDED PACKAGING SYSTEM FOR RADIOACTIVE WASTE

BACKGROUND

Historically, engineered robust packaging systems for radioactive waste that incorporate radiation shielding have been designed, licensed and deployed on a project or application specific basis. This means that such a packaging system has to be designed for each individual project or application. The unique requirements for each project or application dictates the design of the packaging system. This makes the packaging system unsuitable for other projects and applications having different requirements.

For example, a project may require a container made of double wall stainless steel integral welded shells, monolithic cast-in-place high density concrete shielding with steel reinforcing, and extensive machining of mating surfaces with bolted and welded lid. The stainless steel shells, shielding, lid, dimensions, and so forth are all specific to the project. The container cannot be used for another project that has different waste contents specification, confinement requirements, needs more or less shielding, or has different closure requirements.

The use of a custom packaging system for each project or application causes other problems. The cost to design, demonstrate regulatory compliance, and fabricate a packaging system for each project is substantial and cost overruns are common. Fabricating a custom designed system is complex and there are often numerous fabrication nonconformances. The difficulty of fabricating the system often results in schedule overruns and delays.

SUMMARY

A number of representative embodiments are provided to illustrate the various features, characteristics, and advantages of the disclosed subject matter. The embodiments are provided in a variety of specific contexts although it should be understood that many of the concepts can be used in a variety of other settings, situations, and configurations. For example, the features, characteristics, advantages, etc., of one embodiment can be used alone or in various combinations and sub-combinations with the features, characteristics, advantages, etc., of one or more other embodiments.

A modular packaging system for radioactive waste is structurally and mechanically robust, highly functional and configurable, and can be used for nearly all radioactive waste streams that require shielded packaging. It provides cradle-to-grave functionality for loading, interim storage, transport, and disposal of radioactive waste. It provides a platform that can be tailored in the field for batch-specific radioactive waste streams and includes uniform equipment interfaces that provide maximum operational flexibility to end users.

The packaging system eliminates the conventional practice of developing custom packages for nearly every project and/or radioactive waste stream. It includes a standard modular container that can be configured using a catalog of features to package most types of radioactive waste.

The basic process for configuring the container is as follows: (1) evaluate the specifications of the radioactive waste, (2) select a modular container grade and features, e.g., confinement boundary robustness, and the like, (3) select shielding material and thickness that corresponds to the specifications of the radioactive waste, and (4) select the features for the cavity of the modular container, e.g., liner, support framework for sub-containers, and the like.

The modular container can be used to package radioactive waste from source to disposal including remote waste processing, remote container loading and handling, interim storage, off-site storage, and/or disposal by shallow land burial or in a geological repository. The modular container is capable of holding solid, granular, and wet radioactive waste.

The modular container makes it unnecessary to handle and package the waste multiple times before final disposition. This lowers the lifecycle cost associated with managing radioactive waste. The modular container can be reused or disposed with the radioactive waste. It can also be configured by the end user to suit batch-specific waste streams.

The modular container includes a standard enclosure envelope that can be configured in a variety of ways to meet the requirements of a specific project or application. Also, the modular container can include other components such as a liner to hold granular radioactive waste, a support framework to hold sub-containers of wet radioactive waste, and other support frameworks such as baskets, dividers, and the like to hold various types of solid radioactive waste, spent nuclear fuel (SNF), and high level waste (HLW).

The modular container can include modular shielding inserts or members that can be used to adjust the shielding of the modular container to satisfy the requirements of a given project or application. The modular shielding inserts can be made of a variety of suitable materials and have any of a number of suitable thicknesses.

The entire contents of all sections of the U.S. Code of Federal Regulations (CFR) and the International Atomic Energy Agency regulations referenced in this document are incorporated by reference. In the event of a conflict, the subject matter explicitly recited or shown in this document controls over any subject matter incorporated by reference. The incorporated subject matter should not be used to limit or narrow the scope of the explicitly recited or depicted subject matter.

The Summary is provided to introduce a selection of concepts in a simplified form that are further described below in the Detailed Description. The Summary and the Background are not intended to identify key concepts or essential aspects of the disclosed subject matter, nor should they be used to constrict or limit the scope of the claims. For example, the scope of the claims should not be limited based on whether the recited subject matter includes any or all aspects noted in the Summary and/or addresses any of the issues noted in the Background.

DRAWINGS

Various embodiments of the packaging system are disclosed in the accompanying drawings.

DETAILED DESCRIPTION

Figure 1:
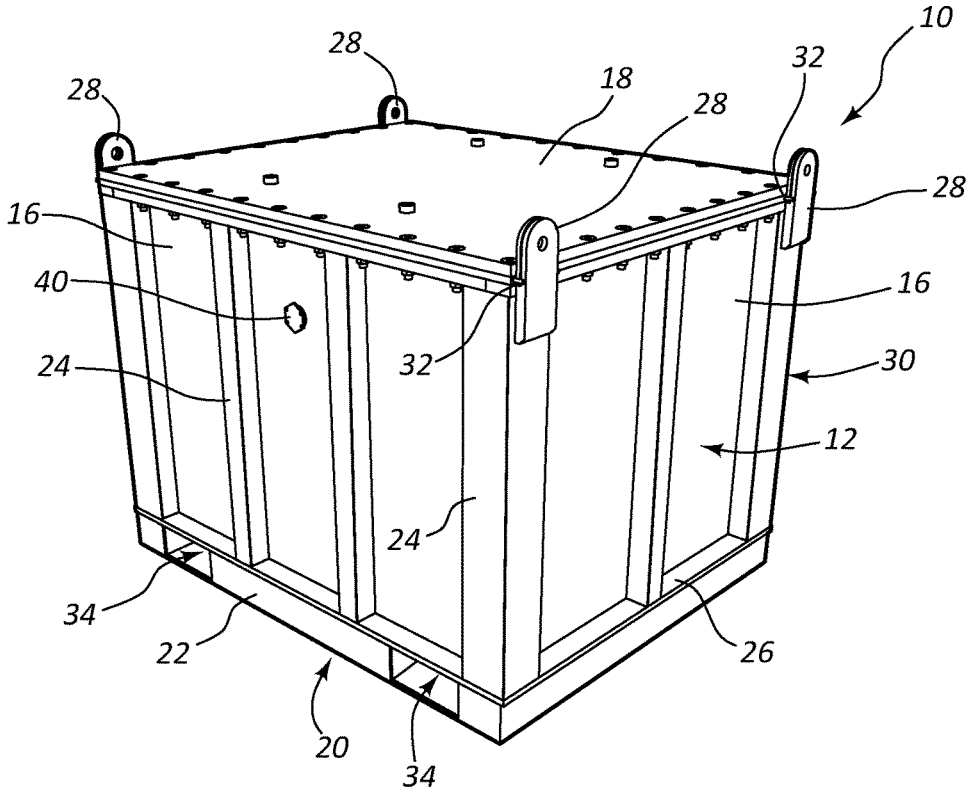
FIG. 1 is a perspective view of one embodiment of a modular container.

A packaging system for radioactive waste is modular in nature and can be tailored for a variety of radioactive waste. The packaging system is modular in that it can be deconstructed into a number of component parts or subsystems that can be mixed and matched in a variety of configurations. The components are able to connect, interact, fit together, and otherwise interoperate by adhering to an overall standardized design.

The packaging system includes the following standardized subsystems and/or components: containers (including enclosure envelopes), interior shielding inserts, exterior shielding panels, interior loading baskets, impact limiters, interior liners, interior support frameworks, transport overpack system (including transport containers and transport impact limiters), disposal overpacks, and disposal vaults. Each subsystem or component can be configured separately and then used in conjunction with any other subsystem or component to provide a tremendous amount of flexibility to package a variety of radioactive waste.

It should be appreciated that the standardized subsystems and components listed in the previous paragraph are provided by way of example and do not represent an exhaustive list of all the standardized subsystems and components of the packaging system. The packaging system can include additional standardized subsystems and components beyond those listed. Each standardized subsystems and components can be referred to as being modular because they are what make the packaging system modular.

The packaging system includes standardized equipment handling interfaces such as standard forklift, crane rigging, and the like. It can be used for interim storage of radioactive waste as well as transport and final disposition by shallow surface burial and geological repository burial. The packaging system can handle any class of radioactive waste from Class A low level waste to high level waste.

Radioactive waste can be classified according to a number of systems in use worldwide. It should be appreciated that some classifications use similar terminology but define the specifics of the waste differently. Despite this, radioactive waste can generally be divided into the following classifications.

Low level waste (LLW) is generally radioactive waste that is suitable for near surface or shallow land disposal. This is a disposal option suitable for waste that contains such an amount of radioactive material that robust containment and isolation for limited periods of time up to a few hundred years are required. LLW covers a wide range of radioactive waste. It ranges from radioactive waste with an activity level that does not requiring shielding or particularly robust containment and isolation, to radioactive waste with an activity level such that shielding and more robust containment and isolation are necessary for periods up to several hundred years.

Because LLW may have a wide range of activity concentrations and may contain a wide range of radionuclides, there are various design options for near surface disposal facilities. These design options may range from simple to more complex engineered facilities, and may involve disposal at varying depths, typically from the surface down to 30 m. They will depend on safety assessments and on national practices, and are subject to approval by the governing regulatory body.

LLW can include low concentrations of long lived radionuclides. Although the waste may contain high concentrations of short lived radionuclides, significant radioactive decay of these will occur during the period of reliable containment and isolation provided by the site, the engineered barriers, and institutional control. The IAEA regulations defining LLW are set forth in IAEA CSG-1.

In the U.S., LLW is radioactive waste that is defined by what it is not. It is radioactive waste not classified as high-level, spent fuel, transuranic or byproduct material such as uranium mill tailings. LLW has four subcategories: Classes A, B, C, and Greater Than Class C (GTCC), described below. On average, Class A is the least hazardous while GTCC is the most hazardous. The U.S. regulations defining Class B, C and GTCC are set forth in 10 CFR 61.55.

Class A radioactive waste is the least radioactive of the four LLW classes. It is primarily contaminated with short-lived radionuclides. For example, it can have an average concentration of 0.1 Ci/ft$^3$, Class B radioactive waste is contaminated with a greater amount of short-lived radionuclides than Class A. For example, it can have an average concentration of 2 Ci/ft$^3$). Class C radioactive waste is contaminated with greater amounts of long-lived and short-lived radionuclides than Class A or B. For example, it can have an average concentration of 7 Ci/ft$^3$. GTCC radioactive waste is the most radioactive of the low-level classes. It can have an average concentration of 300 to 2,500 Ci/ft$^3$.

TABLE 1

Low Level Waste Classification Table

| Radionuclide | Class A (Ci/m$^3$) | Class B (Ci/m$^3$) | Class C (Ci/m$^3$) |
|---|---|---|---|
| Total of all nuclides with less than 5 years half life | 700 | No limit | No limit |
| H-3 (Tritium) | 40 | No limit | No limit |
| Co-60 | 700 | No limit | No limit |
| Ni-63 | 3.5 | 70 | 700 |
| Ni-63 in activated metal | 35 | 700 | 7000 |
| Sr-90 | 0.04 | 150 | 7000 |
| Cs-137 | 1 | 44 | 4600 |
| C-14 | 0.8 | | 8 |
| C-14 in activated metal | 8 | | 80 |
| Ni-59 in activated metal | 22 | | 220 |
| Nb-94 in activated metal | 0.02 | | 0.2 |
| Tc-99 | 0.3 | | 3 |
| I-129 | 0.008 | | 0.08 |
| Alpha emitting transuranic nuclides with half life greater than 5 years | 10 nCi/g | | 100 nCi/g |
| Pu-241 | 350 nCi/g | | 3500 nCi/g |
| Cm-242 | 2000 nCi/g | | 20000 nCi/g |

Intermediate level waste (ILW) is radioactive waste that contains long lived radionuclides in quantities that need a greater degree of containment and isolation from the biosphere than is provided by near surface disposal. Disposal in a facility at a depth of between a few tens and a few hundreds of meters is indicated for ILW. Disposal at such depths has the potential to provide a long period of isolation from the accessible environment if both the natural barriers and the engineered barriers of the disposal system are selected properly. In particular, there is generally no detrimental effect of erosion at such depths in the short to medium term. Another important advantage of disposal at intermediate depths is that, in comparison to shallow surface disposal facilities suitable for LLW, the likelihood of inadvertent human intrusion is greatly reduced. Consequently, long term safety for disposal facilities at such intermediate depths will not depend on the application of institutional controls. Notably, ILW is a classification that is not used in the U.S. The IAEA regulations defining ILW are set forth in IAEA CSG-1.

High level waste (HLW) is produced by nuclear reactors and include SNF and/or reprocessing waste. HLW contains such large concentrations of both short and long lived radionuclides that a greater degree of containment and isolation from the accessible environment is needed to ensure long term safety. Containment and isolation is usually provided by the integrity and stability of deep geological disposal, with engineered barriers. HLW generates significant quantities of heat from radioactive decay, and normally continues to generate heat for several centuries. Heat dissipation is an important factor that has to be taken into account in the design of geological disposal facilities.

HLW typically has levels of activity concentration in the range of $10^4$-$10^6$ TBq/m$^3$ (e.g. for SNF recently discharged from power reactors). HLW includes conditioned waste arising from the reprocessing of SNF together with any other waste requiring a comparable degree of containment and isolation. At the time of disposal, following a few decades of cooling time, waste containing such mixed fission products typically has levels of activity concentration of around $10^4$ TBq/m$^3$. In the U.S., the regulations that define HLW are set forth in 10 CFR 60/63

In the U.S., transuranic waste (TRU) is radioactive waste that contains elements with atomic numbers (number of protons) greater than 92, the atomic number of uranium. The meaning of the term transuranic is above uranium. TRU includes only waste material that contains transuranic elements with half-lives greater than 20 years and concentrations greater than 100 nanocuries per gram. If the concentrations of the half-lives are below the limits, it is possible for waste to have transuranic elements but not be classified as TRU waste. The regulations defining transuranic waste are set forth in 10 CFR 61.55.

There are also other classes of radioactive waste including special form material (10 CFR 71.75; 49 CFR 173.476; IAEA TS-G-1.1), special nuclear material (10 CFR 70.4), source material (10 CFR 40.4), and by product material (10 CFR 30.4).

Standardized Container

The packaging system includes a modular container 10, one example of which is shown in FIGS. 1-4. The modular container 10 includes a structural lid 18 (alternatively referred to as a top closure) positioned on a main body 30 to enclose a cavity 14 for the radioactive waste. The main body 30 includes side walls 16, side and corner wall support members 24 (alternatively referred to as side and corner tubes or support tubes), and a base 20 (alternatively referred to as a support base). The base 20 includes a base plate 26 (alternatively referred to as a base member) and base support members 22. The support members 22, 24 provide additional robustness, strength, and rigidity to the modular container 10. The walls 16, the structural lid 18, and the base plate 26 form the interior boundary of the cavity 14 and serve to define the enclosure envelope 12 (alternatively referred to as a main enclosure or confinement boundary).

The modular container 10 can have any of a number of different configurations all of which are compatible with the other subsystems and/or components of the packaging system. Three specific configurations are described in greater detail and referred to as Grade A, B, and C modular container variants (the embodiment shown in FIGS. 1-4 corresponds to Grade B). The grades roughly correspond to the activity of the radioactive waste with Grade A being the most robust variant configured for use with the most active waste and Grade C being the least robust variant configured for use with the least active waste. It should be appreciated that the modular container 10 can have any number of grades or configurations.

The different configurations of the modular container 10 are easy to assemble and can be inexpensively mass produced in large quantities compared to conventional containers. In one embodiment, the parts of the modular container 10 are self-jigging which simplifies fit-up and assembly. Something is generally considered self-jigging when its component parts incorporate design features that ensure each component, when assembled, remains in proper relationship throughout the fastening process (e.g., welding, bolting, and the like) without the aid of auxiliary fixtures.

The dimensions and external features or interfaces of the modular container 10 are standardized for all grades, including the Grade A, B, and C variants. The external features are appurtenances on the exterior of the modular container 10 that facilitate remotely handling, moving, loading, lid placement, and/or stacking (as well as other operations) of the modular container 10. The features can include appurtenances such as standard lifting equipment, interfaces, and the like.

In one embodiment, the modular container 10 includes openings 34 (alternatively referred to as bottom pockets) in the base 20 to receive the forks of a forklift. The openings 34 can have any suitable configuration that allows them to receive the forks. In one embodiment, the openings 34 fully capture the forks to reduce the likelihood of the modular container 10 toppling during movement. The modular container 10 can also be lifted using the openings 34 with a suitable spreader bar or sling.

In another embodiment, the modular container 10 includes lifting members 28 (alternatively referred to as lifting lugs) on the structural lid 18 and/or the main body 30. The lifting members 28 can be used to remotely lift the structural lid 18 and the main body 30 together or separately and to guide stacking of the modular containers 10.

The structural lid 18 can also include guide members 32 that guide placement of the structural lid 18 on the main body 30 by remote means as necessary. In the embodiment shown in FIGS. 1 and 3, there are two guide members 32 extending outward from the base of each lifting member 28 on the structural lid 18. The guide members 32 are spaced apart to allow the corresponding lifting member 28 on the main body 30 to pass between the guide members 32. The top of the lifting members 28 on the main body 30 are rounded so that the guide members 32 easily move to the side to align the structural lid 18 with the main body 30.

The enclosure envelope 12 provides a robust confinement boundary for radioactive waste. The size and shape of the enclosure envelope 12 is standardized for all waste-forms and activity levels. In one embodiment, the enclosure envelope 12 is formed by coupling the structural lid 18 to the main body 30 with fasteners 42 such as bolts or the like. Once the structural lid 18 is in place, the fasteners 42 can be manually installed while the workers are frilly shielded from the radioactive waste by the main body 30 and the structural lid 18.

In one embodiment, the structural lid 18 has a stepped design that forms a shear key that resists lateral and other loads and maintains the seal. For example, the main body can include a flange 36 coupled to the outside of the side walls 16 just below their upper edges. The structural lid 18 is stepped around the edges to extend over the upper edges of the side walls 16 and down to the flange 36 (using a spacer 38 in the embodiment shown in FIG. 4). The structural lid 18 is coupled to the flange 36 using one or more sealing members 44, which can be a gasket, O-ring, or the like depending on the application. The enclosure envelope 12 can be welded and leak tested.

It should be appreciated that the various components of the modular container 10 and the packaging system as a whole can be fastened together in a variety of ways. Two of the most common ways include bolting and welding. It should be appreciated that any of the components of the packaging system can be coupled together using one or both of these techniques without explicitly reciting the same. The fasteners and/or fastening techniques used can be inspected (e.g., non-destructive examination of welds) and leak tested.

It should also be appreciated that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The modular container 10 can include a filtered cavity vent 40 depending on the application. The vent 40 is typically included in situations where the pressure inside the cavity 14 has the potential of exceeding design conditions. The vent 40 prevents this from happening by allowing gas to escape. A filter is used to prevent radioactive material from escaping through the vent 40.

The modular container 10 and any of its subsystems and/or components can be made of any suitable material. In general, the robustness and corrosion resistance of the material used to make the modular container 10 corresponds to the activity level of the radioactive waste. For example, the Grade C modular container can be made of lower cost materials such as structural carbon steel plate with comparatively reduced thickness and coated with decontaminable epoxy. The Grade A modular container variant 70 can be made of structural stainless steel plate with a comparatively increased thickness to provide increased structural capacity and corrosion resistance (no coating performance or maintenance issues over longer term) and to mitigate brittle fracture concerns.

Standardizing the size and shape of the enclosure envelope 12 of the modular container 10 facilitates common operational interfaces and allows more economical non-structural materials to be utilized for the separate shielding inserts. Fabricating the enclosure envelope 12 to Type A transportation packaging standards avoids costly Type B transportation packaging fabrication for every container. This decouples modular container production manufacturing from more rigorous Type B transportation packaging licensing constraints.

The modular container 10 can have any suitable shape so long as the other components and subsystems of the packaging system have a corresponding shape to preserve the modular nature of the system. It is preferable for the modular container 10 to have a cuboidal shape such as those shown in the Figures. The cuboidal shape of the modular container 10 with separate shielding inserts has a number of advantages relative to conventional cylindrical containers with concentric shells and integral shielding such as more efficient volume utilization, simpler loading, handling, and stacking, and the ease of fabrication and assembly sequencing. However, it should be appreciated that the modular container 10 can have other shapes such as cylindrical.

The modular container 10 can be used with any type and/or form of radioactive waste that can physically fit in it. Examples of suitable types of radioactive waste include: solid waste—highly activated or surface contaminated components; granular waste—metallic fines, concrete ruble or excavated materials in drop-in liner; wet waste—stabilized liquid waste positioned in a support framework with one or more subcontainers; and other waste—smaller spent fuels, special form waste, and low to moderate pressure and heat generating wastes with application-specific inserts.

The modular container 10 is especially useful for radioactive waste that exceeds Class A, but can also be used with Class A waste although such waste does not typically require such a robust engineered container. In one embodiment, the modular container 10 can be configured to be used with radioactive waste having higher concentrations of short lived isotopes such as Class B and C low level waste that has low concentrations of long-lived isotopes (see 10 CFR 61.55 and IAEA CSG-1). The modular container 10 can also be configured to be used with waste having high concentrations of short and/or long-lived isotopes such as greater than Class C waste (GTCC) (see 10 CFR 61.55), intermediate level waste (see IAEA CSG-1), transuranic waste (see 10 CFR 61.55), and high level waste (see 10 CFR 60/63).

The modular container 10 can also be configured to hold special form material such as indispersible radioisotope material and sealed capsule containing radioisotope material (see 10 CFR 71.75 and 49 CFR 173.476, IAEA TS-G-1.1) It can also be configured to hold by-product material such as fuel and strategic nuclear material production waste such as source material tailings as well as byproduct waste from commercial, medical, or research activities (see 10 CFR 30.4). It should be appreciated that U.S. and IAEA regulations are typically referenced in this document with the understanding that other similar or corresponding regulations can be applicable depending on the jurisdiction.

The modular container 10 can be configured to hold some types of SNF. This can be done using the Grade A container envelope and associated shielding inserts for the modular container 10 and using content-specific cavity features such as nuclear fuel specific loading baskets. In general, SNF that can be put in the modular container 10 are those that have compact geometry, lower decay heat flux, and lower pressure generation compared to LWR fuels. Examples include advanced gas-cooled reactor (AGR) oxide fuel, metallic uranium fuels such as materials testing reactor (MTR) and TRIGA research reactor fuels, natural uranium fuels such as Canada deuterium uranium (CANDU) and Magnox reactor fuels, as well as other defense and research reactor fuels that fit.

The modular container 10 can be used for interim storage of radioactive waste on-site or at an off-site interim storage facility (indoor or outdoor interim storage). The Grades A, B, and C modular containers meet on-site interim storage, off-site transport as Type A or IP-2 packaging, and disposal requirements including accidental drop depending on the application. The lid closure system also satisfies Type A and IP-2 packaging requirements. It can also be used to transport the radioactive waste off-site if the waste is subject to Type A and/or IP-2 requirements at the time of loading or following decay in interim storage. If the waste is subject to the Type B requirements, then the modular container 10 can be packaged in a reusable transport overpack specifically designed for the modular container 10 that meets Type B requirements.

TABLE 2

Modular Container Storage, Transport, and Disposal

| Modular Container Grade | Interim Storage | Offsite Transport | Disposal |
|---|---|---|---|
| A | 10 CFR 72 | Type A as-is or overpack as Type B | Geologic disposal as-is or in disposal overpack |
| B | Type A plus site-specific | Type A as-is or overpack as Type B | Geologic disposal as-is |
| C | IP-2 | IP-2 | Surface disposal as-is |

Shielding Inserts

The modular container 10 can include modular shielding inserts (alternatively referred to as modular shielding slabs) with variable thicknesses to customize the modular container 10 to the activity level of the radioactive waste. The modular container 10 and modular shielding inserts provide a number of advantages compared to conventional containers. The modular container 10 with modular shielding inserts is shown in FIGS. 5-9.

The modular nature of both the container 10 and the shielding inserts simplifies the supply chain, shortens the delivery schedule, and allows more efficient parallel manufacturing. For example, the modular container 10 can be manufactured using higher precision nuclear-grade manufacturing processes that use, for example, fixturing to achieve low-defect production and repeatable mass production of consistently high quality product. This mitigates the high cost and delays due to non-conforming product.

The shielding inserts can be manufactured in parallel with the modular container 10 using lower precision manufacturing processes. The shielding inserts can be delivered for assembly in near final form. The shielding inserts can be placed in the modular container 10 near where the modular container 10 will be used. The modular nature of both the container 10 and the shielding inserts avoids serial manufacturing that conventional integral welded containers require.

The use of the modular container 10 and the modular shielding inserts allows multiple container variants to be assembled and delivered in response to varying project demands and batch-specific waste streams. It also enables market driven costing and a robust supply chain. The modular design of the components makes it well suited for local sourcing of supply and production allowing for maximum diversity, flexibility, and localization. It also allows for multiple material options that facilitate competitive sourcing and allows for reduced lead time for material, production, and delivery.

The shielding inserts are self-locking and self-supporting. Once in place, the shielding inserts do not need any additional structure or joining to support them. The shielding inserts are positioned so that the seams between the inserts do not provide a direct path for radiation shine to the enclosure envelope 12.

Referring to FIGS. 5-9, the modular container 10 includes a lid shielding insert 50 (alternatively referred to as a top shielding insert, lid shielding slab, or top shielding slab), a base shielding insert or slab 52 (alternative referred to as a bottom shielding insert, base shielding slab, or bottom shielding slab), wall shielding inserts 54 (alternatively referred to as wall shielding slabs), and corner shielding inserts 56 (alternatively referred to as corner post shielding inserts or corner posts).

Figure 6:
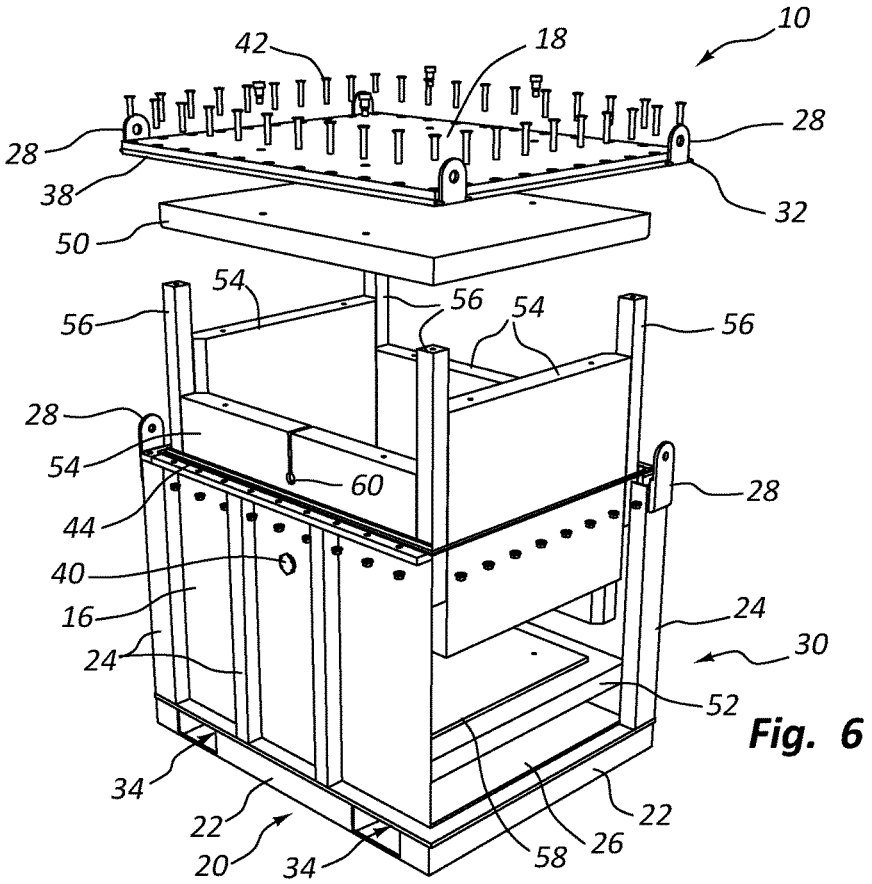
FIG. 6 is a perspective view of the modular container shown in FIG. 5 with the shielding inserts partially exploded.
Figure 7:
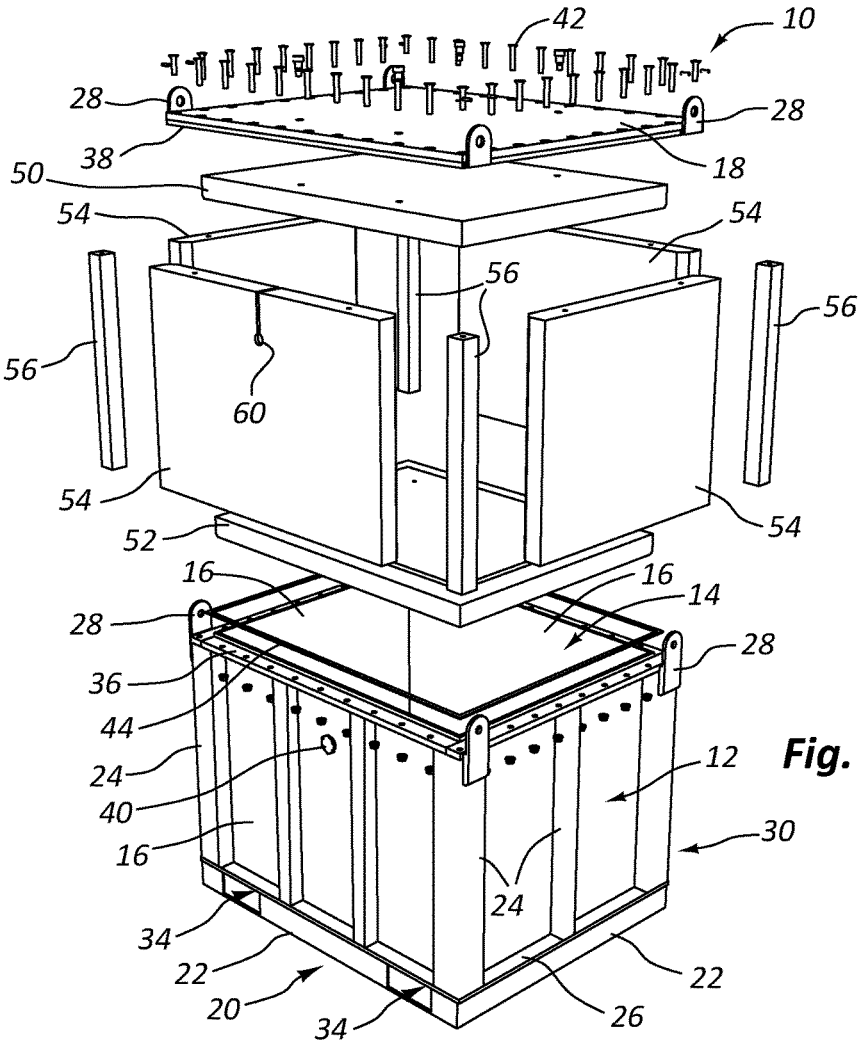
FIG. 7 is a perspective view of the modular container shown in FIG. 5 with the shielding inserts exploded.
Figure 8:
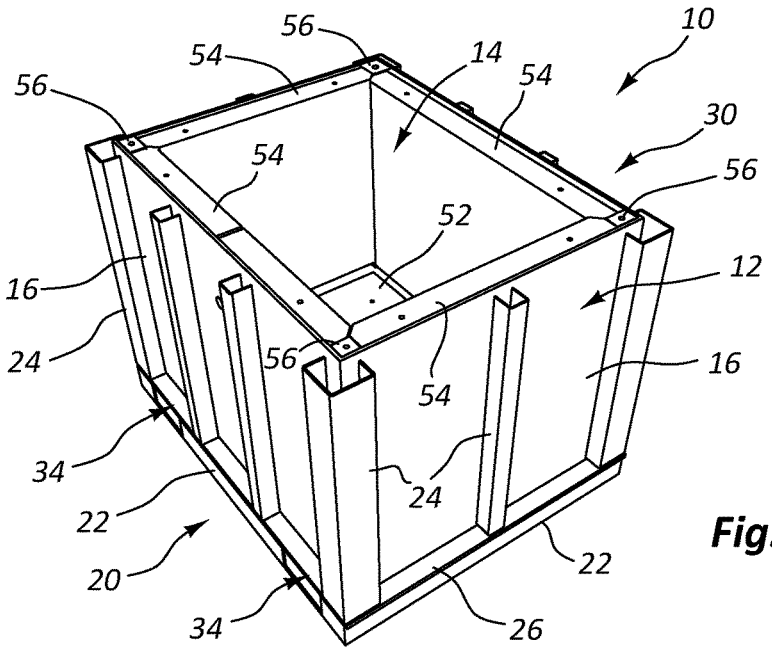
FIG. 8 is a perspective view of the modular container shown in FIG. 5 with a cross-section taken through a horizontal plane of the modular container.
Figure 9:
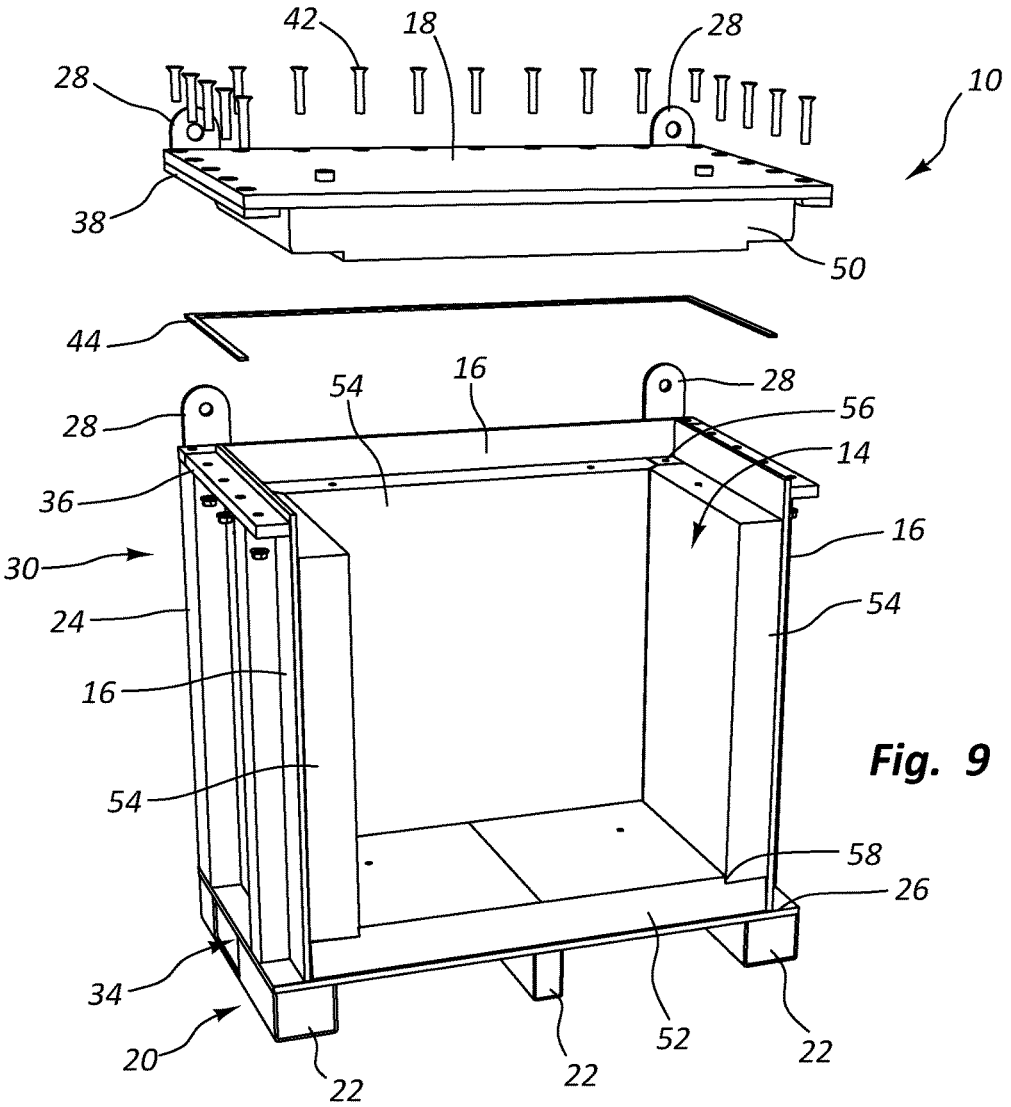
FIG. 9 is a perspective view of the modular container shown in FIG. 5 with a cross-section taken through a vertical plane of the modular container.

In one embodiment, the lid shielding insert 50 and/or the base shielding insert 52 have stepped edges 58 that register with the wall shielding inserts 54 as shown best in FIGS. 6 and 9. In another embodiment, the base shielding insert 52 is flush and an additional plate is inserted on top of the base shielding insert 52 to secure the wall shielding inserts 54 in place. The wall shielding inserts 54 have relaxed tolerances to make it easy to assemble the inserts. The corner shielding inserts 56 have tighter tolerances to secure wall shielding inserts 54 in place. The wall shielding insert 54 on the left side of the modular container 10 in FIGS. 6 and 7 includes a hole 60 for the vent 40.

The joints between the wall shielding inserts 54 and the lid and base shielding inserts 50, 52 have a stepped geometry. The joints between the wall shielding inserts and the corner shielding inserts 56 have an oblique geometry. In one embodiment, the joints between the shielding inserts 50, 52, 54, 56 can be caulked or otherwise filled to provide an additional barrier to prevent migration of fines and loose particulates in those applications that require it. An example of one type of suitable filler material is inorganic silicone sealant. Alternatively, a drop-in liner can be used for waste that contains a significant amount of loose material.

It should be appreciated that the shielding inserts can have any suitable configuration that allows them to securely fit inside the cavity 14 of the modular container 10. Also, the modular container can include more or less than four shielding inserts. For example, the corner shielding inserts can be integrated into the wall shielding inserts 54 or the base shielding insert can be provided in multiple pieces. Numerous variations are possible.

In one embodiment, the modular container 10 has a cavity 14 with the dimensions shown in the table below. The size of the cavity 14 changes depending on the thickness of the shielding inserts. In general, the shielding inserts can range in thickness from 1 inch to 12 inches (25 mm to 305 mm). The size of the cavity 14 is shown in the table for a given shielding insert thickness.

TABLE 3

Shielding Thickness and Cavity Size of One Embodiment of the Modular Container

| Shielding Insert Thickness | | Cavity Length | | Cavity Width | | Cavity Height | | Cavity Volume | |
|---|---|---|---|---|---|---|---|---|---|
| (in) | (mm) | (in) | (mm) | (in) | (mm) | (in) | (mm) | ($ft^3$) | ($m^3$) |
| None | None | 80.00 | 2032 | 63.00 | 1600 | 60.00 | 1524 | 175 | 5.0 |
| 4.0 | 102 | 71.75 | 1822 | 54.75 | 1391 | 51.75 | 1314 | 118 | 3.3 |
| 6.0 | 152 | 67.75 | 1721 | 50.75 | 1289 | 47.75 | 1213 | 95 | 2.7 |
| 9.0 | 229 | 61.75 | 1568 | 44.75 | 1137 | 42.75 | 1086 | 68 | 1.9 |
| 12.0 | 305 | 55.75 | 1416 | 38.75 | 984 | 36.75 | 933 | 46 | 1.3 |

The shielding inserts can be made from any suitable type of shielding material such as metallic or cementitious materials. The modular container 10 can include shielding inserts made of the same material or different materials. For example, the base shielding insert 52 can be made of one material and the corner shielding insert 56 can be made of another material. In general, the shielding inserts are non-structural, low precision simple shapes.

Suitable materials for the shielding inserts include metal material such as steel (wrought, cast, or rolled), cast iron, lead, and depleted uranium metal. The metal material can be virgin or recycled. Another suitable material can be high density concrete such as: (1) heavy aggregates per ACI-211.1, ACI-304, and ASTM C637 & C638 (the ASTM standards describe radiation shielding concrete), (2) depleted uranium aggregate per ASTM C289 & C295 and BS 6073. The following table provides some additional examples of suitable shielding materials.

TABLE 4

Examples of Shielding Insert Materials

| | Shielding Unit Weight $lb/ft^3$ ($g/cm^3$) |
|---|---|
| Cast High Density Concrete with Welded Wire Fabric Reinforcement (cast with various commercially available virgin aggregate types) | |
| Limonite/goethite hydrous iron ores | 180-195 (2.9-3.1) |
| Barite/baryte barium sulfate | 205-225 (3.3-3.6) |
| Ilmenite/hematite/magnetite iron ores | 215-240 (3.4-3.8) |
| Steel/iron shot, pellets or punchings | 310-350 (5.0-5.6) |
| Cast from Recycled Low Specific Activity Contaminated Steel (up to 100% by volume) | |
| Ductile/nodular cast iron slabs | 450 (7.2) |
| Cast ferritic steel slabs | 470 (7.5) |
| Cast austenitic steel slabs | 490 (7.6) |
| Manufactured from Virgin Materials (procured from commercial Metals16 mills/foundries) | |
| Ductile/nodular cast iron slabs | 450 (7.2) |
| Steel casting slabs | 470 (7.5) |
| Hot rolled carbon steel plate | 490 (7.6) |
| Cast from Recycled Other Low Specific Activity Metals (up to 100% by volume) | |
| Depleted uranium concrete (Ducrete) | 559 (8.9) |
| Cast lead | 705 (11.3) |
| Cast depleted uranium metal | 1,192 (19.1) |

In one embodiment, the shielding inserts are made of 100% recycled metal. The use of 100% recycled metal provides very efficient shielding for better ALARA (as low as reasonably achievable). ALARA refers the radiation safety principle for minimizing radiation doses and releases of radioactive materials by employing all reasonable methods.

Examples of recycled metals that can be used to make the shielding inserts include LSA contaminated steel, lead, DU metal, and DU aggregate in DU concrete. Recycling of radioactive waste metals reduces the total volume of contaminated metal that needs to be disposed. Recycling also eliminates the need to package and dispose of such waste metal separately. The unit costs for recycling may initially be higher compared with virgin material, but lifecycle costs are lower considering avoided disposal costs.

The structural lid 18 and the lid shielding insert 50 together form a lid assembly that can be installed in the field as a single assembled unit. For example, the structural lid 18 and the lid shielding insert 50 are coupled together and the entire lid assembly is coupled to the main body 30. Alternatively, the structural lid 18 and lid shielding insert 50 can be installed separately. For example, the lid shielding insert 50 is placed over the cavity 14 then the structural lid 18 is coupled to the main body 30.

Likewise, the lid shielding insert 50 can be removed with the structural lid 18 or separate from the structural lid 18. For example, it may be desirable to remove them both together to access sub-container process fittings for stabilizing waste. It may be desirable to remove them separately to enable replacement of the seal member 44 of the modular container 10 while still keeping the shielding in place. In this situation, the structural lid 18 is removed while the lid shielding insert 50 remains in place to allow the seal member 44 to be replaced.

Figure 10:
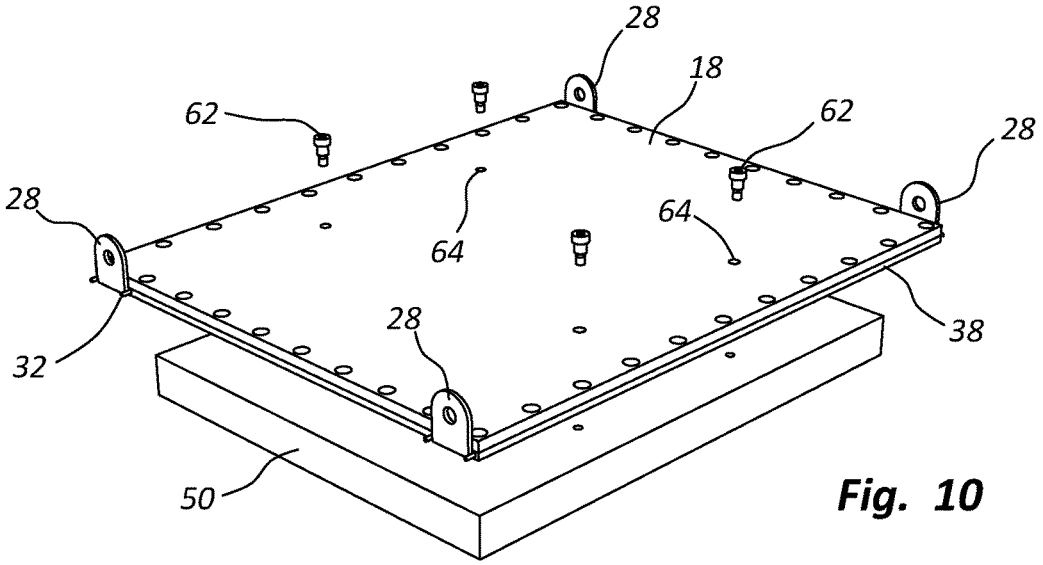
FIG. 10 is an exploded, perspective view of the lid and corresponding shielding insert from the modular container shown in FIG. 5.

Referring to FIG. 10, the lid shielding insert 50 can be coupled to the structural lid 18 in a variety of ways. In general, the lid shielding insert 50 should be coupled to the structural lid 18 so that any holes formed in the structural lid 18 are sealed. This can be accomplished in a variety of ways. In one embodiment, the lid shielding insert 50 is coupled to the underside of the structural lid 18 with fasteners 62 that extend through holes 64 in the structural lid 18.

In one embodiment, fasteners 62 are shoulder bolts having a threaded shoulder that seals the hole 64 in the structural lid 18. In another embodiment, the fasteners 62 are self-sealing cap screws. In yet another embodiment, the fasteners 62 are threaded wedge anchors drilled into the lid shielding insert 50. Numerous variations are possible.

Grade A Container Variant

Figure 11:
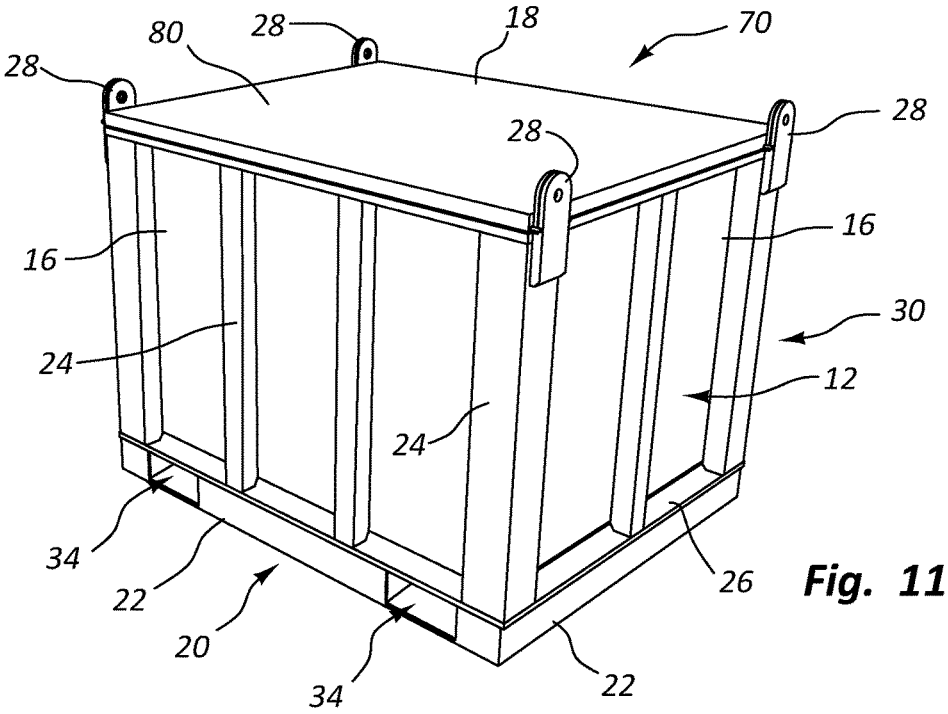
FIG. 11 is a perspective view of one embodiment of a Grade A modular container.
Figure 12:
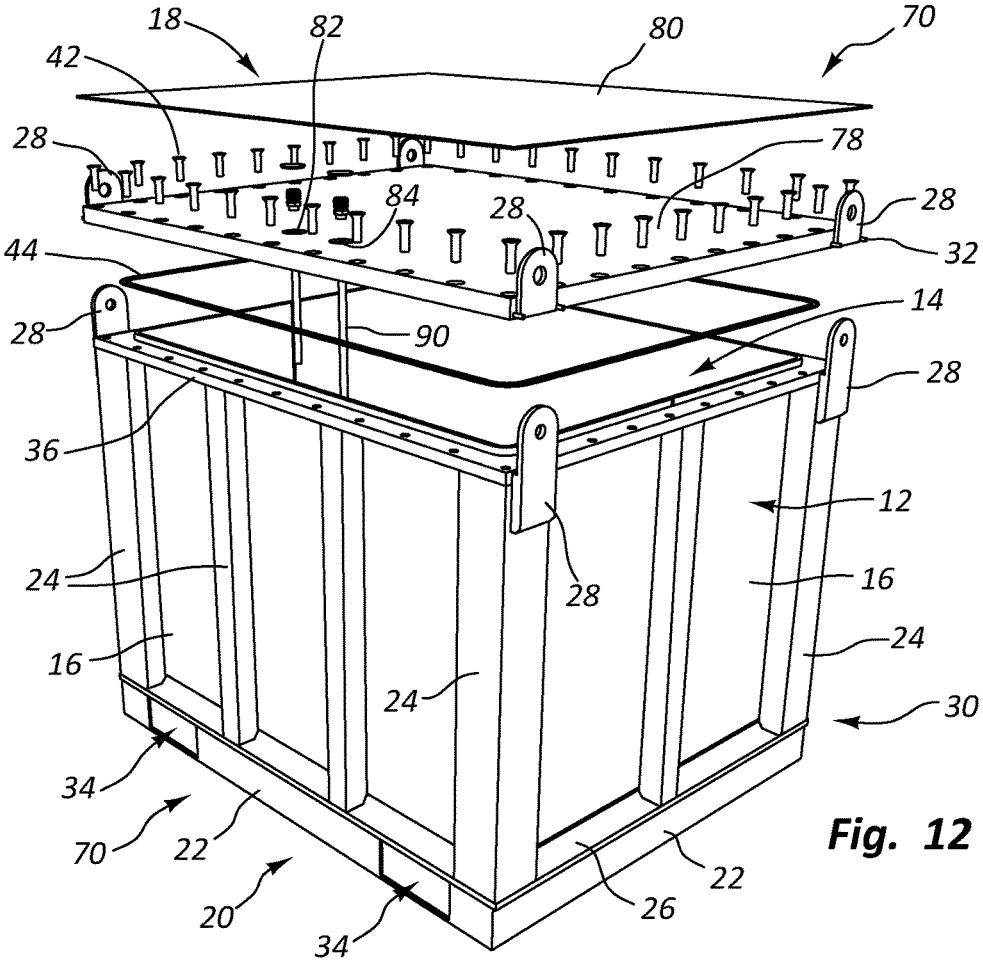
FIG. 12 is a perspective view of the Grade A modular container shown in FIG. 11 with the lid raised.
Figure 13:
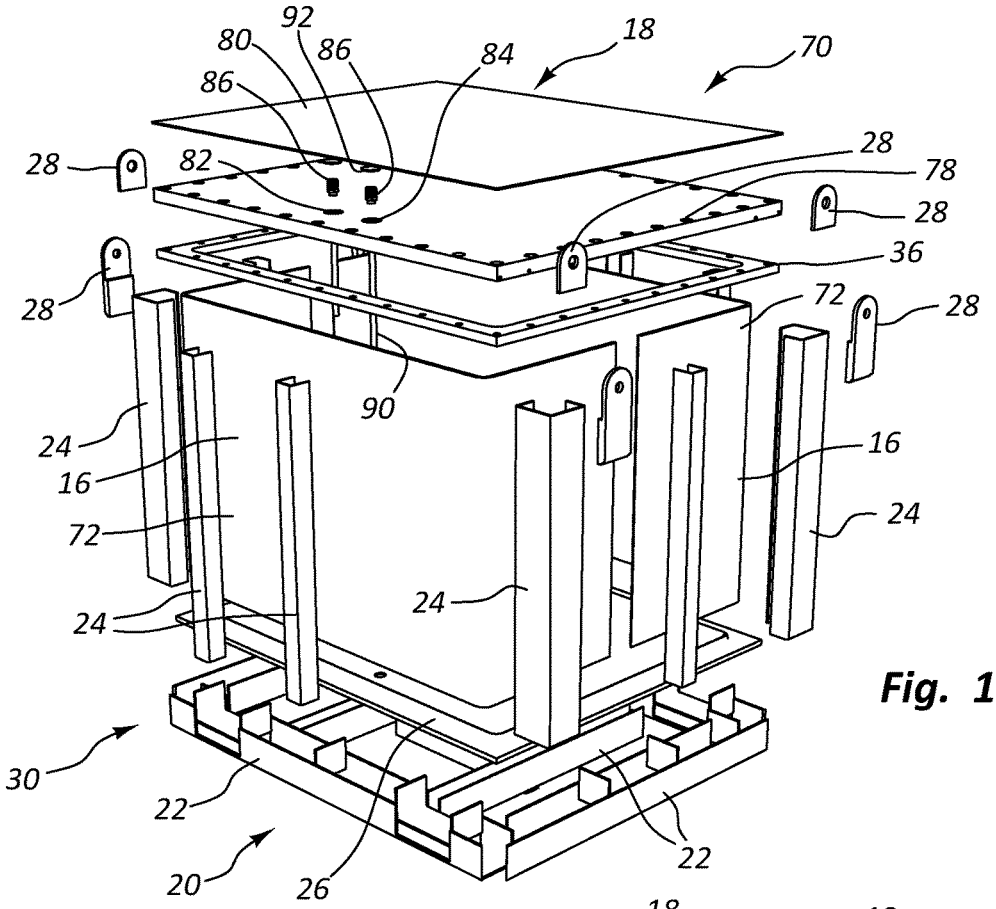
FIG. 13 is an exploded, perspective view of the Grade A modular container shown in FIG. 11.

FIGS. 11-13 show one embodiment of a Grade A modular container variant 70 (alternatively referred to as the Grade A container or Grade A modular container). The Grade A container variant 70 is configured to be used with higher activity radioactive waste including some types of SNF, HLW, and other wastes with the longest lived isotopes. It should be appreciated, however, that the Grade A container variant 70 can be used with any class or type of radioactive waste.

In one embodiment, the Grade A container variant 70 is especially suited for certain types of SNF and HLW such as those that: (a) have small profiles and unique configurations that make them less suitable for storage in a large LWR spent fuel cask—e.g., fuel having a relative small cross-section and short length, (b) generate low container internal pressures—e.g., rod/cladding pressures are low compared to typical LWR fuels, (c) have low decay heats compared to typical LWR fuels—e.g., sealed/inerted container is adequate for heat removal, (d) are from smaller/older facilities with physical constraints and limited capability to handle large conventional LWR casks.

The Grade A container variant 70 which is the most robust container variant is similar in many ways to the modular container 10 shown in FIGS. 1-4 except that a number of the features of the Grade A container variant 70 have been upgraded to accommodate the higher activity of the radioactive waste. For example, upgraded features can include the materials and design details such as weld joints used to make the container 70 and especially the enclosure envelope 12, the structural lid 18 and seal members 44, additional features for draining, drying, leak testing, and inerting the interior of the cavity 14.

In one embodiment, the enclosure envelope 12 and/or the entire Grade A container variant 70 is made in compliance with ASME Section III (materials, fabrication, and testing). For example, the enclosure envelope 12 can be made of ½ inch to 1 inch (12 mm to 26 mm) thick stainless steel plate with complete penetration weld joints with geometric transitions to provide better impact toughness, weld strength, pressure rating, and corrosion resistance.

In one embodiment, the enclosure envelope 12 and/or the entire Grade A container variant 70 can be made of SA240 Type 316/316L austenitic stainless steel for increased long term corrosion performance. This configuration is suitable for a normal operating pressure of 20-25 psig. In another embodiment, the enclosure envelope 12 and/or the entire Grade A container variant 70 can be made of high strength material such as SA-240 Type XM-19 (nitronic 50 alloy) austenitic stainless steel or SA-693 Type 630 (17-4PH alloy) martensitic stainless steel to accommodate higher internal pressures and more severe postulated drop accident conditions.

Figure 4:
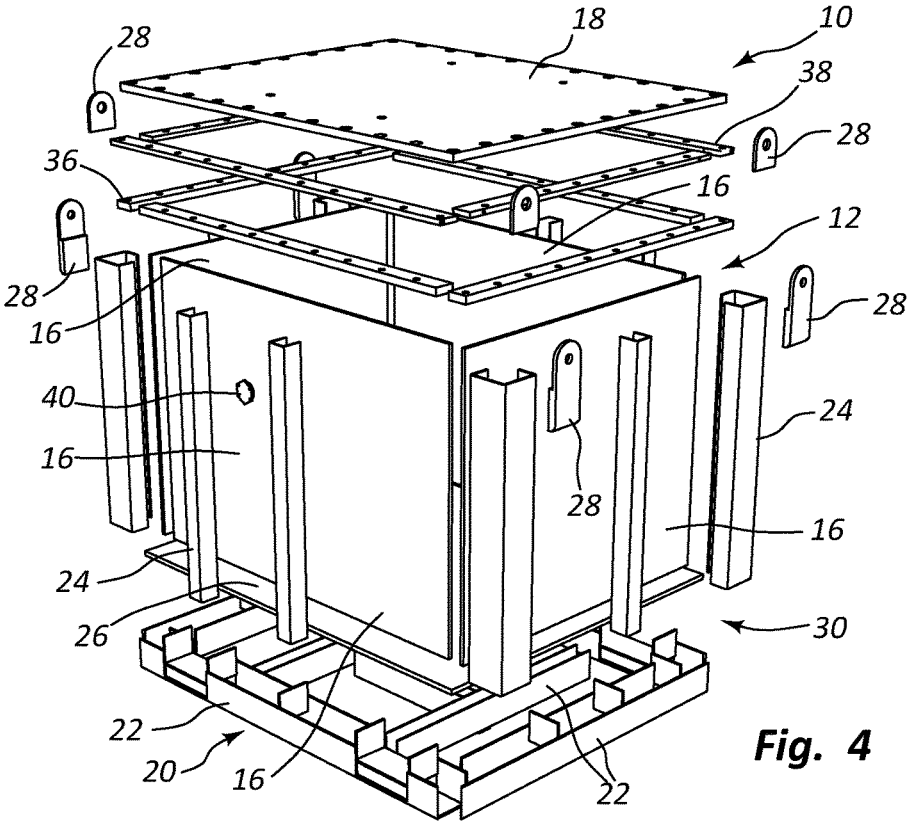
FIG. 4 is an exploded, perspective view of the modular container shown in FIG. 1.
Figure 5:
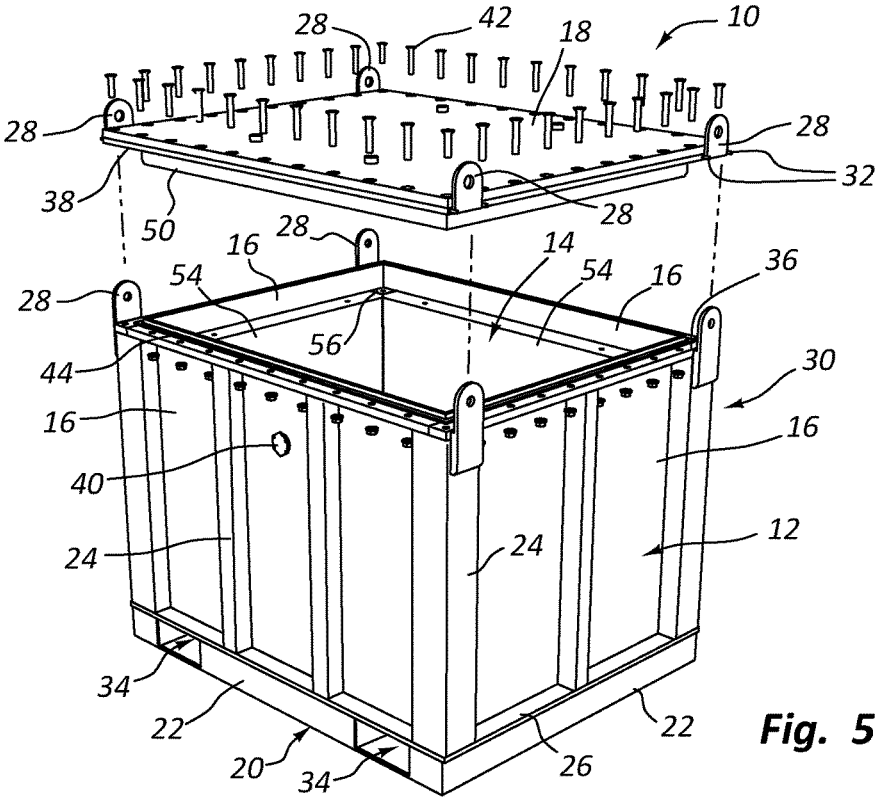
FIG. 5 is a perspective view of the modular container shown in FIG. 3 with shielding inserts positioned in the waste cavity.
Figure 14:
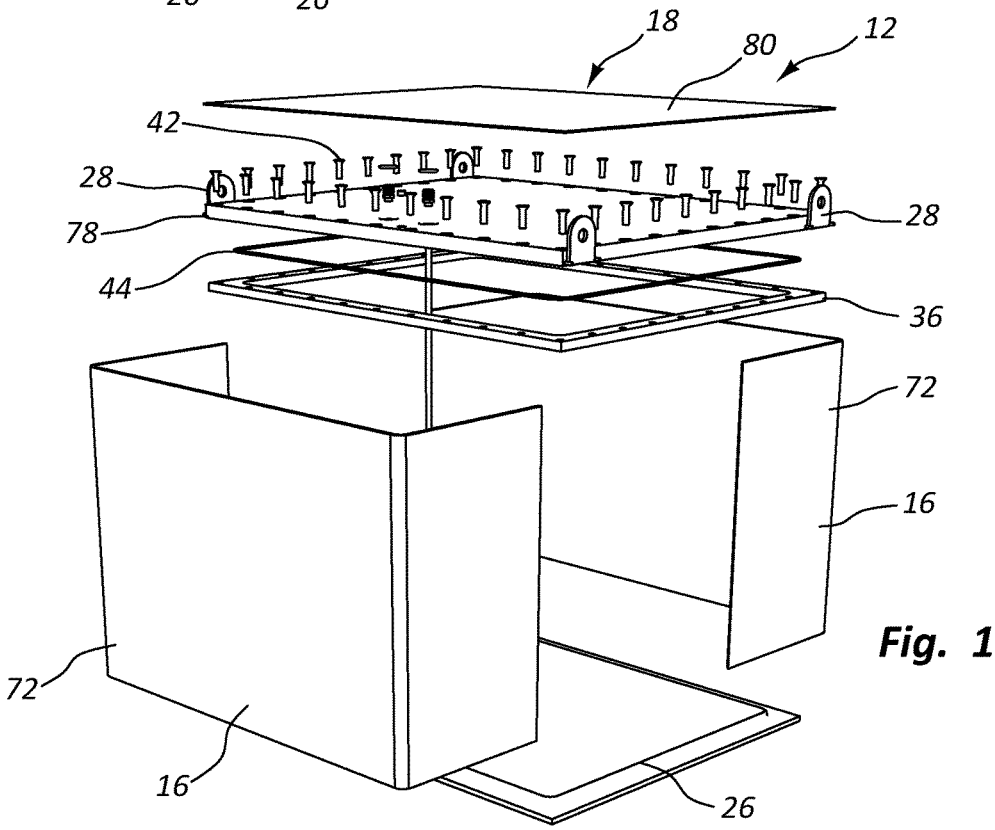
FIG. 14 is an exploded view of the enclosure envelope of the Grade A modular container shown in FIG. 11.
Figure 15:
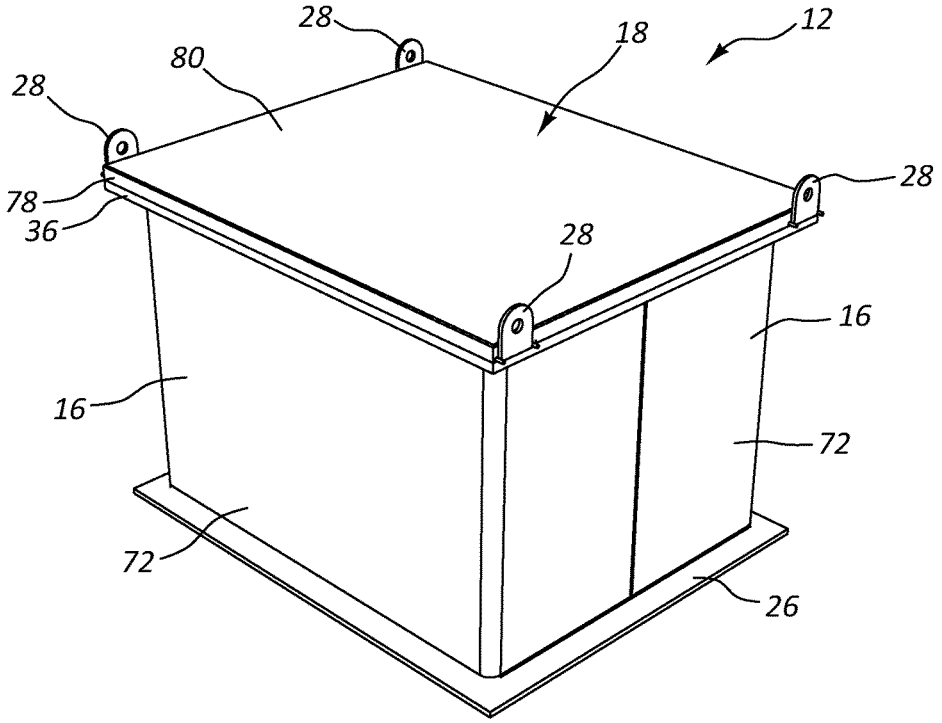
FIG. 15 is an assembled, perspective view of the Grade A modular container shown in FIG. 11.
Figure 16:
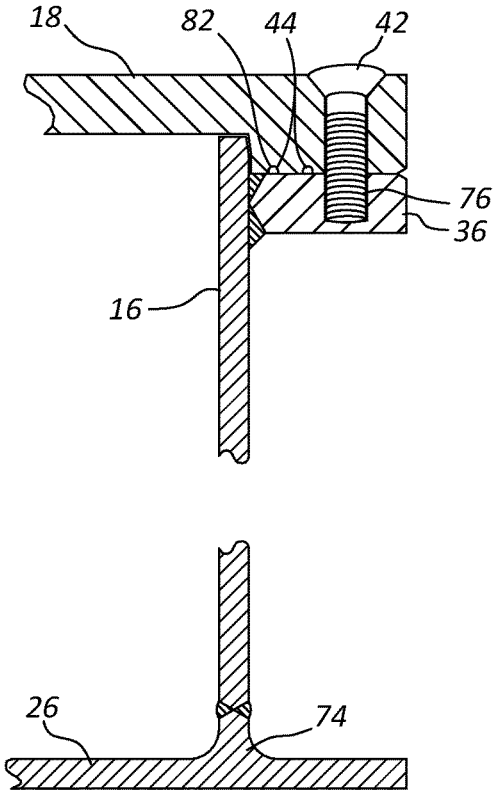
FIGS. 16-17 are cross-sectional views of the lid attached to the main body and the wall attached to the base plate of the Grade A modular container shown in FIG. 11.
Figure 17:
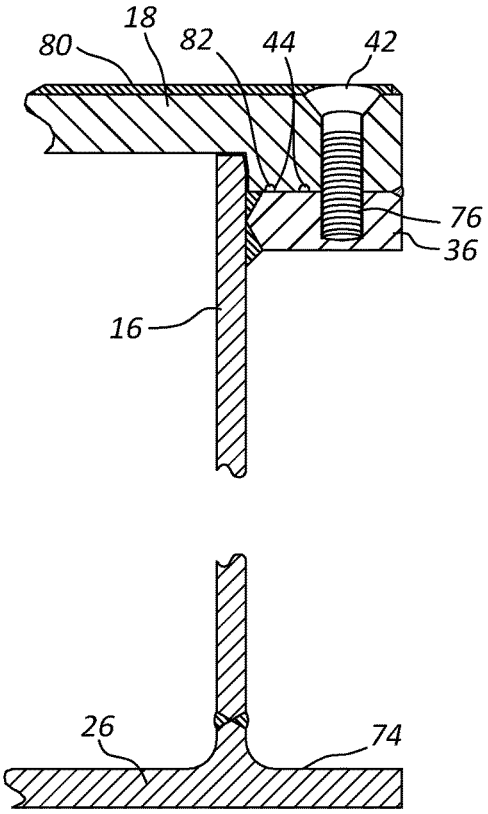

Referring to FIGS. 13-15, the walls 16 of the enclosure envelope 12 for the Grade A container variant 70 can be made of two U-shaped or four L-shaped side plates 72 to provide increased strength and load capacity instead of the four plates with corner joints shown in FIG. 4. In this embodiment, the plates 72 can be formed with 2t radius inside corners and coupled together using mid-wall weld joints to provide a transition for bending stresses. In one embodiment, the plates 72 are butt welded using full penetration welds (FIGS. 16-17 show examples of full penetration welds). The welds can be examined using volumetric, non-destructive, radiographic testing.

The base plate 26 of the enclosure envelope 12 for the Grade A container variant 70 can be machined from a 1.5 inch to 2.5 inch (38 mm to 64 mm) thick plate of steel. Referring to FIGS. 16-17, the base plate 26 can include raised weld necks transition joints 74. The walls 16 are coupled to the weld necks 74 using full penetration butt welds. The welds can be examined using volumetric, non-destructive, radiographic testing. This provides superior strength and robustness compared to partial penetration bottom corner weld joints.

In one embodiment, all Grade A container containment welds can be examined using full penetration, non-destructive, radiographic testing (e.g., formed corners, base plate 26 weld neck 74, and the like). Moreover, all mating and sealing surfaces can be machined and sealed with one or more sealing members 44.

Referring to FIGS. 12-17, the structural lid 18 of the Grade A container variant 70 and the manner in which it is coupled to the main body 30 can be upgraded. For example, the flange 36 can be cut from a full-size steel plate that is 1 inch to 2 inches thick (25 mm to 51 mm). This eliminates the joints at the corners that result from four bars being joined together as shown in FIG. 4 for the Grade B container variant 10 (and Grade C container variant 120, see below). Referring to FIGS. 16-17, the flange 36 can be coupled to the walls 16 using full penetration welds. Also, the flange 36 can include threaded bores 76 to receive the fasteners 42. The bores 76 extend partially through the flange 36 instead of completely through the flange 36 to eliminate potential leak paths when the structural lid 18 is installed.

The structural lid 18 for the Grade A container variant 70 can include a one-piece, solid, unbroken lid plate 78 machined from steel having of thickness of 2 inches to 3 inches (50 mm to 77 mm). The lid plate 78 is stepped in the manner shown in FIGS. 16-17 so that the outer edges of the lid plate 78 fit over the upper edge of the walls 16.

The structural lid 18 for the Grade A container variant 70 can be coupled to the main body 30 using upgraded fasteners 42. Examples of suitable fasteners 42 include SA-320 grade L43 pressure vessel flathead bolts. In one embodiment, the fasteners 42 are recessed into the structural lid 18 to protect the fasteners 42 during handling or stacking. In another embodiment, the Grade A container variant 70 is configured to allow the fasteners 42 to be easily installed while standing at grade level using standard tools.

The structural lid 18 and the top lip of the walls 16 form a shear key that resists lateral loads. The fasteners 42 are not loaded in the shear plane. Also, there are no welds in the shear plane, which serves to increase the strength of the Grade A container variant 70 and the robustness of the seal between the structural lid 18 and the main body 30.

The structural lid 18 can be sealed to the main body 30 in any suitable manner. In one embodiment, the structural lid 18 and the main body 30 are sealed together using one or more sealing members 44. Referring to FIGS. 16-17, the structural lid 18 for the Grade A container variant 70 can be sealed to the flange 36 using at least two sealing members 44 that fit in corresponding grooves 82 in the structural lid 18. In one embodiment, the sealing members 44 are O-ring seals made of an elastomeric material such as butyl rubber. The lid plate 78 for the Grade A container variant 70 can also be welded to the flange 36 along its entire perimeter as shown in FIGS. 16-17 to provide a more robust seal.

The Grade A container variant 70 can be sealed to prevent leaks. In one embodiment, the Grade A container variant 70 provides leak tightness to at least $10^{-6}$ $cm^3$/see via pressure drop test on the interspace between the sealing members 44 for the rated maximum normal operating pressure (unvented). The enclosure envelope 12 of the Grade A container variant 70 is typically pressure retaining and is not vented in this instance. In one embodiment, a test port is provided to test the pressure drop on the interspace between the sealing members 44.

Referring to FIG. 17, the structural lid 18 can include a top cover plate 80 to further seal the Grade A container variant 70. The top cover plate 80 is coupled to the lid plate 78 by welding or other suitable techniques to seal the top of the structural lid 18. In one embodiment, the top cover plate 80 can be welded to the lid plate 78 along the entire perimeter. The top cover plate 80 can be used to eliminate the need for continuous pressure monitoring of seals during interim storage or as an alternative to seal replacement following extended interim storage.

The Grade A container variant 70 can be used to remotely load waste in a wet or dry environment. In one embodiment, the Grade A container variant 70 includes features for draining, drying, leak testing, and inerting the cavity 14. These features are useful in situations where the Grade A container variant 70 is loaded underwater, such as in a SNF pool. These features allow the Grade A container variant 70 to be drained, dried, and leak tested after being loaded with waste. They can also be used to fill the cavity 14 with an inert gas.

Figure 18:
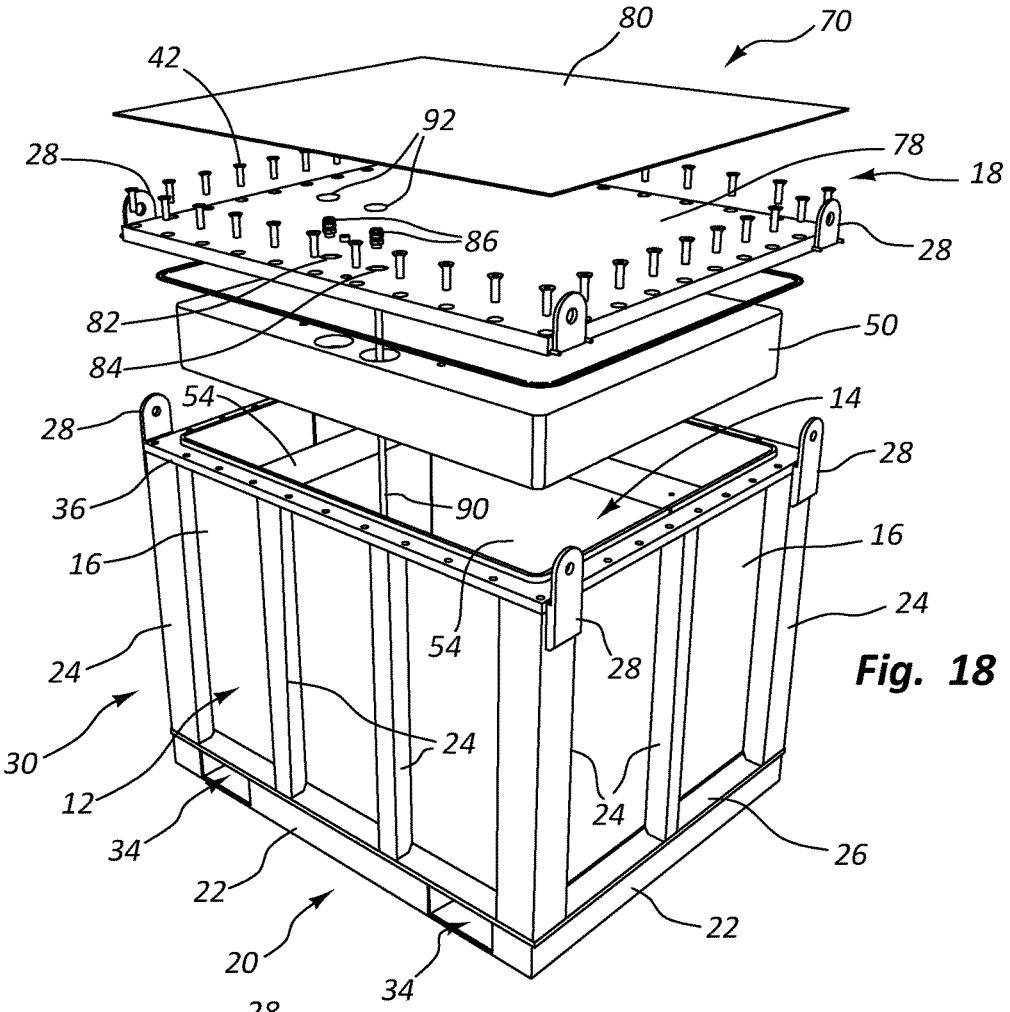
FIG. 18 is a perspective view of the Grade A modular container shown in FIG. 11 with shielding inserts positioned in the cavity, the lid raised, and shielding inserts partially exploded.
Figure 19:
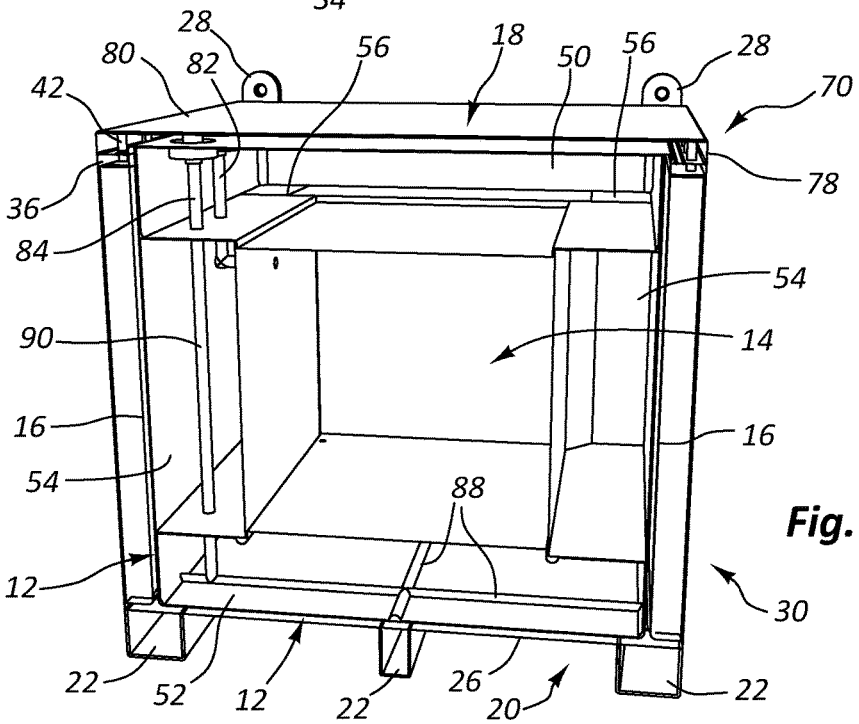
FIG. 19 is a perspective view of the Grade A modular container shown in FIG. 11 with a cross-section taken through a vertical plane of the Grade A modular container.
Figure 20:
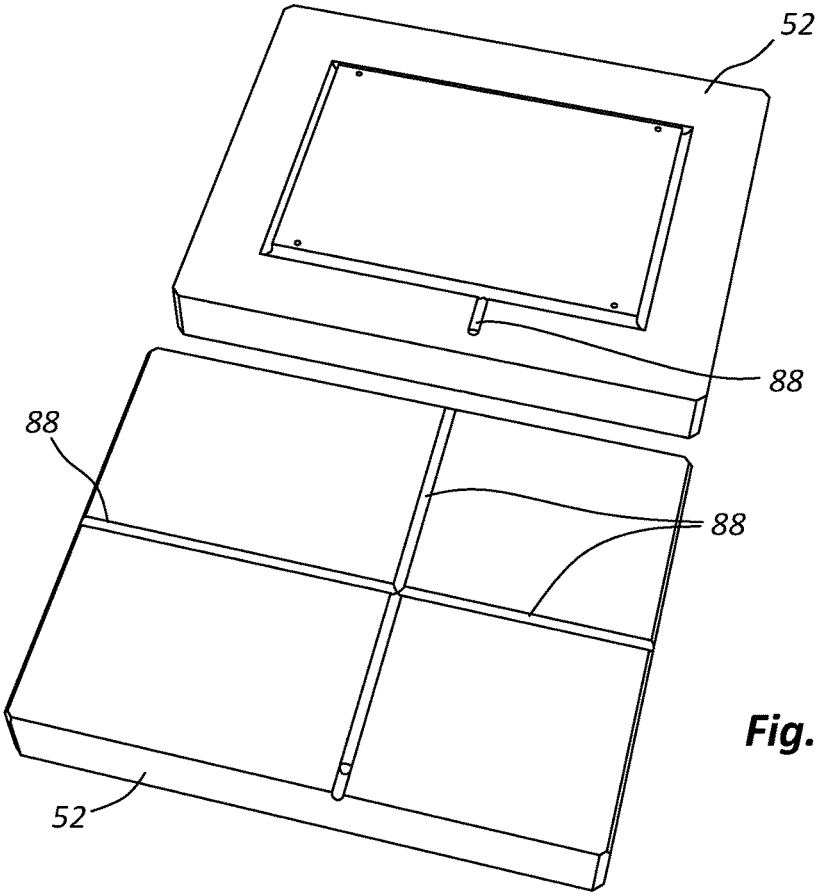
FIG. 20 is a perspective view of the top and bottom sides of the base shielding insert in the Grade A modular container shown in FIG. 18.

Referring to FIGS. 18-20, the Grade A container variant 70 includes a vent port 82 and a drain 84. The vent port 82 is a dog-leg passage through the lid plate 18 and wall shielding insert 54 to the cavity 14. Excess gas from the cavity 14 can be vented through the vent port 82. The ports 82, 84 can be sealed shut with the port covers 92 after the Grade A container variant 70 has been drained, dried, leak tested, and/or inerted. In one embodiment, the port covers 92 can be welded to the lid plate 78.

A drain tube 90 passes through the drain port 84 and through the shielding inserts 50, 52, 54 to the bottom of the enclosure envelope 12. The drain tube 90 can be used to remove water from the cavity 14. Fittings 86 can be coupled to the structural lid 18 to allow processing equipment to be coupled to the ports 82, 84. For example, the fittings 86 can be Swagelok type fittings that can be coupled to a vacuum drying skid or the like.

Referring to FIGS. 19-20, the base shielding insert 52 can include grooves 88 that convey water to the drain tube 90. Once the cavity 14 is dry, it can be filled with an inert gas such as helium to assist with removing excess heat and maintaining the integrity of the SNF.

Figure 21:
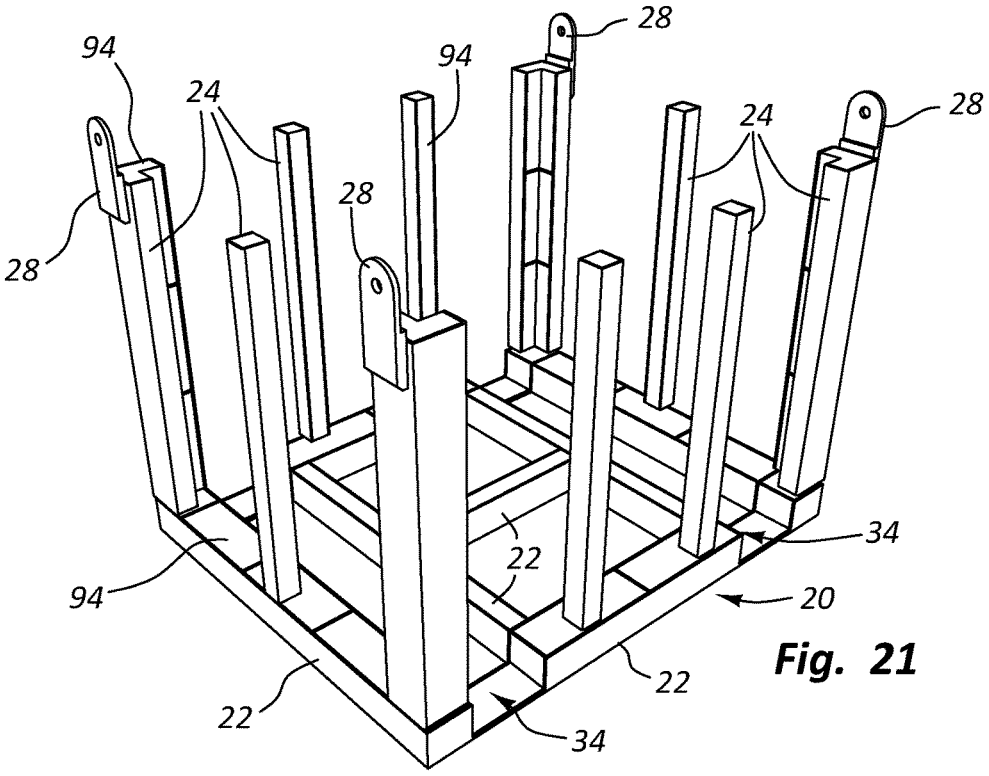
FIG. 21 is a perspective view of the support members of the Grade A modular container shown in FIG. 11 filled with energy absorbing material.
Figure 22:
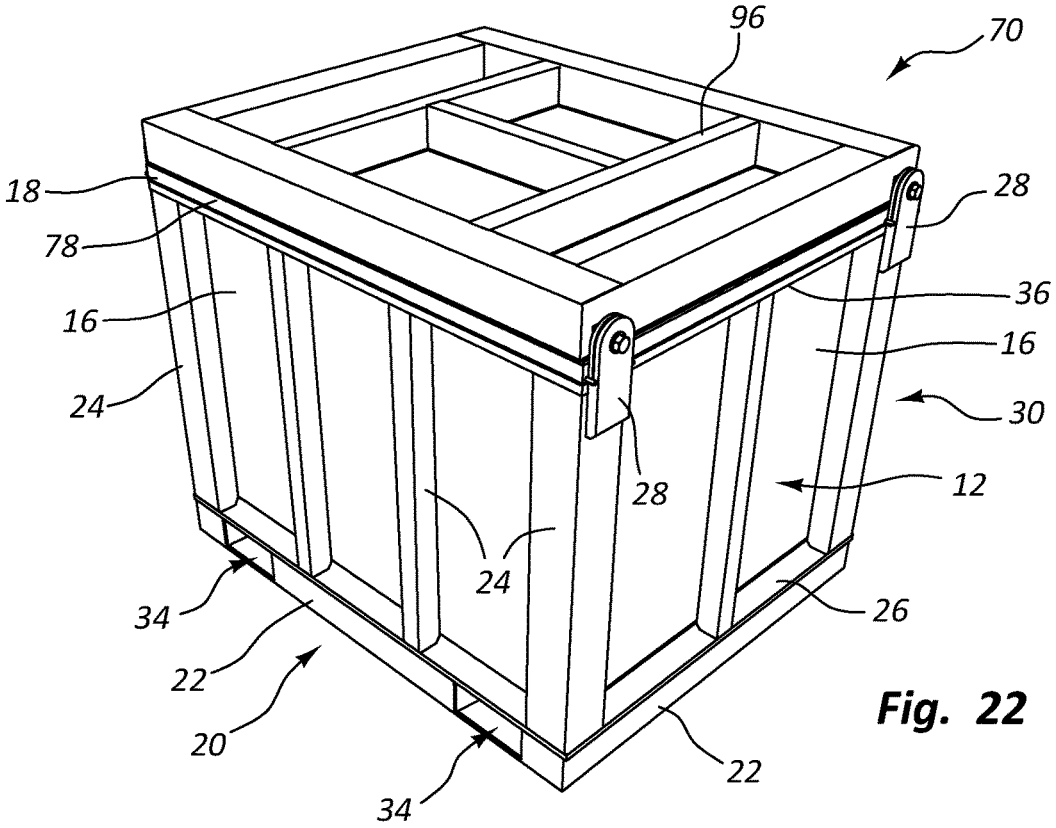
FIGS. 22-23 are perspective views of the Grade A modular container shown in FIG. 11 illustrating the how an impact limiter can be coupled to the top of the container.
Figure 23:
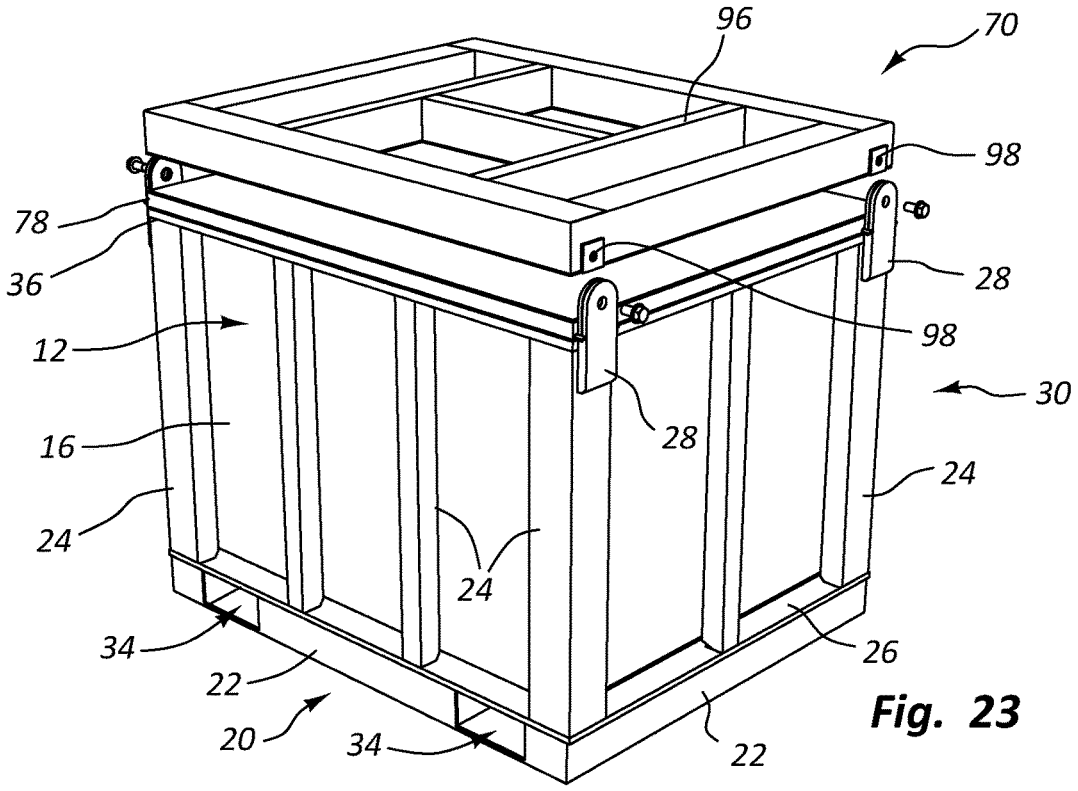
Figure 24:
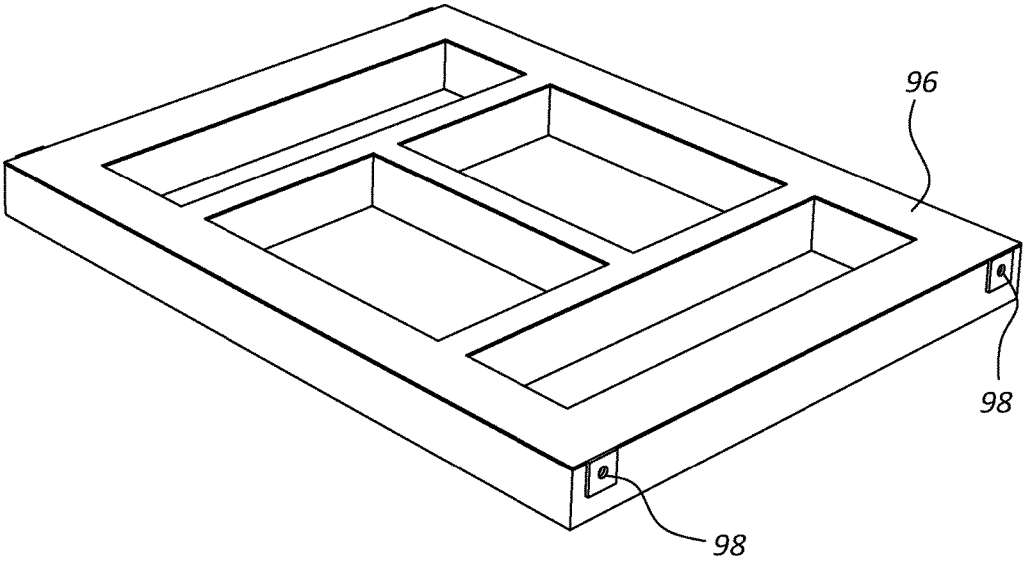
FIG. 24 is a perspective view of one embodiment of an assembled impact limiter that can be used with the Grade A modular container shown in FIG. 11.

Referring to FIG. 21, the Grade A container variant 70 can include an energy absorbing material 94 positioned inside the support members 22, 24. The energy absorbing material 94 increases the robustness and energy absorbing capability when the Grade A container variant 70 is accidentally dropped. The support members 22, 24 are crushed when the Grade A container variant 70 is dropped and the energy absorbing material 94 helps to absorb the energy of the drop. The energy absorbing material 94 increases a number of parameters associated with the container—e.g., increases the lifting and handling capacity, increases stack height for interim storage, increases range of transportation conditions, increases stack height for geological disposal, and so forth.

The energy absorbing material 94 can be any suitable material. In one embodiment, the energy absorbing material 94 includes an energy absorbing foam material. The energy absorbing foam can be the kind widely used in Type B transportation package impact limiters—e.g., LAST-A-FOAM from General Plastics.

Referring to FIGS. 22-25, the Grade A container variant 70 can include an impact limiter 96 that can be coupled to the top of the Grade A container variant 70. The impact limiter 96 is shaped similarly to the base 20. In one embodiment, the impact limiter 96 can be coupled to the Grade A container variant 70 using the lifting members 28. For example, fasteners such as bolts can extend through the hole in the lifting members 28 and into a threaded hole 98 on the impact limiter 96.

Figure 25:
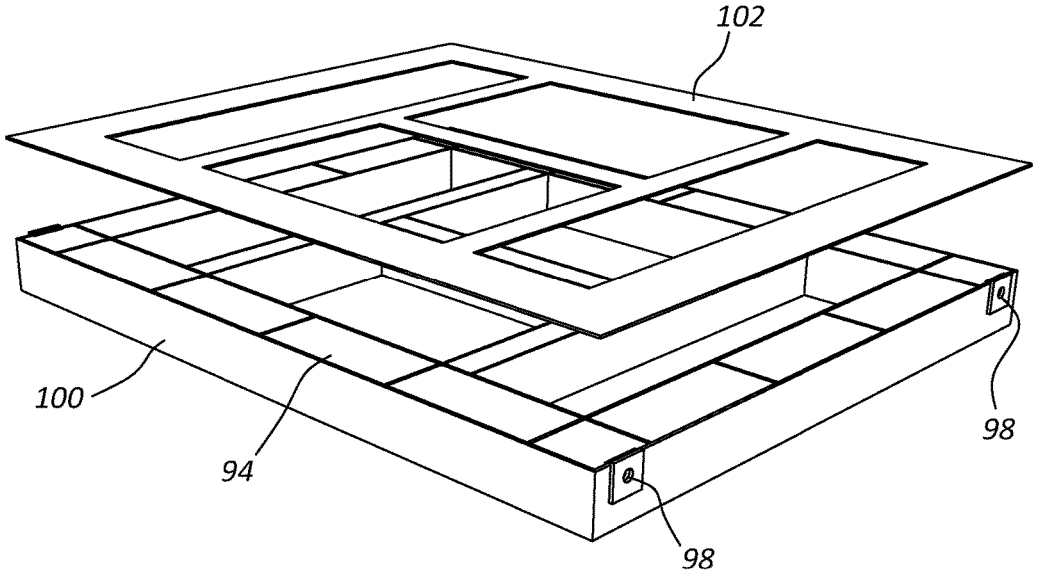
FIG. 25 is a perspective view of the impact limiter shown in FIG. 24 with the cover plate exploded from the rest of the impact limiter.

In one embodiment, the impact limiter 96 includes a main body 100 and a cover plate 102. The main body 100 can be filled with the energy absorbing material 94 as shown in FIG. 25. The cover plate 102 is fastened over the open side of the main body 100 through any suitable means such as welding and the like. The impact limiter 96 can be used selectively as needed, for example, for lifts in excess of 15 feet (4.6 m) and for the highest container in a stack (interim storage or geological disposal).

Figure 26:
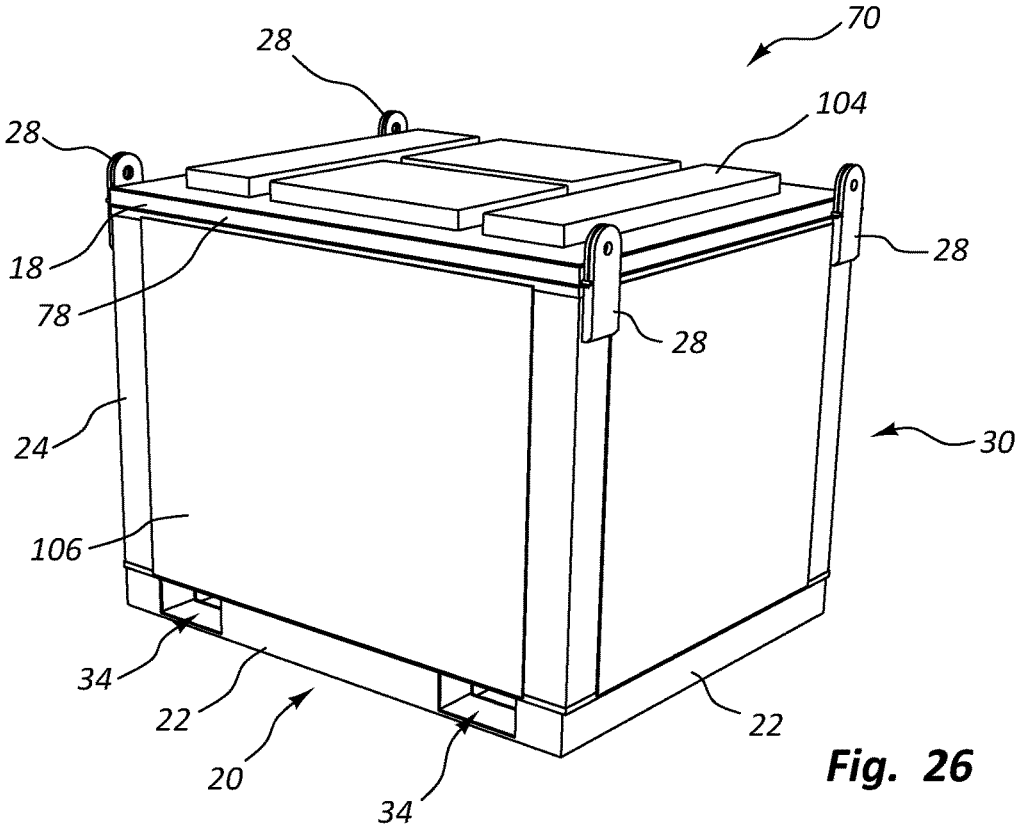
FIG. 26 is an assembled, perspective view of the Grade A modular container shown in FIG. 11 with neutron shielding panels coupled to the exterior of the container.
Figure 27:
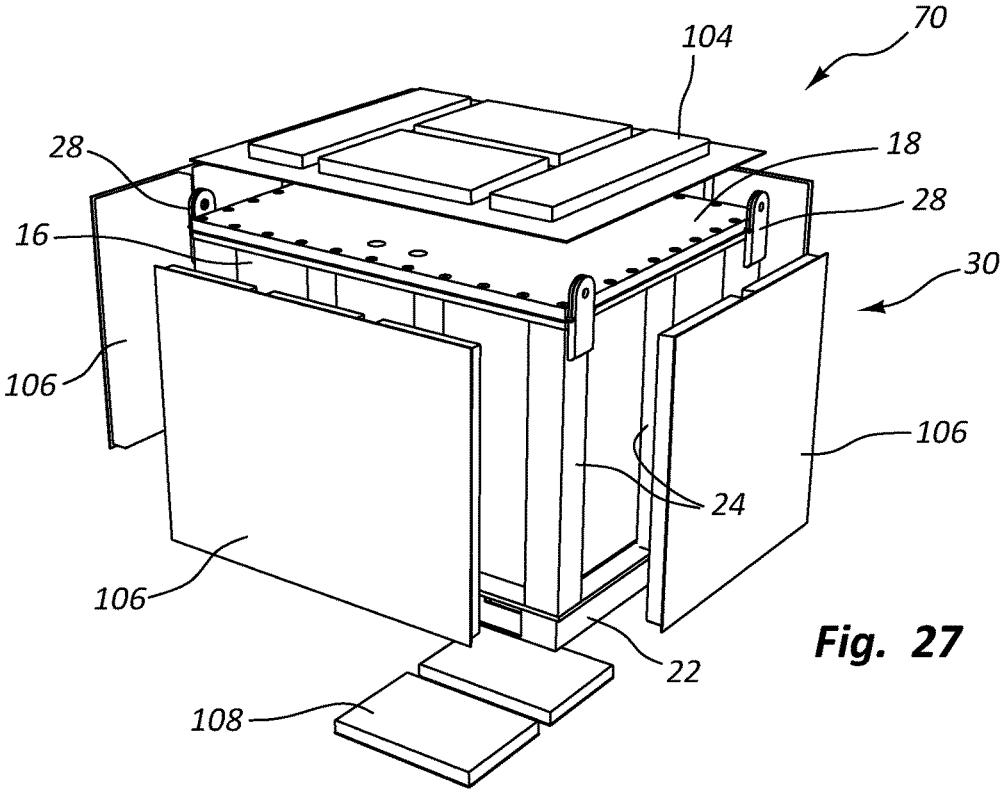
FIG. 27 is a partially exploded, perspective view of the Grade A modular container shown in FIG. 11 with the neutron shielding panels.
Figure 28:
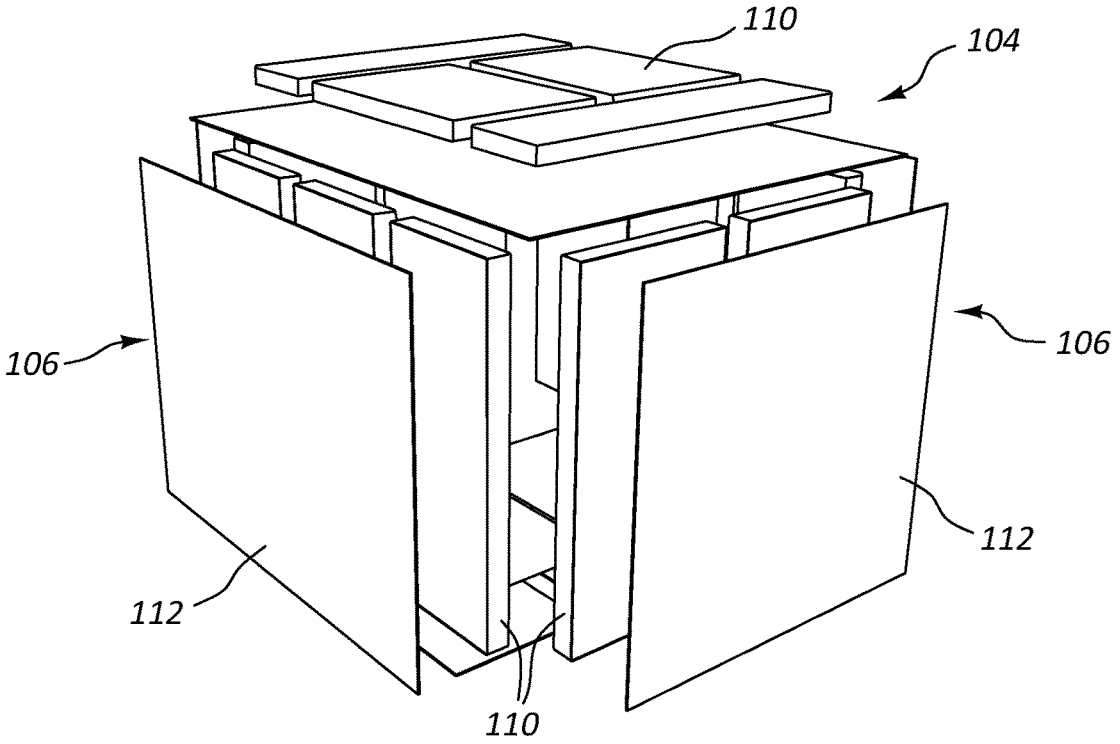
FIG. 28 is an exploded, perspective view of the neutron shielding panels for the Grade A modular container shown in FIG. 11.

Referring to FIGS. 26-28, the Grade A container variant 70 can also include additional neutron shielding panels 104, 106, 108 (alternatively referred to as neutron shielding members). These are useful when the radioactive waste has significant neutron activity. The neutron shielding panels 104, 106, 108 can be filled with any suitable neutron shielding material including hydrogenous material such as that specified in NS-4-FR.

The Grade A container variant 70 includes a top neutron shielding panel 104, side neutron shielding panels 106, and bottom neutron shielding panels 108. The neutron shielding panels 104, 106, 108 can be fabricated separately and then fastened to the outside of the Grade A container variant 70 using any suitable fastener or fastening technique, for example welding. The top and side neutron shielding panels 104, 106 include shielding inserts 110 coupled to a flat plate 112 as shown in FIG. 28. The bottom neutron shielding panels 108 just include the shielding inserts 110.

Figure 2:
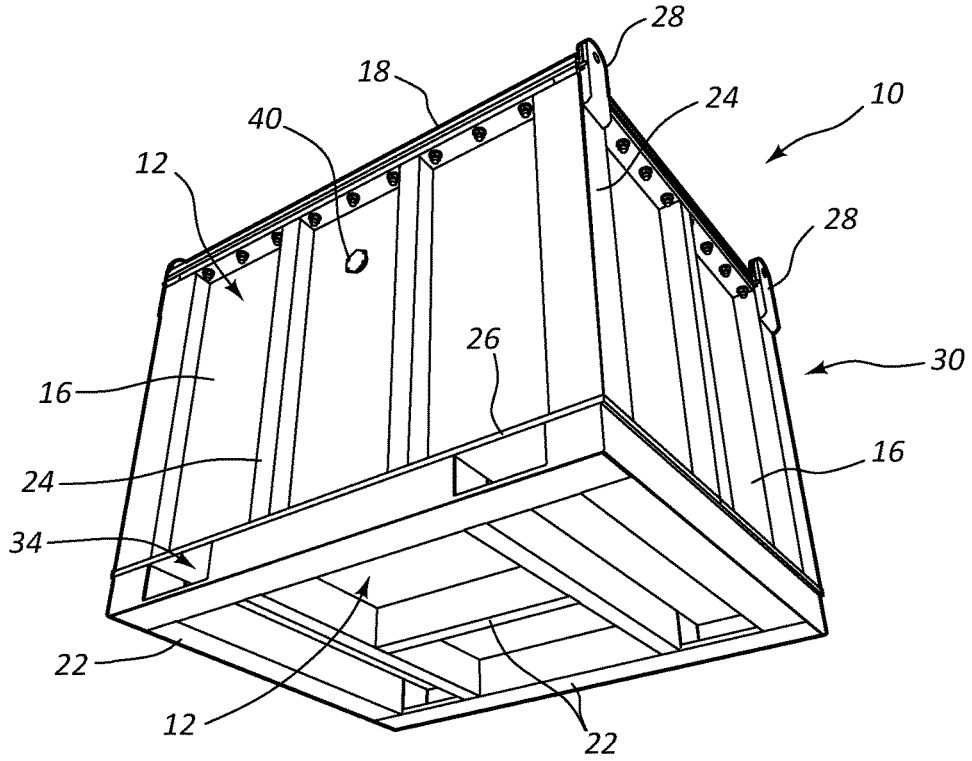
FIG. 2 is a bottom perspective view the modular container shown in FIG. 1.

The top neutron shielding panel 104 is configured so that the shielding inserts 110 correspond to the cavities or recesses in the bottom of the base 20 of the main body 30 (see FIG. 2). When the Grade A containers 70 are stacked, the shielding inserts 110 extend into the cavities in the base 20. The top neutron shielding panel 104 is also compatible with the impact limiter 96.

In one embodiment, the shielding inserts 110 on the top neutron shielding panel 104 fill up one half of the cavity in the base 20 and the shielding inserts 110 that form the bottom neutron shielding panels 108 are configured to fill up the other half of the cavity. The shielding inserts 110 on the side neutron shielding panel 106 are positioned to fit in and fill up the spaces between the support members 24.

Grade B Container Variant

The modular container 10 shown in FIGS. 1-10 constitutes one embodiment of a Grade B modular container variant that is less robust than the Grade A container variant 70, but more robust than the Grade C container variant 120. As such, the modular container 10 is referred to as the Grade B modular container variant 10 in the following description (alternatively referred to as the Grade 13 container or Grade B modular container). The Grade B modular container variant 10 is configured to be used primarily with intermediate activity radioactive waste such as class B waste, class C waste, GTCC waste, and ILW. It should be appreciated, however, that the Grade B modular container variant 10 can be used with any class or type of radioactive waste including special form waste, TRU waste, and other waste with longer lived isotopes.

The Grade B container variant 10 can be made of any suitable materials. In one embodiment, the enclosure envelope 12 and/or the entire Grade B container variant 10 is made in compliance with ASME Section VIII (materials, fabrication, and testing). For example, the enclosure envelope 12 and/or the entire Grade B container variant 10 can be made of A240 Type 304/304L stainless steel. The various components can be welded together using at least partial penetration welds inspected using non-destructive examination techniques.

Figure 3:
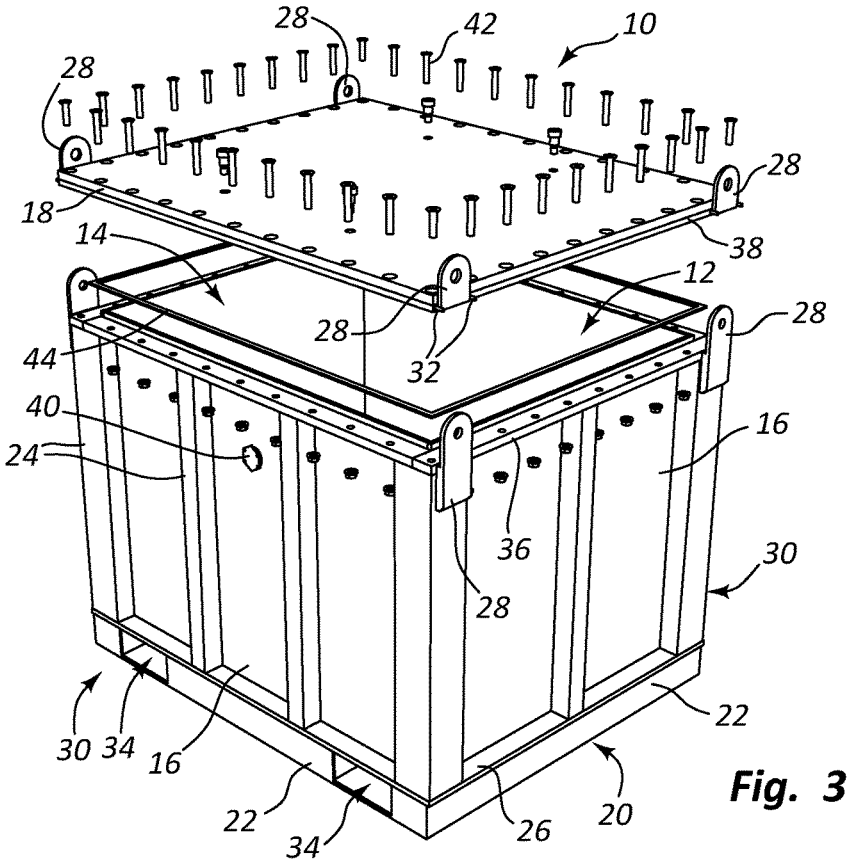
FIG. 3 is a perspective view of the modular container shown in FIG. 1 with the lid raised.

Referring to FIGS. 3-4, the walls 16 of the enclosure envelope 12 of the Grade B container variant 10 can be made of four side plates with corner joints. In one embodiment, the plates are welded using corner welds with partial or complete joint penetration (FIGS. 16-17 show examples of full penetration welds). The welds can be examined using non-volumetric, non-destructive, dye penetrant testing.

The base plate 26 of the enclosure envelope 12 of the Grade B container variant 10 can be a steel plate. The walls 16 are coupled to the base plate 26 using corner welds with partial or complete joint penetration. The welds can be examined using non-volumetric, non-destructive, dye penetrant testing.

Figure 29:
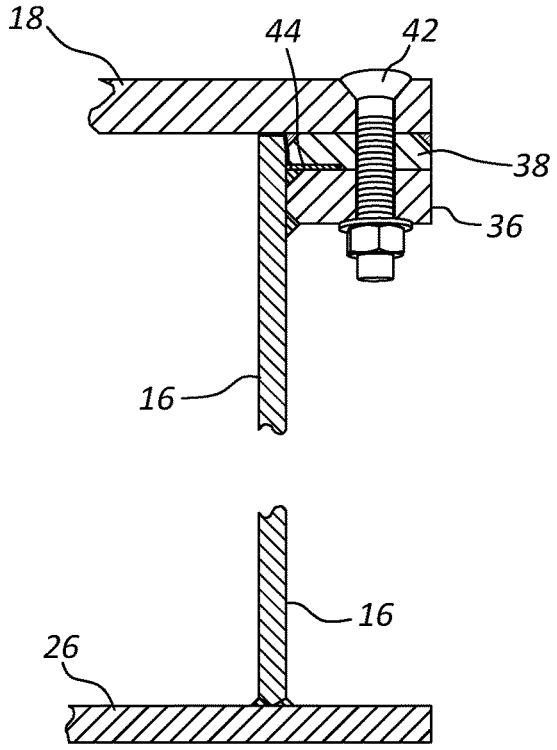
FIG. 29 is a cross-sectional view of the lid attached to the main body and the wall attached to the base plate of the Grade B modular container shown in FIG. 1.

FIG. 29 shows the manner in which the structural lid 18 is coupled to the main body 30 of the Grade B container variant 10. The flange 36 is formed by four separate pieces coupled together at the corners, preferably by welding (see FIG. 4 to see the separate pieces). The flange 36 is coupled to the outside of the walls 16 just below their top edges. The flange 36 can be coupled to the walls 16 in any suitable manner such as by welding (at least partial penetration weld).

The shear key spacer 38 is positioned above the flange 36 so that the top of the spacer 38 is flush with the top of the walls 16. The spacer 38 can be coupled to the walls 16 by welding or the like (at least partial penetration welds). One or more sealing members 44 is positioned between the flange 36 and the spacer 38. The sealing member 44 can be any suitable material. In one embodiment, the sealing member 44 includes a one-piece flat elastomeric gasket seal (butyl rubber). In another embodiment, all mating and sealing surfaces are machined, including, but not limited to the surfaces that contact the sealing member 44.

The structural lid 18 is coupled to the main body 30 with the fasteners 42 that extend through the spacer 38 and the flange 36. In one embodiment, the fasteners 42 include 316 stainless steel flathead bolts, lock washers, and nuts. In another embodiment, the fasteners 42 are recessed into the structural lid 18 to protect them during container handling. The fasteners 42 can easily be replaced if damaged because there are no threaded parts to repair. The fasteners 42 can also easily be installed while standing at grade level using standard tools.

The structural lid 18 forms a stepped arrangement when coupled to the spacer 38 and flange 36. The stepped arrangement of the structural lid 18, spacer 38, and flange 36 combined with the upper lip of the walls 16 forms a shear key that resists lateral loads. Also, the fasteners 42 are not subject to loads in the shear plane. The structural lid 18 can be welded to the spacer 38 in the manner shown in FIG. 29 to provide a more robust seal.

The Grade B container variant 10 can be configured to withstand leaks. In one embodiment, the Grade B container variant 10 provides leak tightness to $10^{-4}$ $cm^3$/sec via pressure drop test on the cavity 14. The Grade B container variant 10 is suitable for a normal operating pressure of approximately 10 psig (unvented). The enclosure envelope 12 of the Grade B container variant 10 can be pressure retaining or non-pressure retaining using a filtered vent in the latter instance.

Grade C Container Variant

Figure 30:
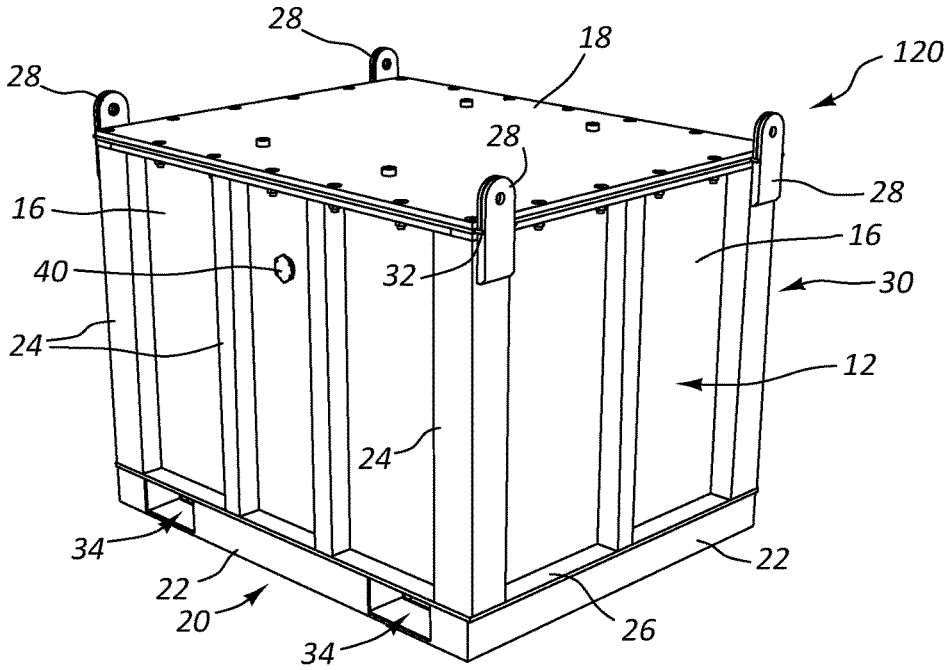
FIG. 30 is a perspective view of one embodiment of a Grade C modular container.
Figure 31:
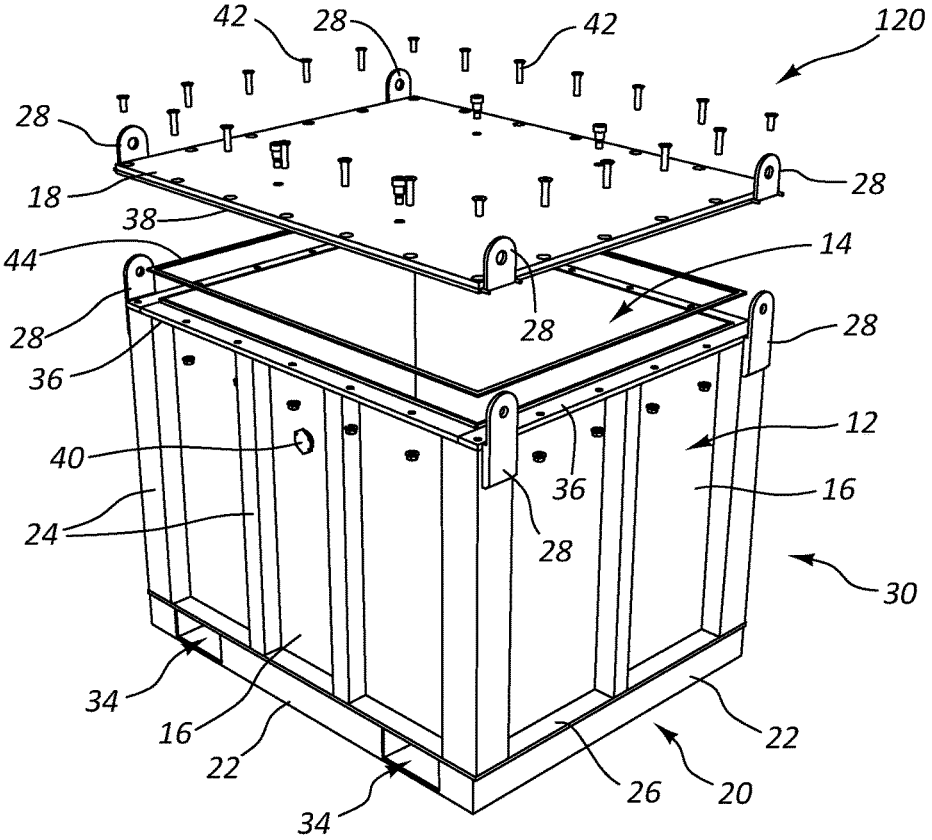
FIG. 31 is a perspective view of the Grade C modular container shown in FIG. 30 with the lid raised.
Figure 32:
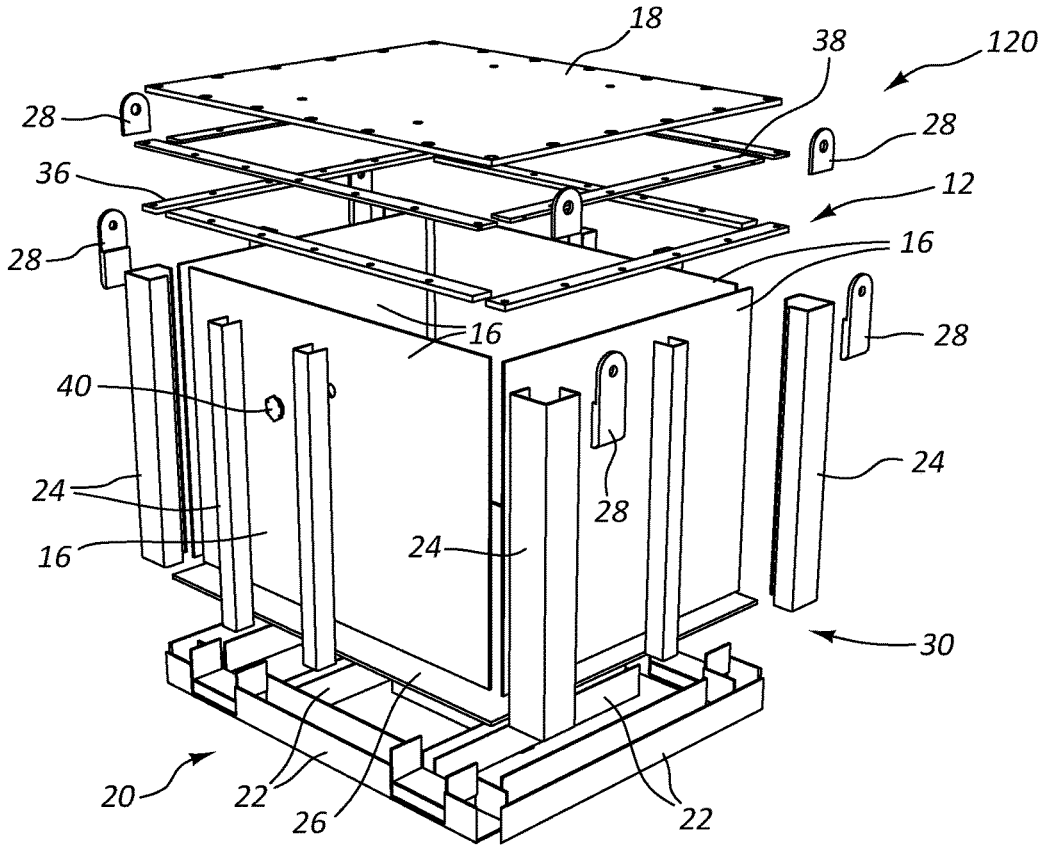
FIG. 32 is an exploded perspective view of the Grade C modular container shown in FIG. 30.

FIGS. 30-32 show one embodiment of a Grade C modular container variant 120 (alternatively referred to as the Grade C container or Grade C modular container) that is less robust than the Grade A and B modular container variants 70, 10. It is configured similarly to the Grade B container variant 10 so that the description of the Grade B container variant 10 applies unless noted otherwise. The Grade C container variant 120 is configured to hold lower activity radioactive waste such as Class B waste, Class C waste, and ILW. In general, it is especially suitable for storing shorter lived radioactive isotopes. It should be appreciated, however, that the Grade C container variant 120 can be used with any class or type of radioactive waste.

The Grade C container variant 120 can be made of any suitable materials. In one embodiment, the enclosure envelope and/or the entire Grade C container variant 120 are made of AISC (American Institute of Steel Construction) and AWS (American Welding Society) materials, fabrication, and testing. For example, the Grade C container variant 120 can be made of A36 epoxy coated carbon steel. In general, the material used to make the Grade C container variant 120 is thinner than the material used to make the Grade B container variant 10. The walls 16 and base plate 26 for the Grade C container variant 120 can be joined in largely the same manner as the Grade B container variant 10.

Figure 33:
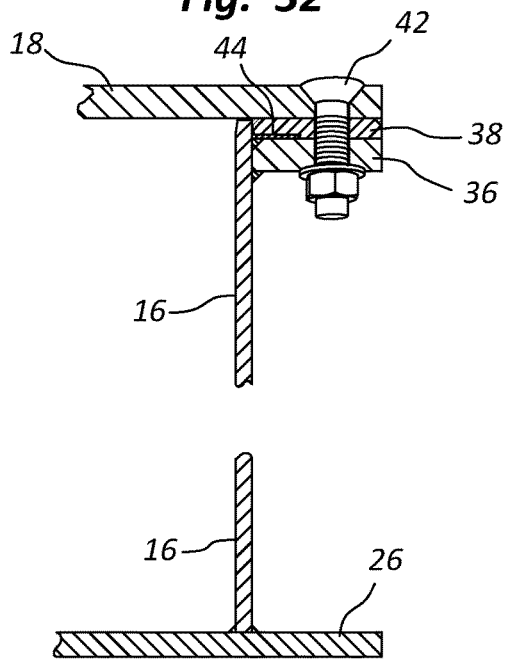
FIG. 33 is a cross-sectional view of the lid attached to the main body and the wall attached to the base plate of the Grade C modular container shown in FIG. 30.

FIG. 33 shows that the structural lid 18 can be coupled to the main body 30 in largely the same manner as the Grade B container variant 10. It should be noted that the materials used for the structural lid 18, flange 36, and spacer 38 are thinner than that used for the Grade B container variant 10. Also, fewer fasteners 42 are used to couple the structural lid 18 to the main body 30 and the fasteners 42 can be standard flathead bolts, lock washers, and nuts.

The Grade C container variant 120 can be configured to withstand leaks. In one embodiment, the Grade C container 12 provides leak tightness to $10^{-4}$ $cm^3$/sec via pressure drop test on the cavity 14. The Grade C container can also be designed for a comparatively lower normal operating pressure or is non-pressure retaining using a filtered vent in the latter instance.

Solid and Granular Radioactive Waste

The modular container 10 can be configured to hold a variety of physical manifestations of radioactive waste including solid and granular radioactive waste. It should be appreciated that the remainder of the description refers to the modular container 10 but applies to all of the grade variants of the modular container 10, 70, 120.

Solid radioactive waste can generally be considered waste that maintains its physical form or, in other words, waste that is not in a liquid form (e.g., no more than 1% liquid by volume) or a gaseous form. It can optionally be considered to exclude certain materials specified by regulation. For example, in one embodiment, solid radioactive waste excludes material that exceeds strategic quantities of special nuclear material as referenced in 10 CFR 70.4.

Solid radioactive waste includes both processed and unprocessed bulk waste. In one embodiment, solid radioactive waste can be processed using any of a variety of process. Examples of suitable processes include segregation, decontamination, size reduction, volume reduction, and the like. Solid radioactive waste is distinguished conceptually from granular radioactive waste in that solid radioactive waste has a relatively low volume of fines and loose particulate. The following table describes different waste classes and waste types along with typical configurations of the modular container that accommodate them.

TABLE 5

General Modular Container Solid Radioactive Waste Acceptance Criteria

| Waste Class | Waste Type | Modular Container Configuration |
|---|---|---|
| Class B and C low level waste (LLW)<br>Waste with concentrations of short and long lived radionuclides that exceed the Class A limits specified in 10 CFR 61.55, but do not exceed the limits for Class B and C | Surface contaminated objects (SCO) with low levels of long-lived radionuclides<br>Activated materials with low specific activity (LSA)<br>Contact dose rates may exceed 2.0 mSv/hr (200 mrem/hr) and warrant shielded packaging<br>Other solid radioactive waste that meet the applicable criteria | Shielding inserts to suit waste activity<br>Solid waste with minimal fines and loose particulate, e.g., non-fuel bearing fuel components or primary system components*<br>Support framework for drummed solid waste<br>May require use of a Type B transport overpack for transport |
| Greater Than Class C (GTCC)<br>Waste with concentrations of short or long lived radionuclides that exceed the limits specified in 10 CFR 61.55 and that is not HLW, special form, or transuranic waste<br>Primarily from commercial sources (as opposed to government) | SCO with higher levels of long-lived radionuclides<br>Highly activated materials<br>Sealed sources<br>Contact dose rates typically exceed 2.0 mSv/hr (200 mrem/hr) and require shielded packaging<br>Other solid radioactive waste that meet the applicable criteria | Thicker shielding inserts to suit higher waste activity<br>Solid waste with minimal fines and loose particulate, e.g., reactor internals*<br>Support framework for drummed solid waste<br>Typically requires use of Type B transport overpack for transport |
| Transuranic (TRU)<br>Includes contact handled TRU (CH-TRU) and remote handled TRU (RH-TRU)<br>Waste with alpha-emitting transuranic radionuclides having half-lives and concentrations that exceed 20 years and 100 nCi/g.<br>Primarily from government sources (Department of Energy) | SCO with transuranic radionuclides<br>CH-TRU wastes have surface dose rates <200 mrem/hr and typically require only a lightly shielded packaging<br>RH-TRU wastes have surface dose rates ≥200 mrem/hr and require a more heavily shielded packaging | Minimal or no shielding inserts for CH-TRU wastes. Support framework for drummed CH-TRU waste<br>Thicker shielding inserts to suit RH-TRU wastes. Support framework for drummed RH-TRU waste<br>Typically requires use of Type B transport overpack for transport |
| Special form waste<br>Sealed sources with high activity but low contamination | Indispersible radioisotope material<br>Sealed capsules containing radioisotope material<br>Contact dose rates typically exceed 2.0 mSv/hr (200 mrem/hr) and require shielded packaging | Shielding inserts to suit waste activity<br>Contents-specific insert for sealed sources<br>May require use of Type B transport overpack for transport |
| Intermediate level waste (ILW)<br>Long-lived alpha emitters >4 GBq/tonne (108 mCi/tonne)<br>Long-lived beta and gamma emitters >10 GBq/tonne (270 mCi/tonne)<br>Thermal power <2 kW/m$^3$ | SCO with higher levels of long-lived radionuclides<br>Highly activated metals<br>Sealed sources<br>Contact dose rates may exceed 2.0 mSv/hr (200 mrem/hr) and warrant shielded packaging<br>Other solid wastes that meet the applicable criteria | Thicker shielding inserts to suit higher waste activity<br>Solid waste with minimal fines and loose particulate, e.g., reactor internals*<br>Support framework for drummed solid waste<br>Typically requires use of Type B transport overpack for transport |
| High level waste (HLW)<br>Large concentrations of both short- and long-lived radionuclides<br>Typically has activity concentrations in range of $10^4$ to $10^6$ TBq/m$^3$<br>Typically has thermal power >2 kW/m$^3$ ≤ 20 kW/m$^3$<br>Typically requires decay in interim storage prior to disposal | Spent nuclear fuel elements<br>Fission product and actinide waste from reprocessing<br>Packaging requires criticality control features, heavy shielding, more robust containment function, and greater heat removal capability | Upgraded modular container envelop with contents-specific insert for;<br>Vitrified HLW reprocessing waste<br>Metallic uranium fuels such as research reactor fuel<br>Natural uranium fuel<br>Other defense and research reactor fuels |

Figure 34:
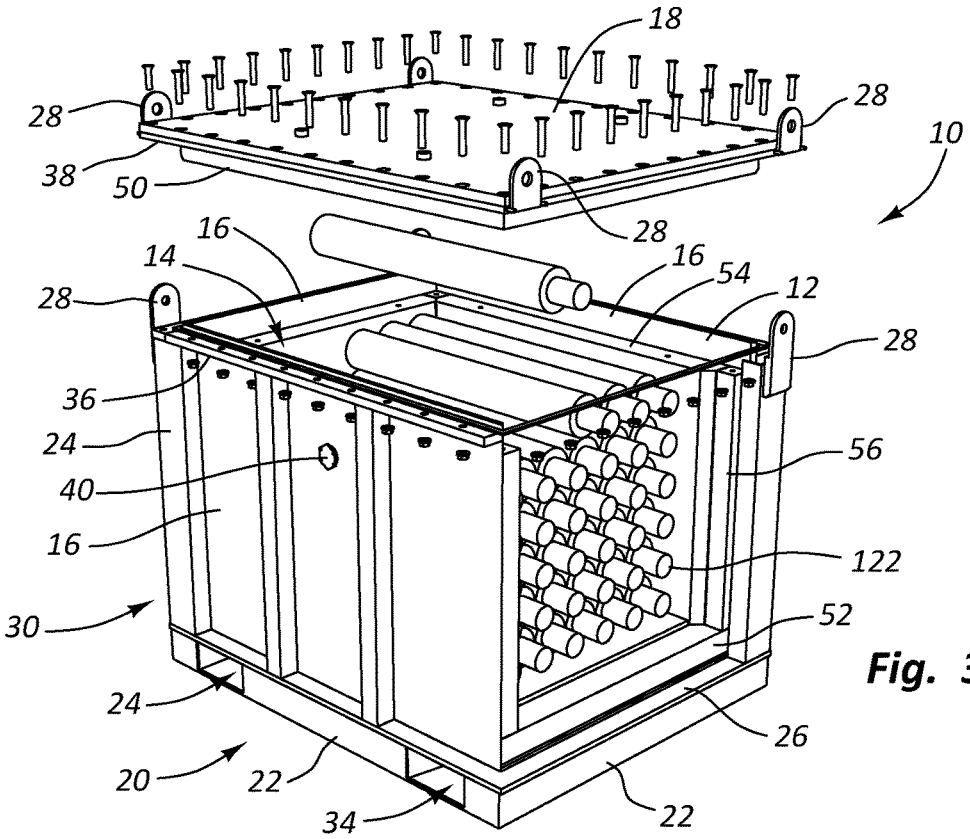
FIG. 34 is a perspective view of the modular container shown in FIG. 1 with the lid raised and the cavity filled with solid radioactive waste canisters.

*Solid radioactive waste with significant fines and loose particulate may be considered granular waste that should be placed in a liner in the modular container FIG. 34 shows one embodiment of the modular container 10 filled with solid waste 122. In this embodiment, the solid waste 122 is in the form of canisters or tubes. The solid waste 122 is placed directly in the cavity 14 and surrounded by the shielding inserts 50, 52, 54, 56. It should be appreciated that the solid waste 122 is merely an example of one form of solid waste that can be put in the modular container 10 and that other forms can be put in as well.

Figure 35:
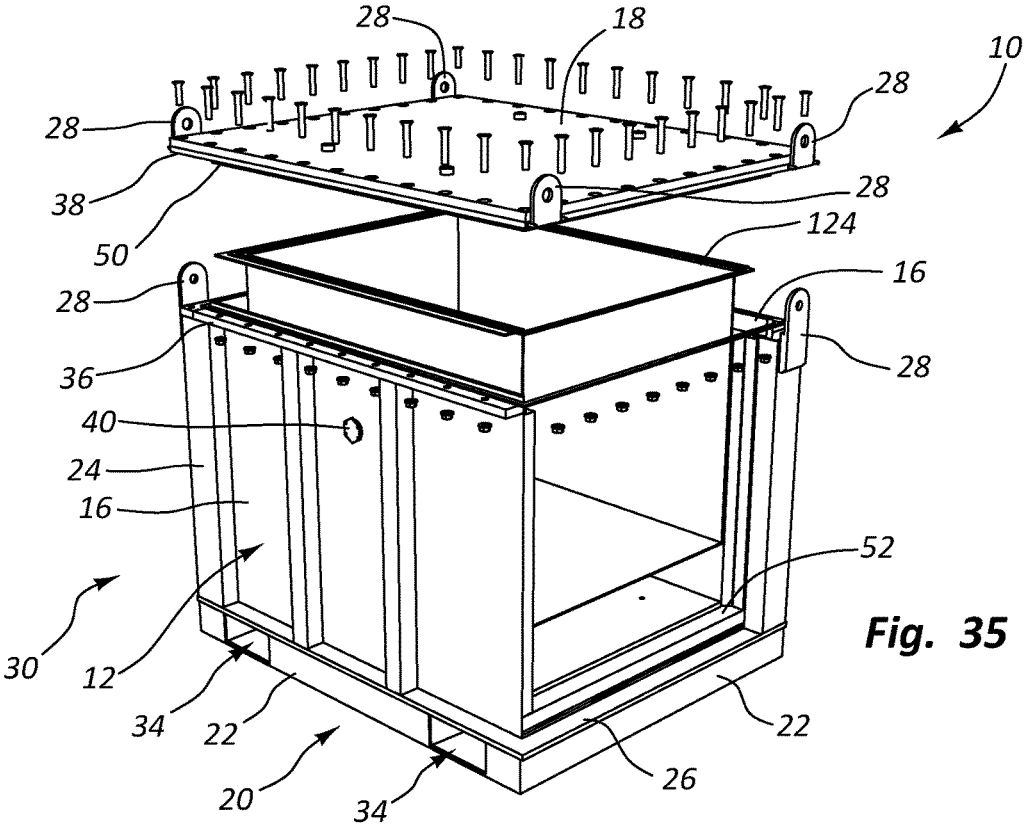
FIGS. 35-36 are perspective views of the modular container shown in FIG. 1 with a liner positioned in the cavity.
Figure 36:
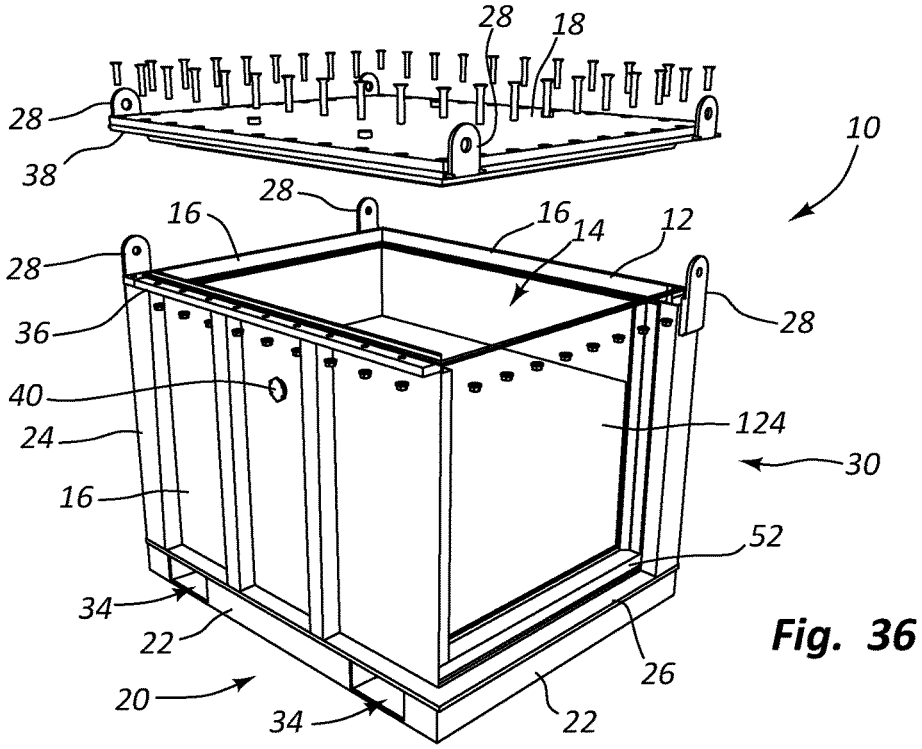

FIGS. 35-36 show another embodiment of the modular container 10 filled with granular waste. It should be appreciated that granular waste refers to solid waste that has a relatively high volume of fines and/or loose particulates. A liner 124 is positioned in the cavity 14 to hold the granular waste. The liner 124 is a single, integral piece that has all of its seams sealed to prevent the granular material from escaping. The liner 124 is sized to fit in the cavity 14 and flanged on the top to provide a better fit and seal.

The liner 124 can be made of any suitable material such as formed polyethylene (e.g., 1/16" to 3/16" thick, etc.), fabricated stainless steel (e.g., 11-16 gauge, etc.), or fabricated galvanized steel (e.g., 11-16 gauge, etc.). An additional gasket can be added between the liner 124 and the structural lid 18 (or shielding insert 50 on the bottom of the structural lid 18) to provide additional loose contamination barrier. As previously mentioned, the design of the structural lid 18 allows the sealing member 44 that forms the outer confinement boundary to be replaced without removing shielding insert 50 that covers the liner 124.

Wet Radioactive Waste

The modular container 10 can be configured to hold a wet radioactive waste. Wet radioactive waste can generally be considered waste that does not maintain its physical form. It includes liquids, slurries (liquid plus suspended solids), sludge (wet solids), or dry solid particles. Wet radioactive waste includes bulk low level waste and mixed radioactive and hazardous waste.

Wet radioactive waste is typically processed to stabilize and/or solidify the waste. The waste is stabilized by dewatering to remove excess water. It is solidified to chemically bind the waste into a monolithic solid and/or encapsulate the waste by surrounding it with a binder or coating.

Wet radioactive waste can be processed in the container (e.g., a 55 gal (208 liter) drum) or separately to chemically and physically stabilize the waste and prevent it from dispersing waste fines or liquids. The following table describes different waste classes and waste types along with typical configurations of the modular container 10 that can accommodate them.

TABLE 6

General Modular Container Wet Radioactive Waste Acceptance Criteria

| Waste Class | Waste Type | Modular Container Configuration |
|---|---|---|
| Class B and C low level waste (LLW)<br>Waste with concentrations of short and long lived radionuclides that exceed the Class A limits specified in 10 CFR 61.55, but do not exceed the limits for Class B and C<br>Liquid wastes or solid wastes containing liquid should be converted to a stable form that contains ≤1% free liquid by volume and otherwise meets 10 CFR 61.56 | Wet solids including spent ion exchange media such as powdered resins, bead resins and Zeolites<br>Sludges such as carbon and cellulose filter media, and diatomaceous earth<br>Liquids and slurries including evaporator concentrates such as sodium sulfate and boric acid, reverse osmosis concentrate, decontamination liquids, and contaminated oils<br>Other wet or dry solids such as calcine, incinerator ash, and other miscellaneous waste | Processed waste in sub-containers such as drums or high integrity containers (HICs).<br>Drums or other sub-containers of various sizes with encapsulated wastes<br>Dewatered resins with radiological activity >1 μCi/cc in HIC sub-containers.<br>Support framework for processed waste in drums and HICs<br>Modular container with shielding inserts to suit waste activity<br>Modular container may require use of Type B transport overpack for transport<br>Modular container and/or support framework may be disposed with sub-container |

The modular container 10 can accommodate a variety of forms of wet radioactive waste. In particular, the modular container can accommodate stabilized wet radioactive waste in industry standard sub-containers. The modular container 10 can be used to process wet radioactive waste. For example the modular container 10 can be used for in-container filling and waste dewatering and/or stabilization using existing systems. The modular container 10 can also be remotely loaded with externally processed and legacy sub-containers.

Figure 37:
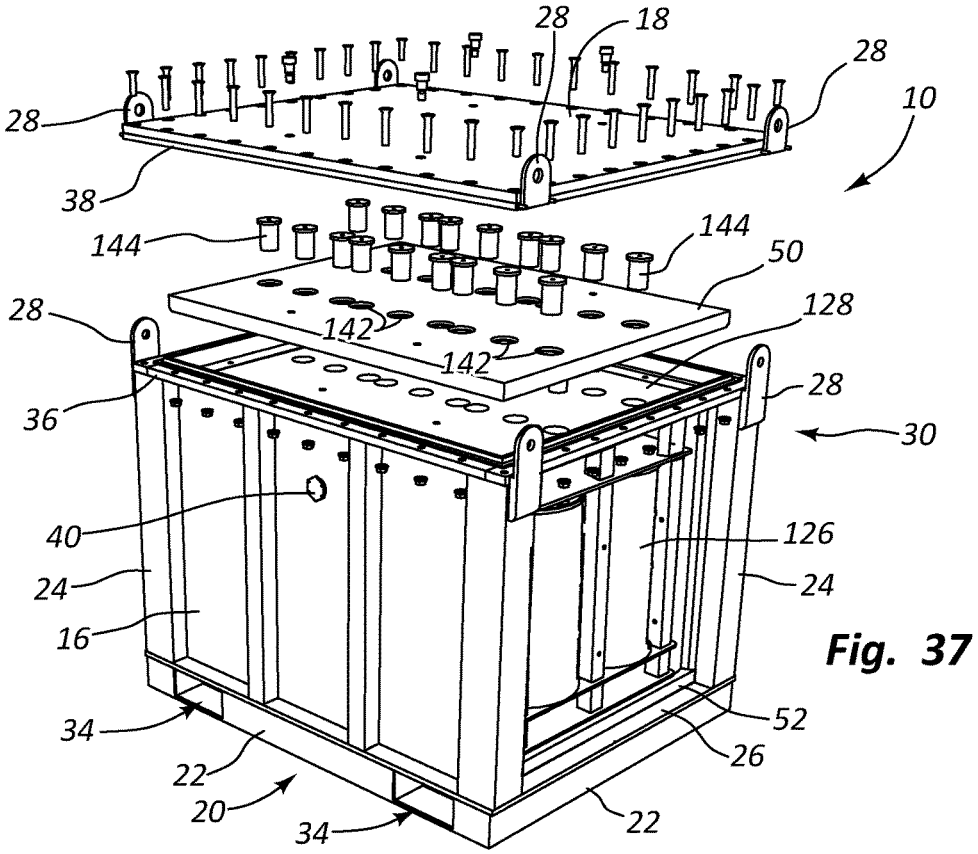
FIG. 37 is a perspective view of the modular container shown in FIG. 1 with the lid raised and the cavity lined with four inch (102 mm) shielding inserts and a support framework holding six sub-containers (six 55 gallon (208 liter) drums) of radioactive waste.
Figure 38:
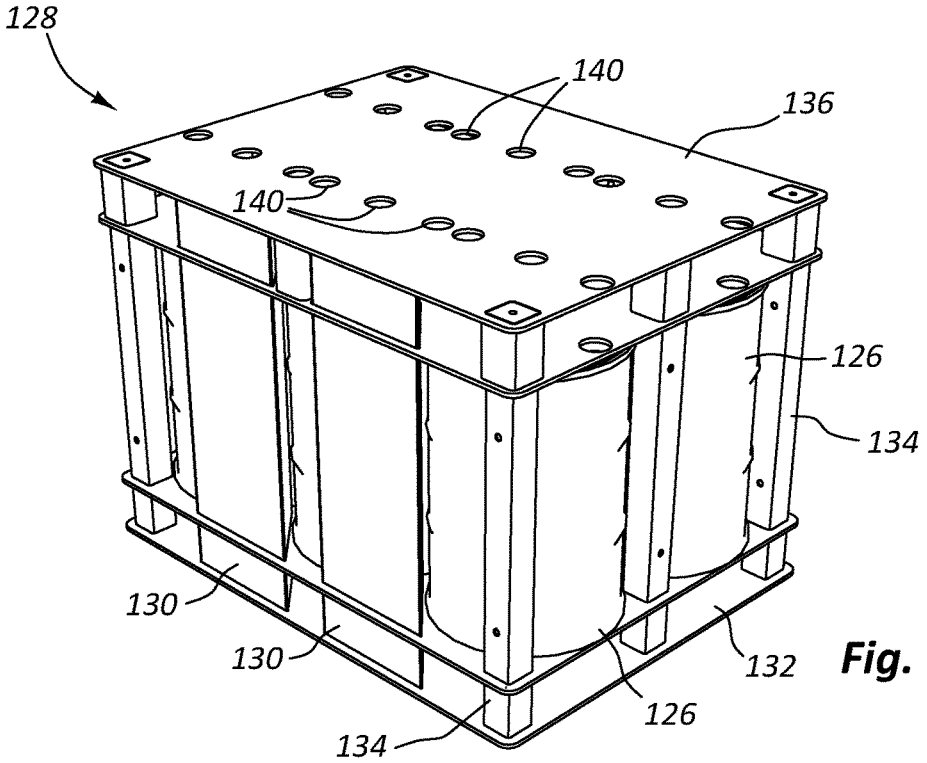
FIG. 38 is a perspective view of the assembled support framework with the sub-containers shown in FIG. 37.
Figure 39:
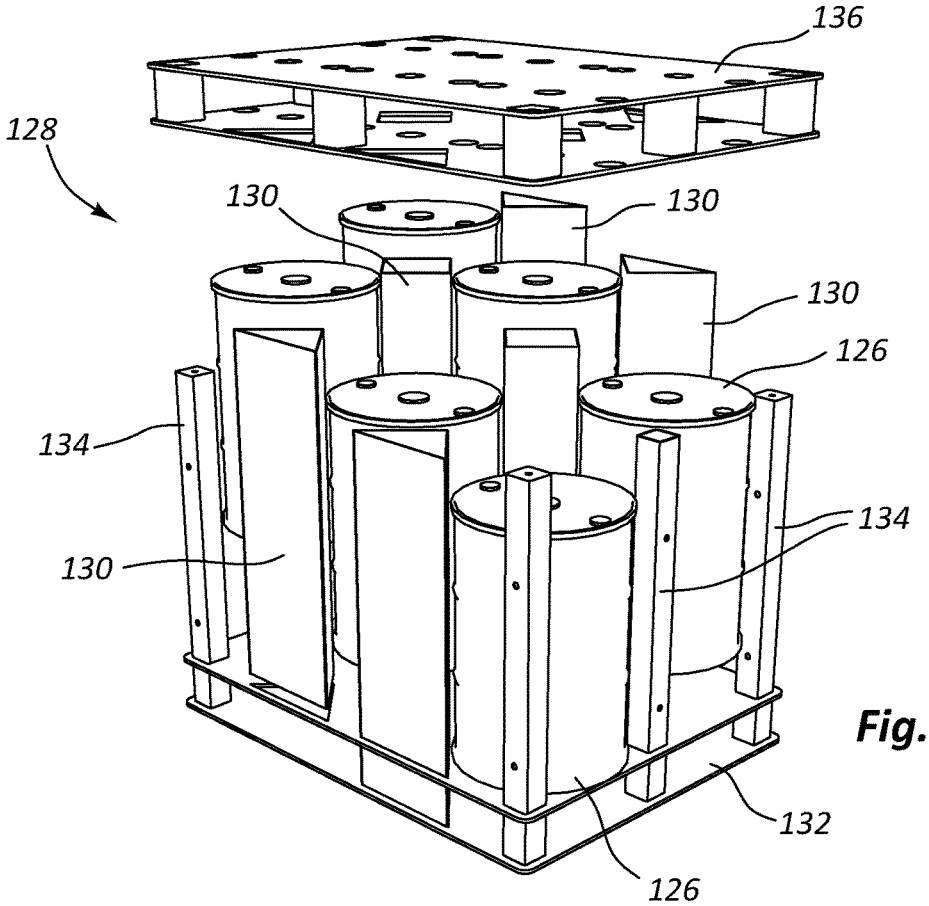
FIG. 39 is an exploded, perspective view of the support framework and sub-containers shown in FIG. 38.

FIG. 37 shows one embodiment of the modular container 10 loaded with sub-containers 126 filled with wet radioactive waste. The sub-containers 126 can be positioned in various support frameworks or stillages 128. The support frameworks 128 can include a support base 132, support posts 134, and a top insert 136.

Referring to FIGS. 37-40, the top shielding insert 136 can include holes 140 through which the mechanical fittings of processing equipment can be coupled to the sub-containers 126 for in-container stabilization of liquid waste. The lid shielding insert 50 can also have holes 142 that correspond to the holes 140. This allows the sub-containers 126 to be processed while the shielding insert 50 in place. When processing is completed, the holes 142 can be filled with shielding plugs 144.

The support framework 128 can be used to facilitate a number of functions. For example, the support framework 128 can be used to accurately position the sub-containers 126 in the cavity 14 of the modular container 10. The support framework 128 also provides a way to handle multiple sub-containers 126 simultaneously. The support framework 128 can also mitigate the consequences of accidentally dropping the modular container 10. The support framework 128 can confine and protect the sub-containers 126 in the drop. It can also provide additional crushable material to absorb the energy of the drop.

The support framework 128 can be lifted using a forklift, crane, or the like. In one embodiment, the support framework 128 includes swivel hoist rings coupled to the top of the support posts 134 to facilitate lifting. In another embodiment, a strap or sling can be positioned in the base pockets of the support framework 128 to facilitate lifting.

The sub-containers 126 can be loaded into modular container 10 in a couple of ways. One way is to put the sub-containers 126 in the support framework 128 and then load the support framework into the modular container 10. Another way is to put the support framework 128 in the modular container 10 and then load the sub-containers 126 into the support framework 128. The sub-containers 126 can be filled with waste before or after they are loaded into the support framework 128 and/or the modular container 10.

In one embodiment, the support framework 128 includes additional auxiliary bins 130 positioned in the interstitial space between the sub-containers 126. The auxiliary bins 130 are generally tubular and can be filled through one or more openings at the top. The auxiliary bins 130 can be closed shut by the top insert 136. They can be used to hold additional solid radioactive waste together with the wet radioactive wastes in the one or more sub-containers 126.

In one embodiment, the auxiliary bins 130 include bottoms and are removable from the support framework 128. This may make it easier to fill and load the auxiliary bins 130. In another embodiment, the auxiliary bins 130 have no bottoms and are coupled to the support base 132.

Examples of suitable solid radioactive waste that can be placed in the auxiliary bins 130 include irradiated and/or contaminated hardware items, dewatered/stabilized filters, and/or granular waste. The auxiliary bins 130 can also be filled with shielding material to provide extra shielding should the activity of the waste require it. Suitable shielding material includes steel shot, concrete, and the like. The auxiliary bins 130 can also be left empty.

The modular container 10 can have a variety of shielding configurations when loaded with wet radioactive waste as shown in the table above. In general, the shielding inserts 50, 52, 54, 56 range in thickness from 2 inches to 8 inches (50 mm to 204 mm) with the most common being 4 inches and 6 inches (101 mm to 153 mm). The enclosure envelope 12 of the modular container 10 provides additional shielding with a typical configuration providing approximately 0.5 inches to 1.5 inches (12 mm to 39 mm) of steel shielding (e.g., 0.75 inches (19 mm) of steel shielding).

Figure 40:
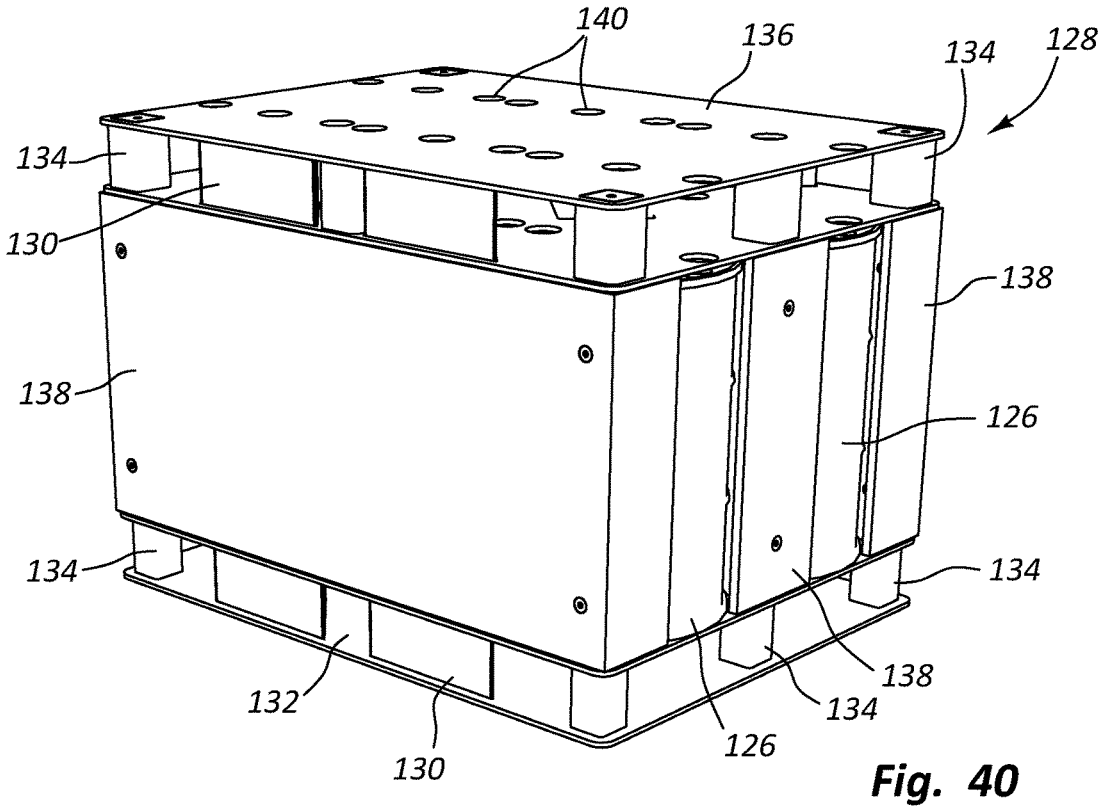
FIG. 40 is a perspective view of the assembled support framework shown in FIG. 38 with additional shielding members coupled to the exterior.
Figure 41:
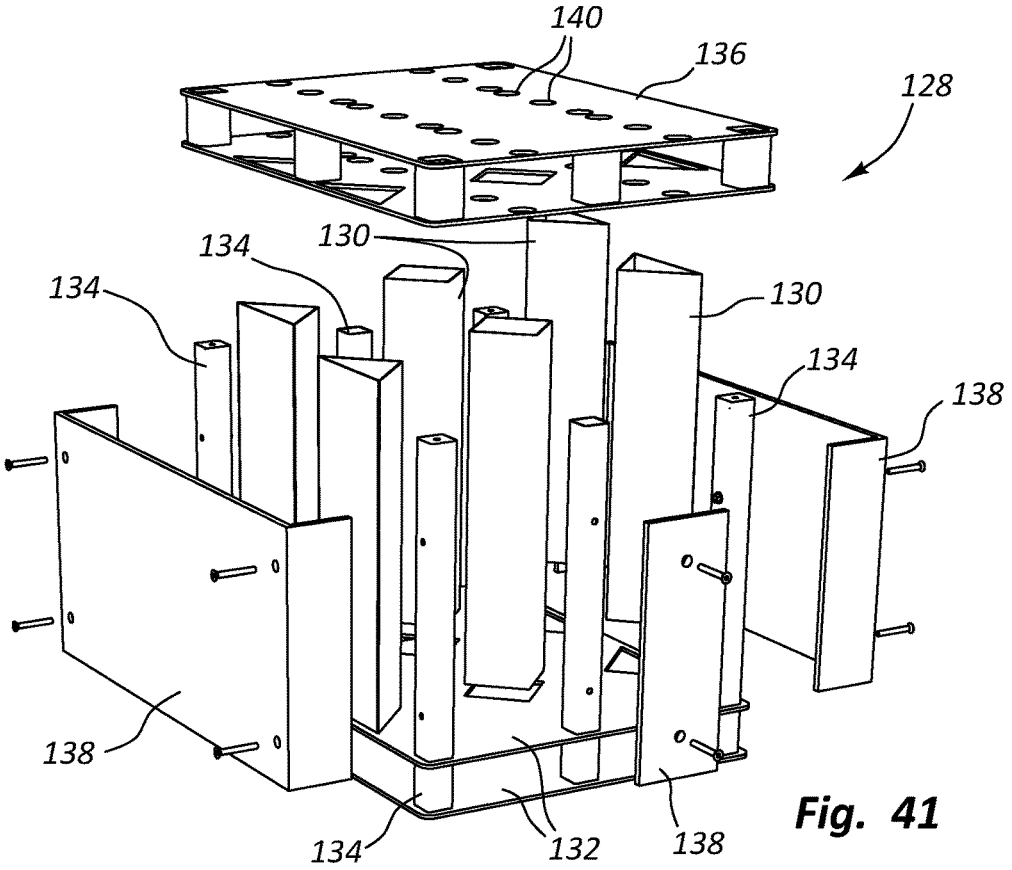
FIG. 41 is an exploded, perspective view of the support framework and shielding members shown in FIG. 40.
Figure 42:
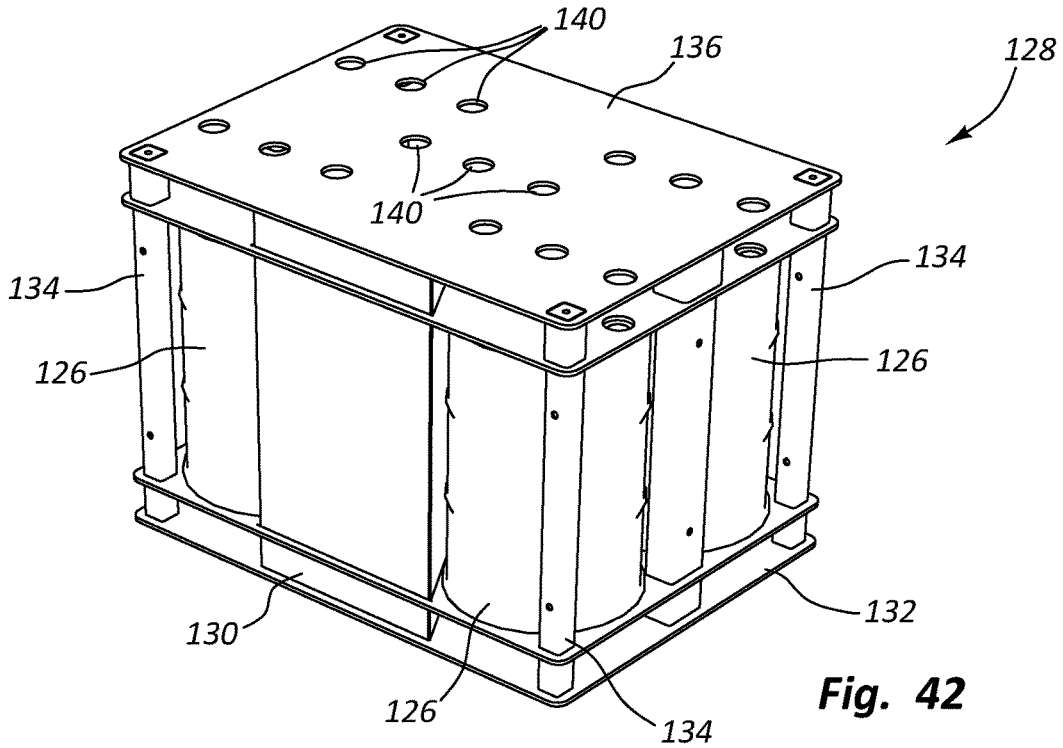
FIG. 42 is a perspective view of another embodiment of the assembled support framework filled with sub-containers (five 55 gallon (208 liter) drums).
Figure 43:
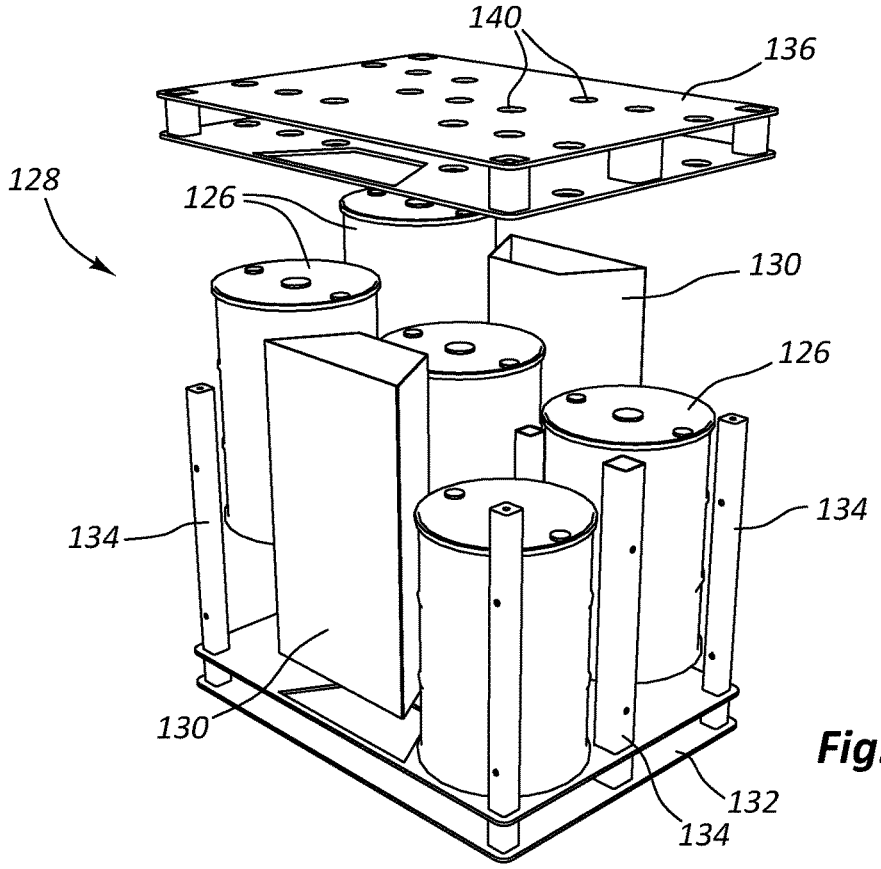
FIG. 43 is an exploded, perspective view of the support framework and sub-containers shown in FIG. 42.
Figure 44:
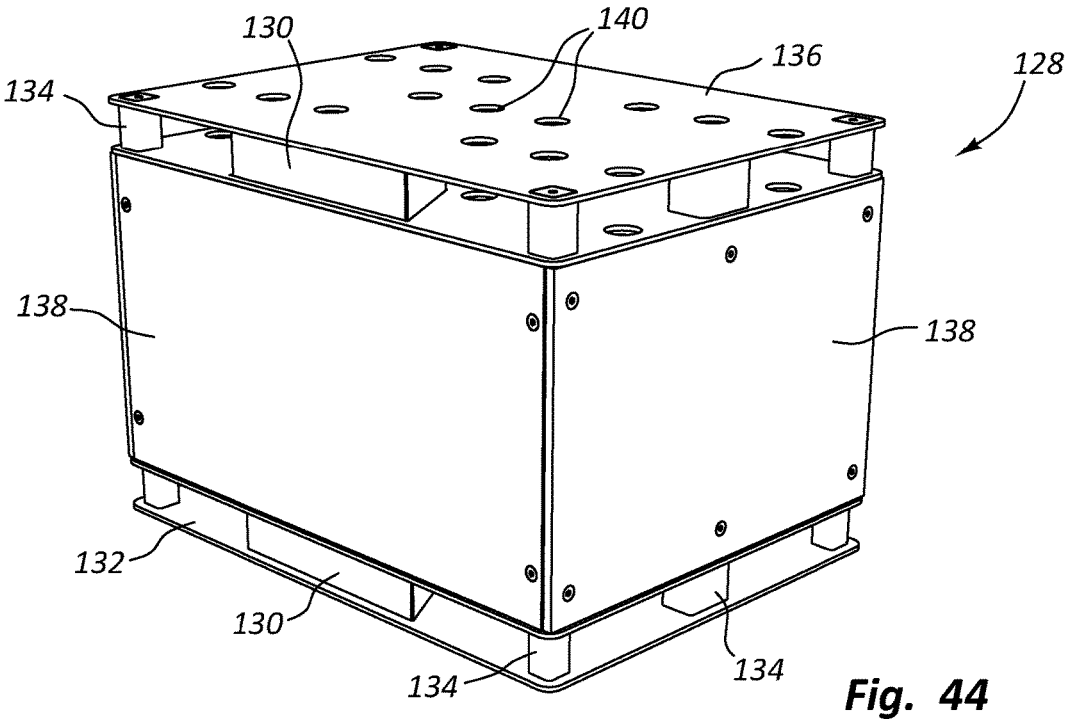
FIG. 44 is a perspective view of the assembled support framework shown in FIG. 42 with additional shielding members coupled to the exterior.
Figure 45:
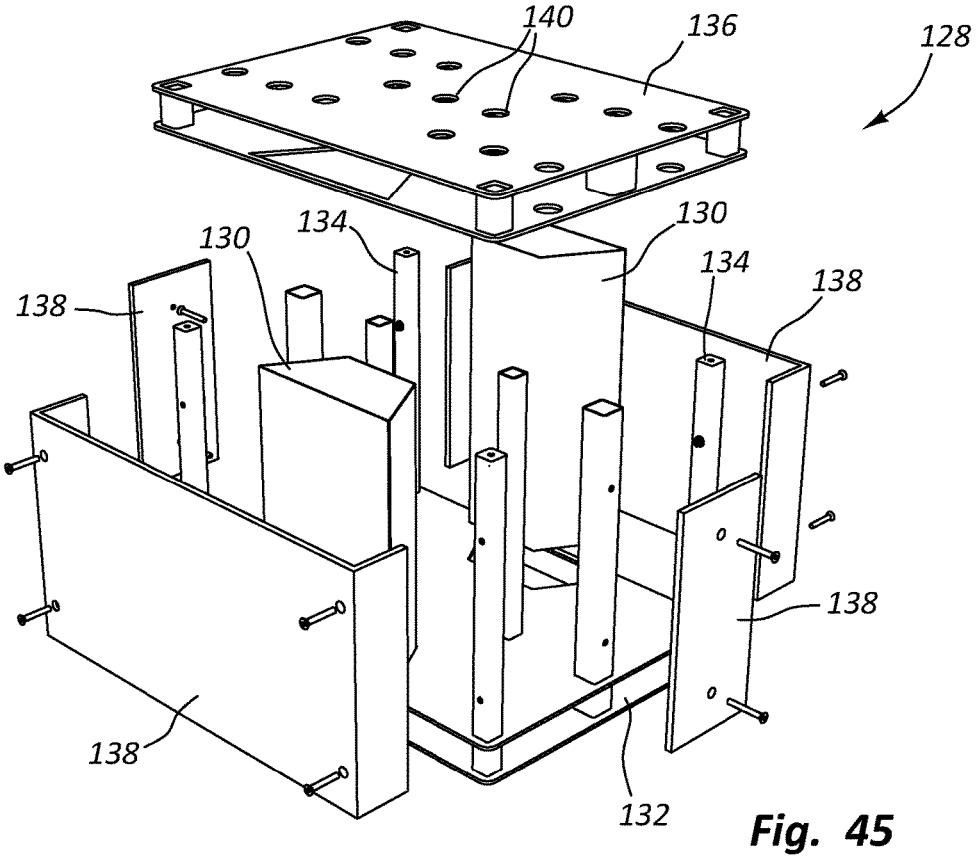
FIG. 45 is an exploded, perspective view of the support framework and shielding members shown in FIG. 44.
Figure 46:
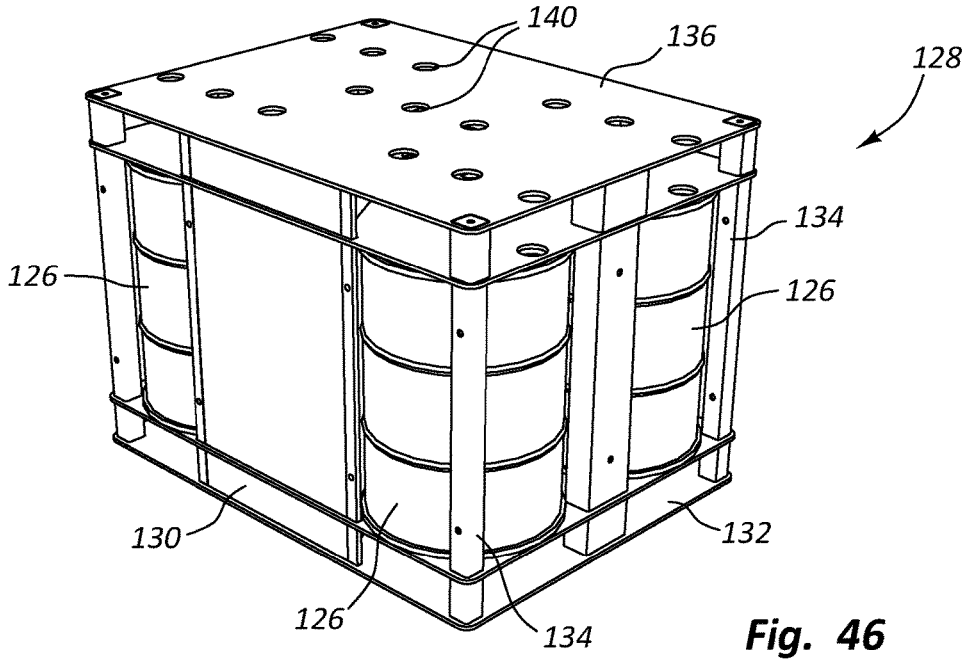
FIG. 46 is a perspective view of another embodiment of the assembled support framework filled with sub-containers (five 85 gallon (322 liter) drums).
Figure 47:
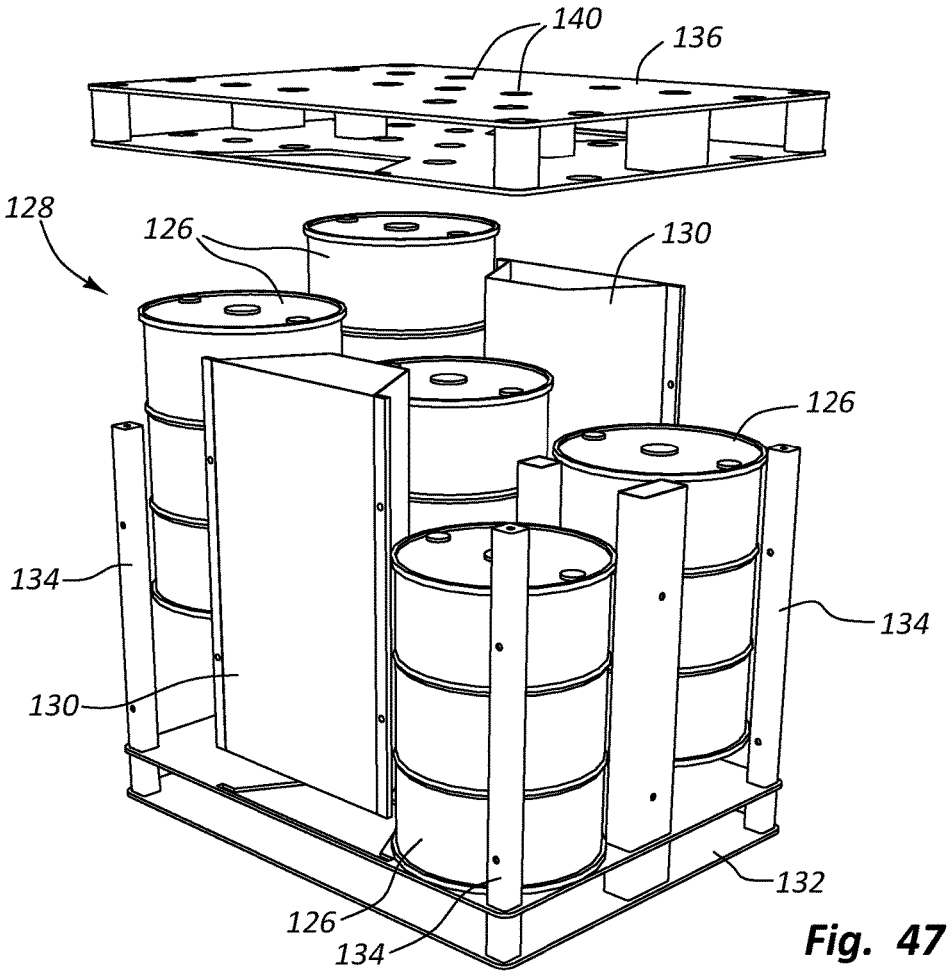
FIG. 47 is an exploded, perspective view of the support framework and sub-containers shown in FIG. 46.
Figure 48:
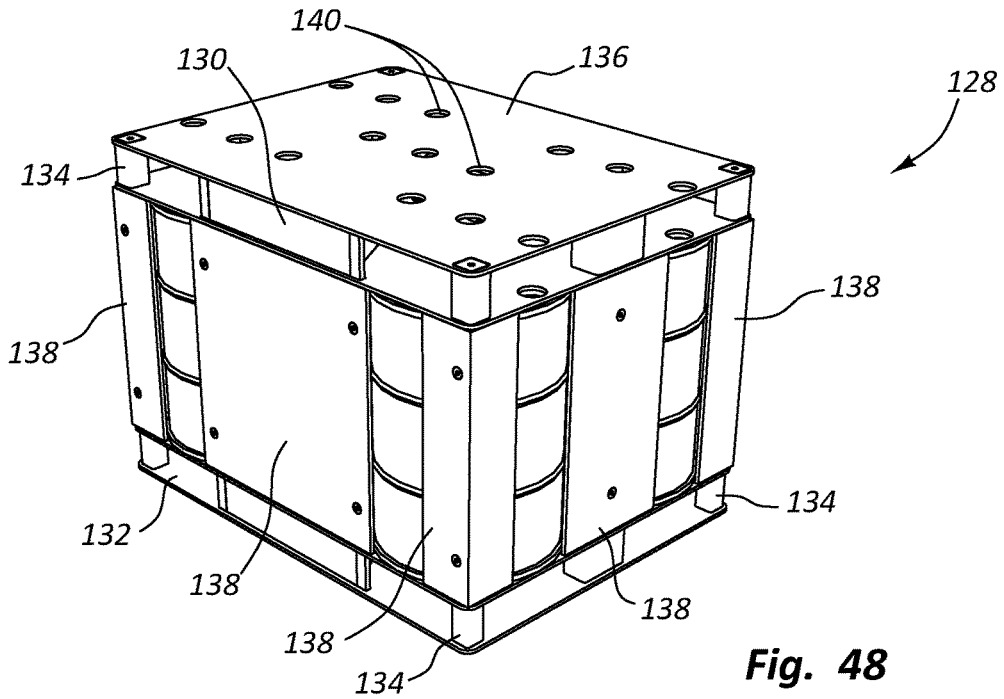
FIG. 48 is a perspective view of the assembled support framework shown in FIG. 46 with additional shielding members coupled to the exterior.
Figure 49:
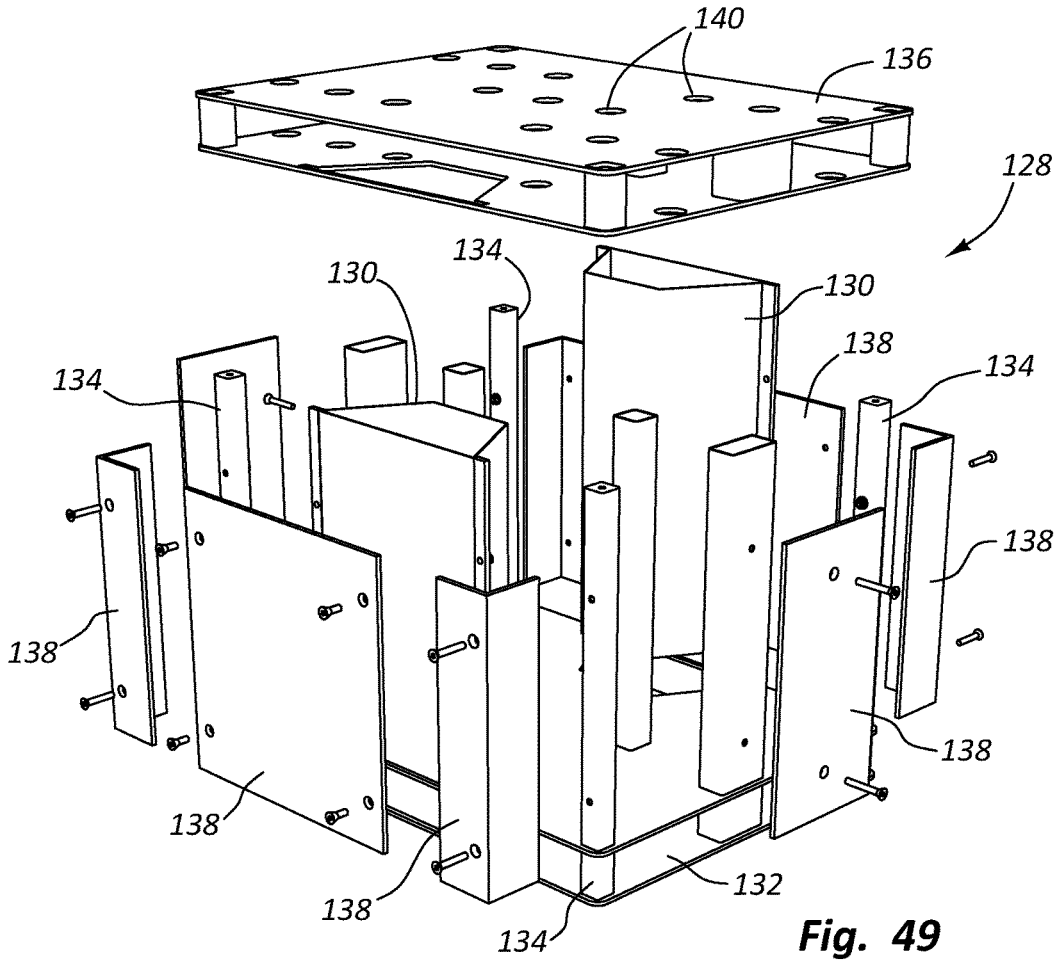
FIG. 49 is an exploded, perspective view of the support framework and shielding members shown in FIG. 48.
Figure 50:
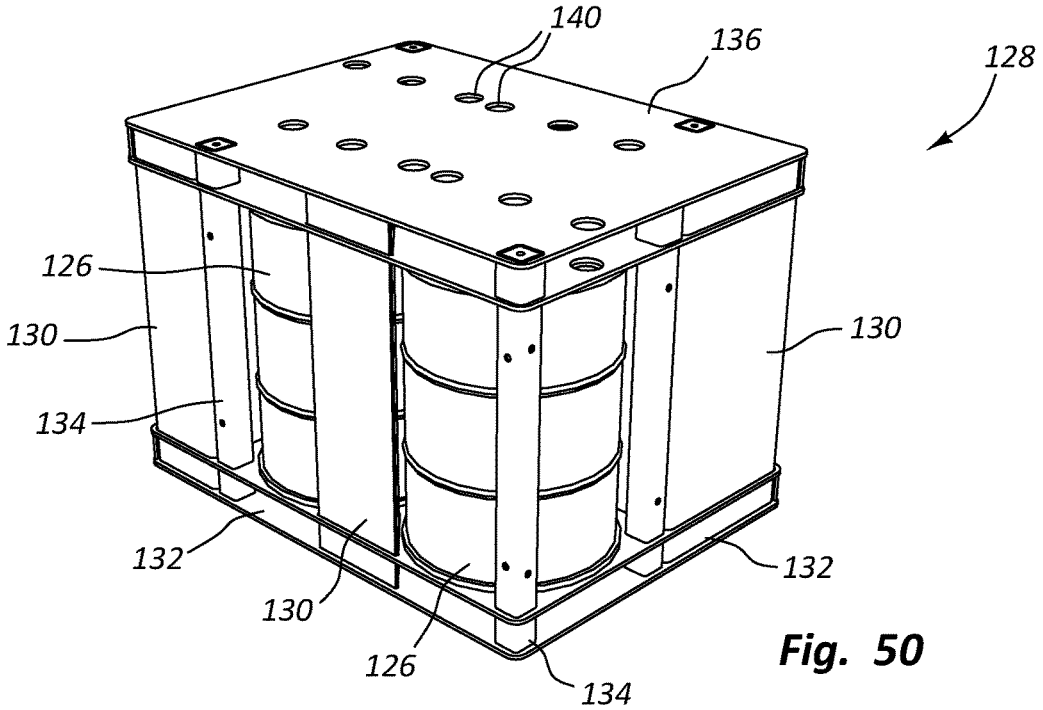
FIG. 50 is a perspective view of another embodiment of the assembled support framework filled with sub-containers (four 85 gallon (322 liter) drums).
Figure 51:
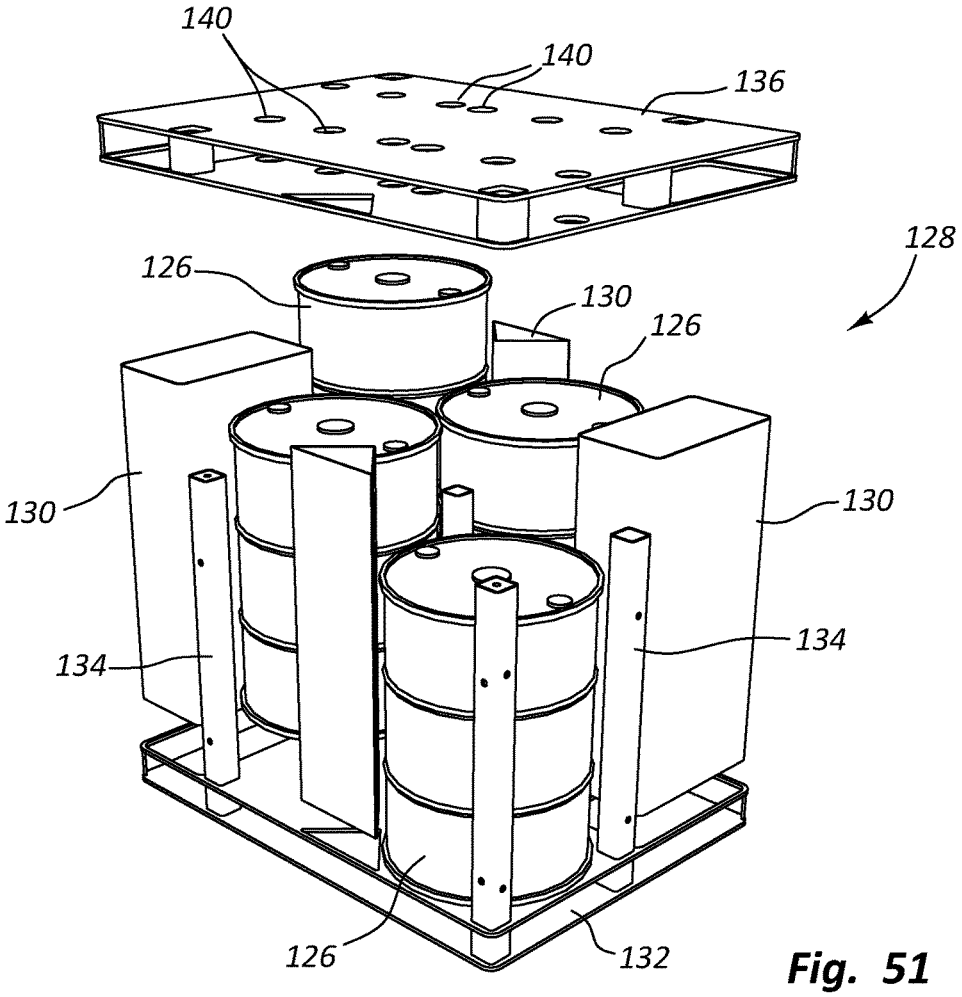
FIG. 51 is an exploded, perspective view of the support framework and sub-containers shown in FIG. 50.
Figure 52:
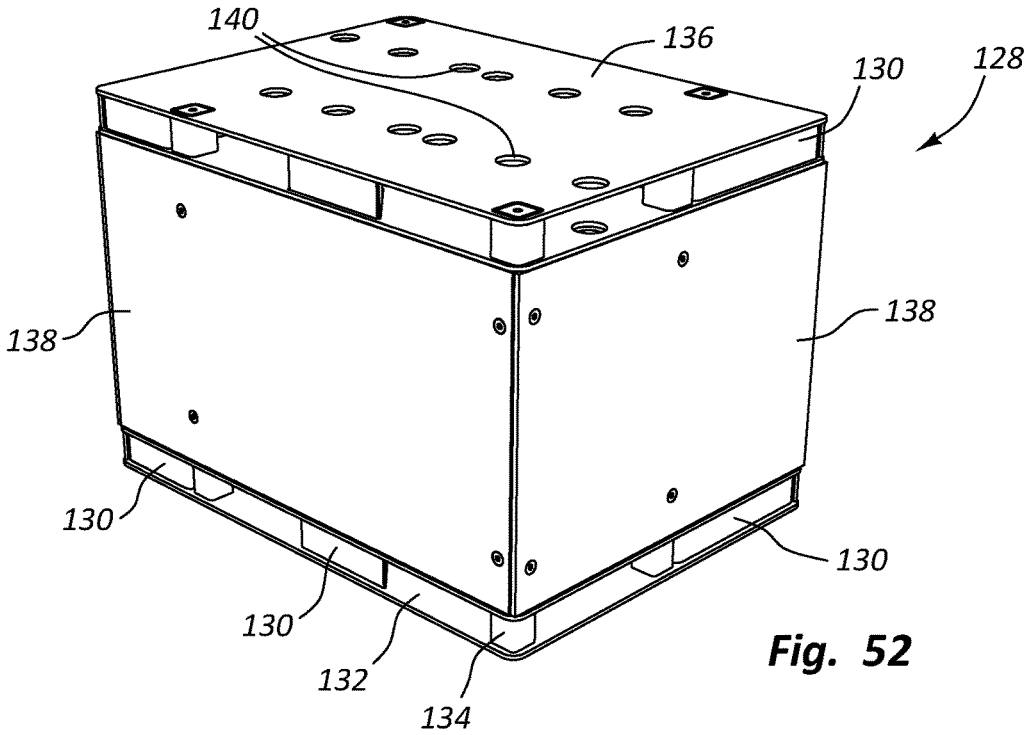
FIG. 52 is a perspective view of the assembled support framework shown in FIG. 50 with additional shielding members coupled to the exterior.
Figure 53:
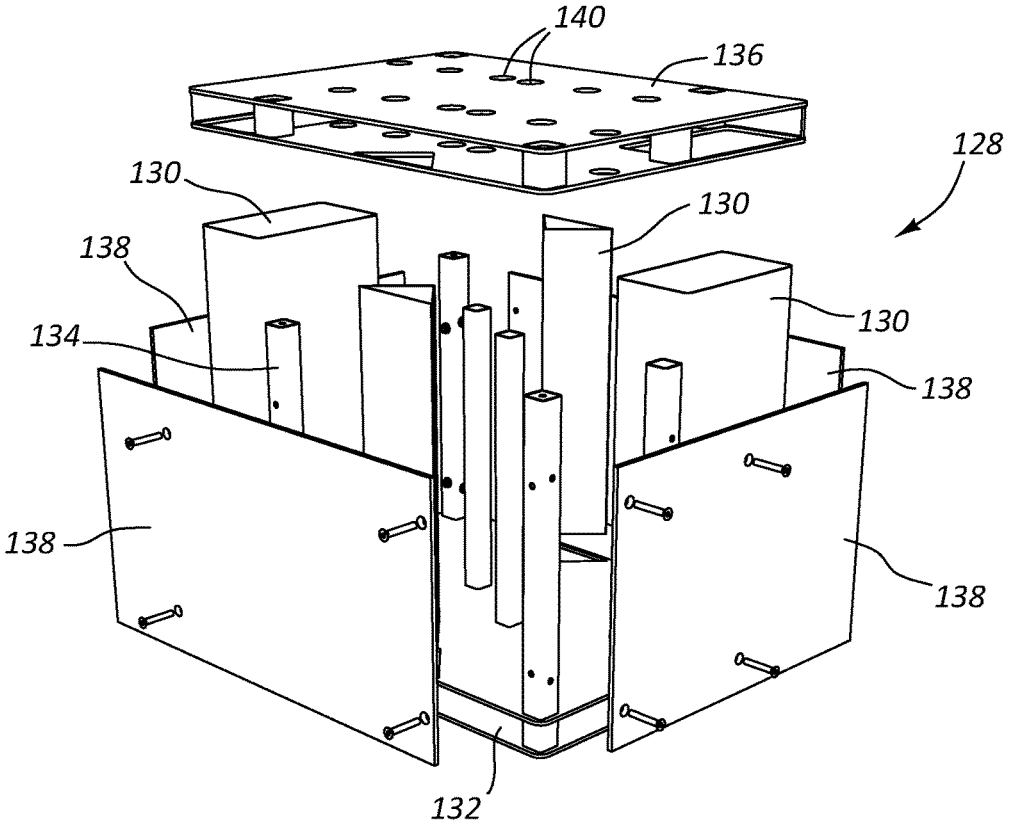
FIG. 53 is an exploded, perspective view of the support framework and shielding members shown in FIG. 52.

Referring to FIGS. 40-41, the support framework 128 can also include supplemental shielding members 138. In one embodiment, the shielding members 138 are panels of steel with a typical configuration providing an additional 0.5 to 1.5 inches (12 mm to 39 mm) of steel shielding (e.g., 1 inch (25 mm) of steel shielding). It should be appreciated that the shielding members 138 can be made of any suitable shielding material and have any suitable shape or configuration.

The modular container 10 can accommodate a variety of standard sub-containers as shown in the table below. Each configuration is described below. It should be appreciated that the above discussion related to wet radioactive waste and the various components of the modular container 10, support framework 128, and the like apply to the following configurations unless noted otherwise.

TABLE 7

Typical Modular Container and Sub-Container Configurations for Wet Waste

| Sub-Container | | | Shielding | | Support Framework Configuration | | | |
|---|---|---|---|---|---|---|---|---|
| Type | Volume gal (liter) | Arrangement in Modular Container | Insert Thickness* inches (mm) | Usable Cavity Vol. $ft^3$ ($m^3$) | Auxiliary Bin Configuration | Aux. Bin Usable Vol. $ft^3$ ($m^3$) | Optional Shield Plates | Lifting Modes |
| Drum | 55 (210) | 2 × 3 = 6 | 4 (100) | 118 (3.3) | 2 center + 4 side = 6 | 12.3 (0.35) | 1 in. thick | Forklift or Crane |
| Drum | 55 (210) | 2 + 1 + 2 = 5 | 6 (150) | 95 (2.7) | 2 side | 7.8 (0.22) | 1 in. thick | Forklift or Crane |
| Drum | 85 (322) | 2 + 1 + 2 = 5 | 4 (100) | 118 (3.3) | 2 side | 15.0 (0.42) | ⅝ in. thick | Forklift or Crane |
| Drum | 85 (322) | 1 × 2 + 1 × 2 = 4 | 6 (150) | 95 (2.7) | 2 corner + 2 side = 4 | 17.3 (0.49) | ⅝ in thick | Forklift or Crane |
| Drum (special) | 132 (500) | 1 × 2 = 2 | 4 (100) | 118 (3.3) | 2 side + 2 side = 4 | 28.1 (0.80) | 1 in. thick | Crane or Individual |
| Drum (special) | 132 (500) | 1 × 2 = 2 | 6 (150) | 95 (2.7) | 4 side + 4 side = 8 | 41.3 (1.17) | None | Individual |
| Cylindrical HIC | 400 (1500) | 1 × 1 = 1 | 4 (100) | 118 (3.3) | 4 corner + 2 end = 6 | 25.4 (0.72) | 1 in. thick | Crane or Individual |
| Cylindrical HIC | 300 (1125) | 1 × 1 = 1 | 6 (150) | 95 (2.7) | 4 corner + 2 end = 6 | 19.0 (0.54) | None | Crane or Individual |
| Cuboidal HIC or Liner | 1200 (4540) | 1 × 1 = 1 | None | 175 (5.0) | None | None | None | Individual |
| Cuboidal HIC or Liner | 800 (3030) | 1 × 1 = 1 | 4 (100) | 118 (3.3) | None | None | None | Individual |
| Cuboidal HIC or Liner | 600 (2270) | 1 × 1 = 1 | 6 (150) | 95 (2.7) | None | None | None | Individual |

*Excludes additional shielding provided by container enclosure envelope - e.g., 0.75 inches (19 mm) additional shielding Referring to FIGS. 37-41, one embodiment of the modular container 10 having 4 inch (102 mm) shielding inserts 50, 52, 54, 56 loaded with sub-containers 126 that are 55 gallon (208 liter) drums filled with radioactive waste. The sub-containers 126 are held in position by the support framework 128. In this configuration, the modular container 10 can hold six of the 55 gallon (208 liter) drums.

The support framework 128 includes two auxiliary bins 130 positioned in the center of the support framework 128. These bins 130 can be used to hold higher activity waste that requires additional shielding and the bins 130 near the edges of the support framework can be used to hold lower activity waste.

FIGS. 42-45 show another embodiment of the support framework 128 loaded with 55 gallon (208 liter) drum sub-containers 126 filled with radioactive waste. The support framework 128 is sized to fit in the cavity 14 of the modular container 10 with 6 inch (152 mm) shielding inserts 50, 52, 54, 56. In this configuration, the modular container 10 can hold five 55 gallon (208 liter) drums with two on each end and one in the middle. The support framework 128 also includes two relatively large wedge shaped auxiliary bins 130 positioned on opposite sides of the center sub-container 126.

FIGS. 46-49 show another embodiment of the support framework 128 loaded with 85 gallon (322 liter) drum sub-containers 126 filled with radioactive waste. The support framework 128 is sized to fit in the cavity 14 of the modular container 10 with 4 inch (102 mm) shielding inserts 50, 52, 54, 56. In this configuration, the modular container 10 can hold five 85 gallon (322 liter) drums with two on each end and one in the middle. The support framework 128 also includes two relatively large wedge shaped auxiliary bins 130 positioned on opposite sides of the center sub-container 126.

FIGS. 50-53 show another embodiment of the support framework 128 loaded with 85 gallon (322 liter) drum sub-containers 126 filled with radioactive waste. The support framework 128 is sized to fit in the cavity 14 of the modular container 10 with 6 inch (152) shielding inserts 50, 52, 54, 56. In this configuration, the modular container 10 can hold four 85 gallon (322 liter) drums in a diamond shape (one in opposite corners and two spread between so the sub-containers 126 form a diamond shape). The support framework 128 also includes two relatively large rectangular shaped auxiliary bins 130 positioned opposite each other on the ends of the support framework 128 and two smaller triangular shaped auxiliary bins 130 positioned opposite each other on the sides of the support framework 128.

Figure 54:
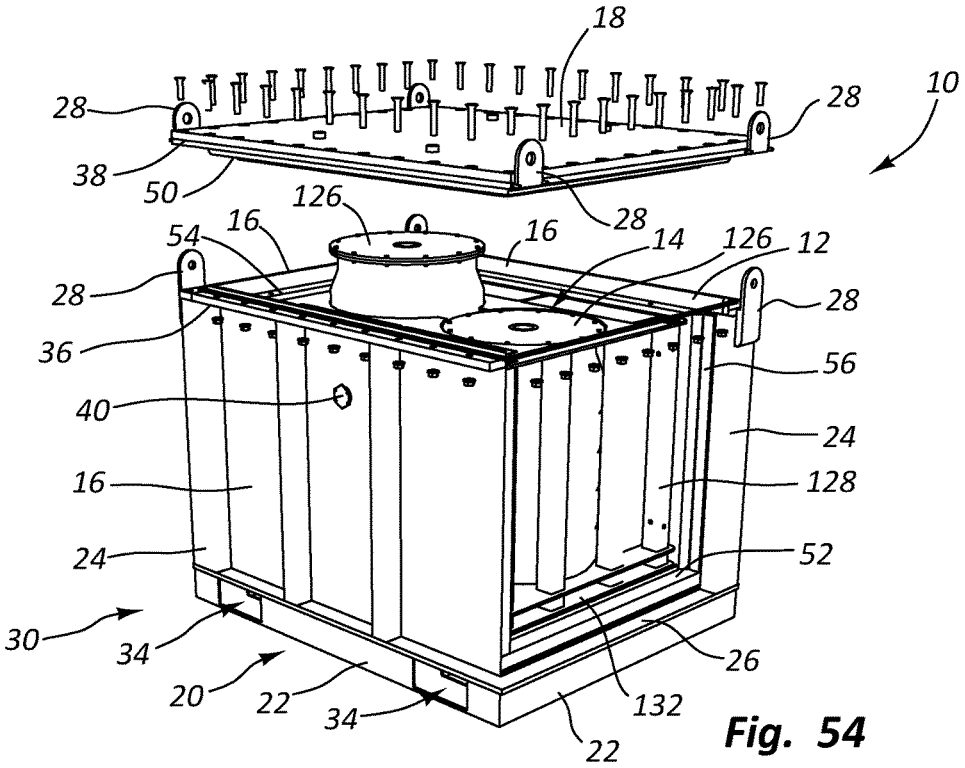
FIG. 54 is a perspective view of the modular container shown in FIG. 1 with the lid raised and the cavity lined with four inch (102 mm) shielding inserts and a support framework holding two sub-containers (two 500 liter drums) of radioactive waste.
Figure 55:
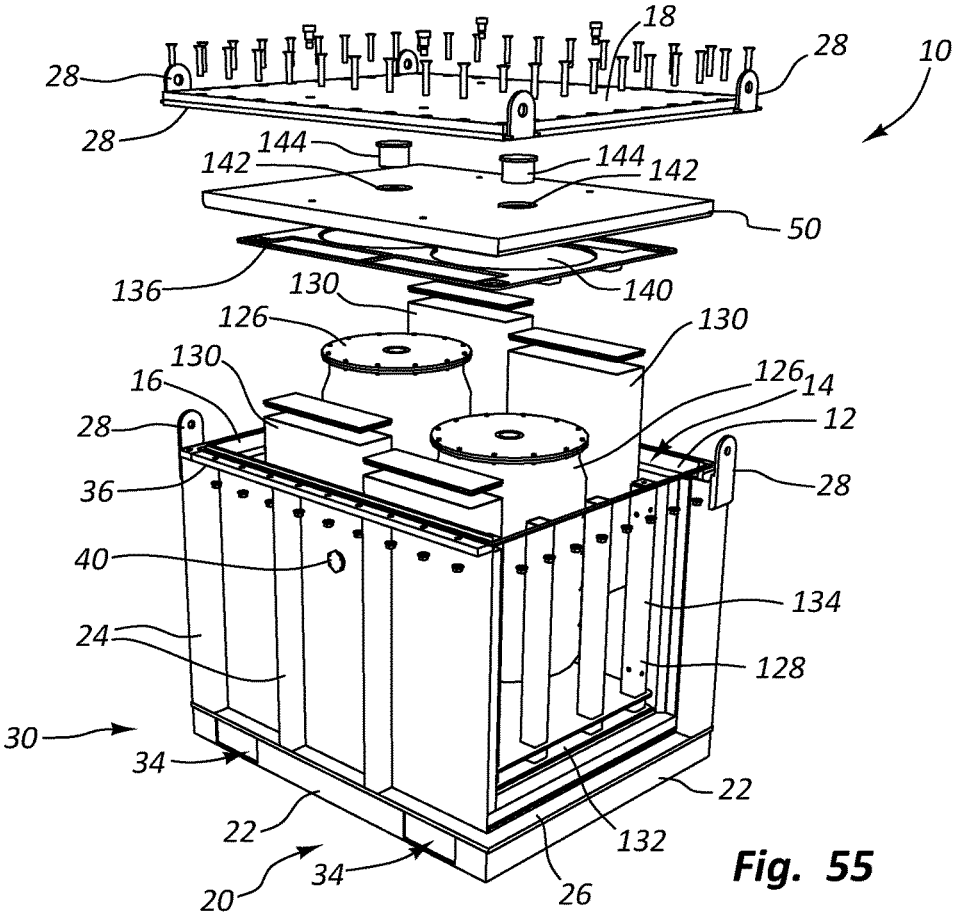
FIG. 55 is an exploded, perspective view of the modular container shown in FIG. 54 with the lid raised and the contents of the cavity exploded.
Figure 56:
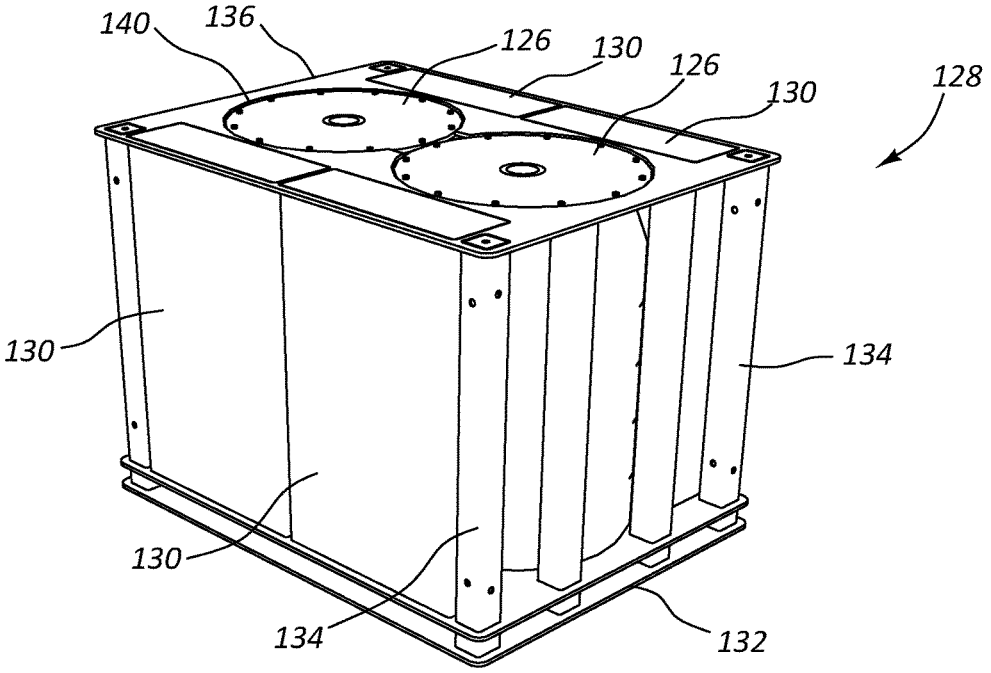
FIG. 56 is a perspective view of another embodiment of the assembled support framework filled with sub-containers (two 500 liter drums).
Figure 57:
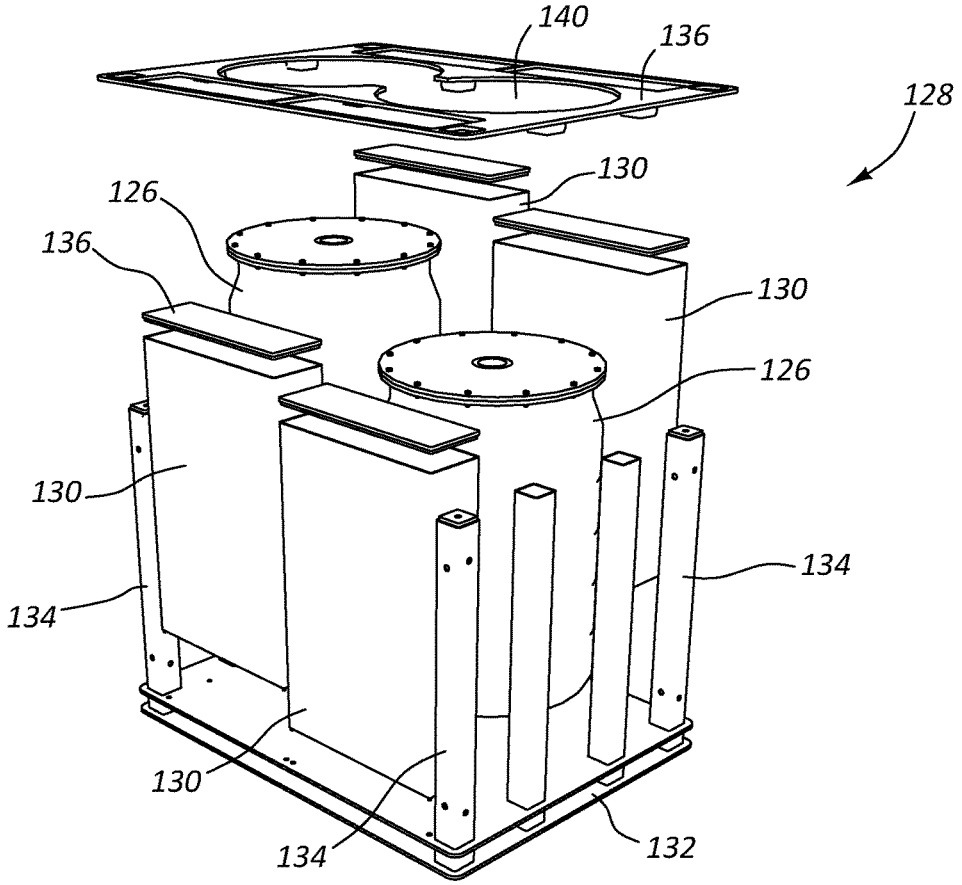
FIG. 57 is an exploded, perspective view of the support framework and sub-containers shown in FIG. 56.
Figure 58:
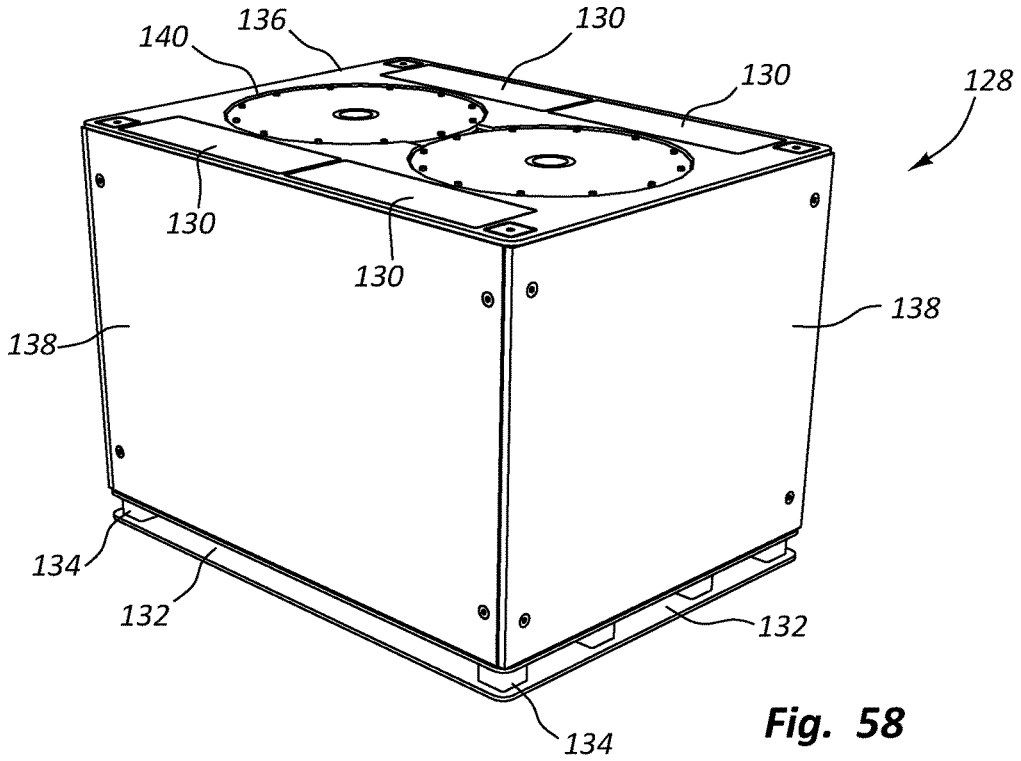
FIG. 58 is a perspective view of the assembled support framework shown in FIG. 56 with additional shielding members coupled to the exterior.
Figure 59:
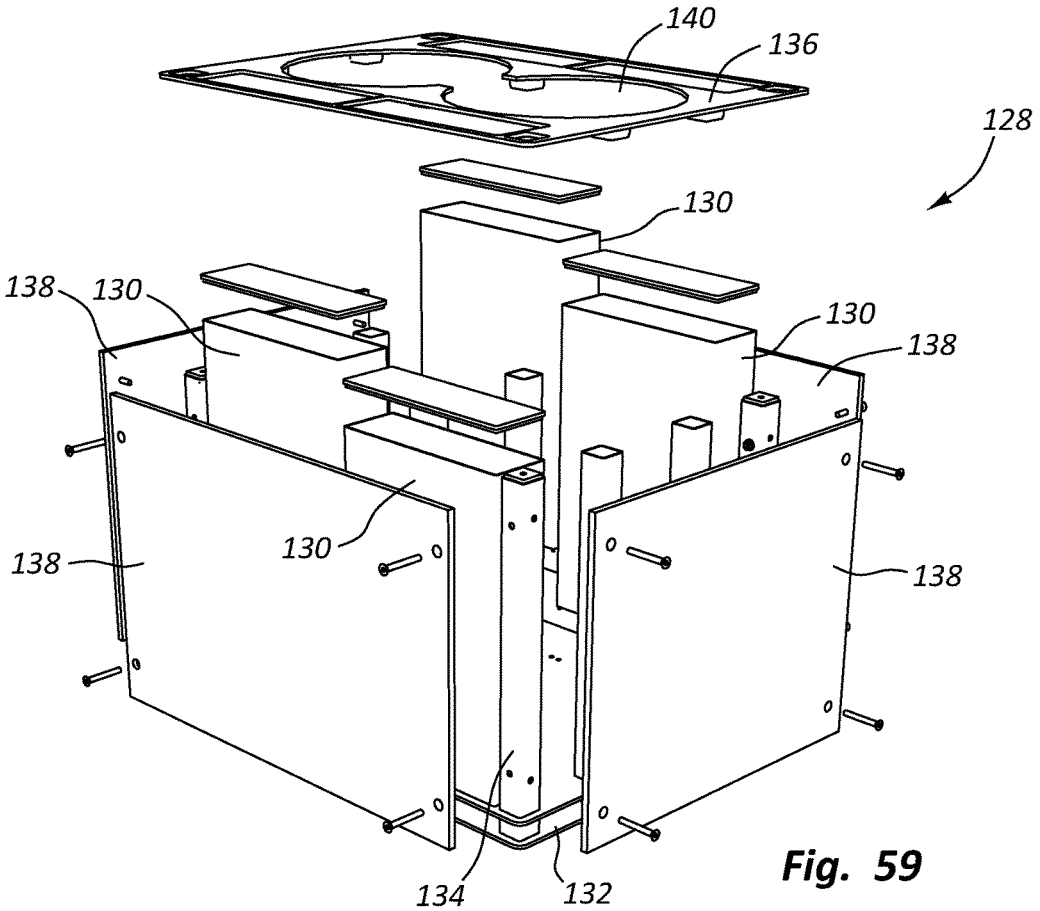
FIG. 59 is an exploded, perspective view of the support framework and shielding members shown in FIG. 58.

FIGS. 54-55 show another embodiment of the modular container 10 having 4 inch (102 mm) shielding inserts 50, 52, 54, 56 loaded with sub-containers 126 that are 500 liter drums filled with radioactive waste. The sub-containers 126 are held in position by the support framework 128. In this configuration, the modular container 10 can hold two of the 500 liter drums.

FIGS. 56-59 show another embodiment of the support framework 128 loaded with 500 liter drum sub-containers 126 filled with radioactive waste. The support framework 128 is sized to fit in the cavity 14 of the modular container 10 with 4 inch (102 mm) shielding inserts 50, 52, 54, 56. In this configuration, the modular container 10 can hold two 500 liter drums side by side. The support framework 128 also includes four relatively large rectangular shaped auxiliary bins 130 (two on one side two on the other side).

Figure 60:
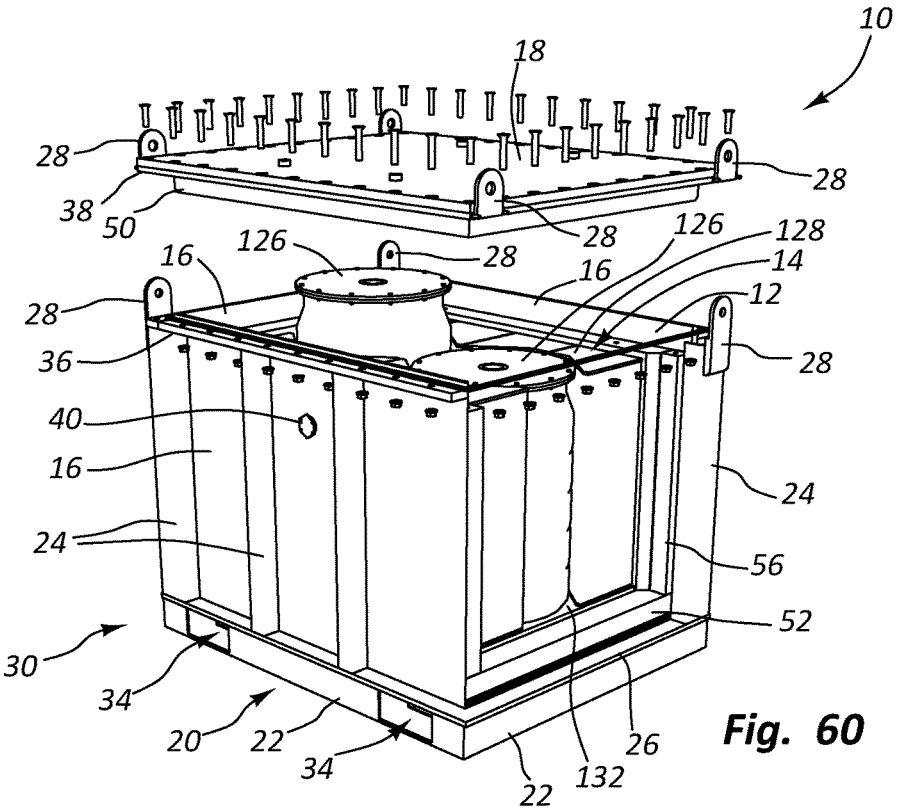
FIG. 60 is a perspective view of the modular container shown in FIG. 1 with the lid raised and the cavity lined with six inch (152 mm) shielding inserts and a support framework holding two sub-containers (two 500 liter drums) of radioactive waste.
Figure 61:
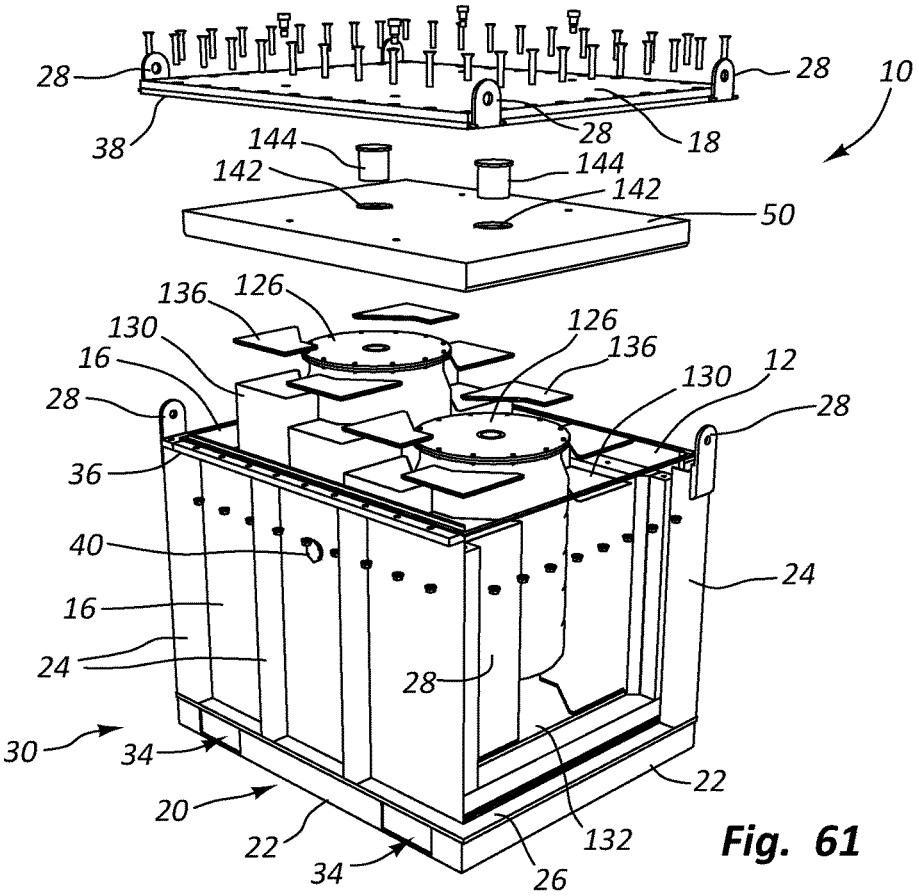
FIG. 61 is an exploded, perspective view of the modular container shown in FIG. 60 with the lid raised and the contents of the cavity exploded.

FIGS. 60-61 show another embodiment of the modular container 10 having 6 inch (152 mm) shielding inserts 50, 52, 54, 56 loaded with sub-containers 126 that are 500 liter drums filled with radioactive waste. The sub-containers 126 are held in position by the support framework 128. In this configuration, the modular container 10 can hold two of the 500 liter drums.

Figure 62:
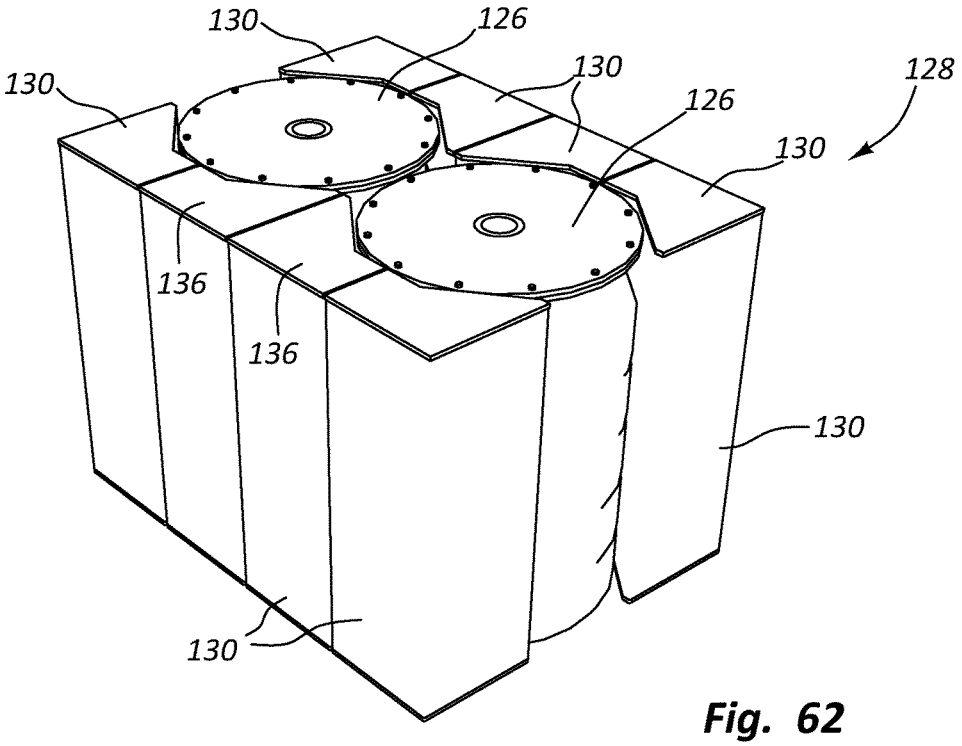
FIG. 62 is a perspective view of another embodiment of the assembled support framework filled with sub-containers (two 500 liter drums).
Figure 63:
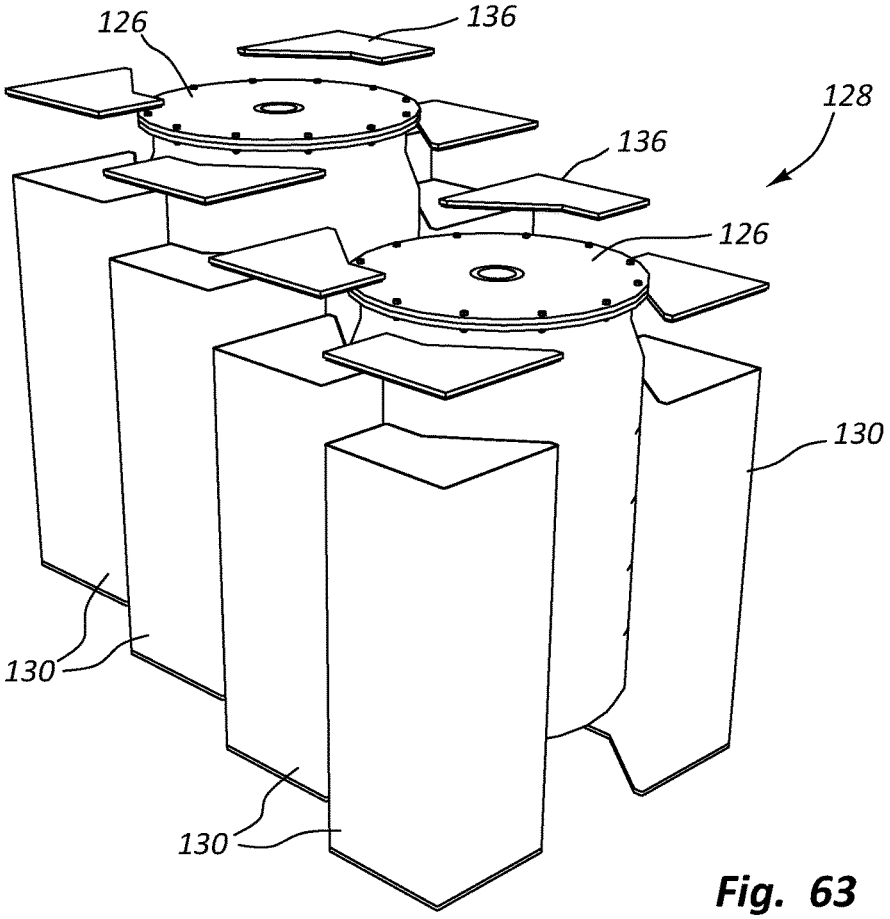
FIG. 63 is an exploded, perspective view of the support framework and sub-containers shown in FIG. 62.

FIGS. 62-63 show another embodiment of the support framework 128 enclosing 500 liter drum sub-containers 126 filled with radioactive waste. In this embodiment, the support framework 128 includes a plurality of auxiliary bins 130 positioned between the sub-containers 126. The bins 130 may or may not be coupled together. Four bins 130 are provided that surround each sub-container 126. It should be appreciated that shielding members 138 can be coupled to the support framework 128 shown in FIGS. 62-63 even though this is not shown in the figures.

Figure 64:
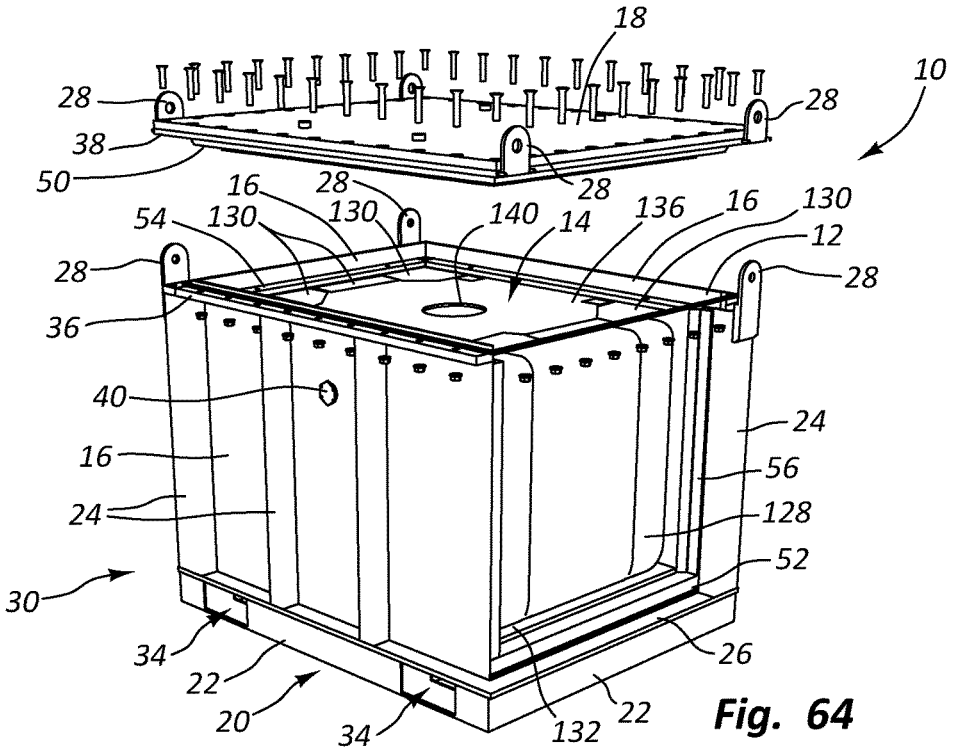
FIG. 64 is a perspective view of the modular container shown in FIG. 1 with the lid raised and the cavity lined with four inch (102 mm) shielding inserts and a single sub-container (cylindrical HIC sub-container) filled with radioactive waste.
Figure 65:
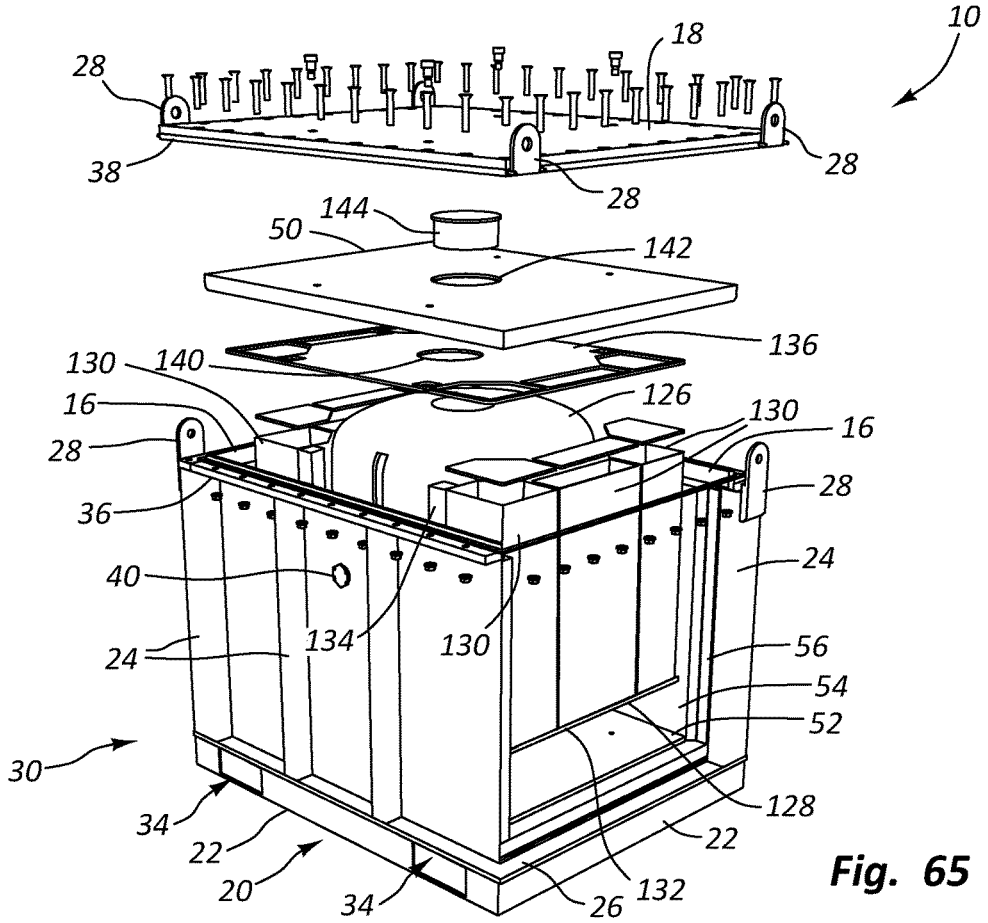
FIG. 65 is an exploded, perspective view of the modular container shown in FIG. 64 with the lid raised and the contents of the cavity exploded.

FIGS. 64-65 show another embodiment of the modular container 10 having 4 inch (102 mm) shielding inserts 50, 52, 54, 56 loaded with a cylindrical HIC (high-integrity-container) sub-container 126 filled with radioactive waste. The sub-container 126 is held in position by the support framework 128. HIC's are widely used in the U.S. and elsewhere to hold stabilized wet waste.

In one embodiment, the HIC sub-container 126 can be fitted with internal components to facilitate dewatering of the radioactive waste, cementation of the radioactive waste, or other stabilization processes. Examples of internal components that can be included in or with the HIC sub-container 126 include process piping/tubing, screens, strainers, and process filters, expanded metal grating and foam, mixing paddles, process equipment connectors, and the like.

Figure 66:
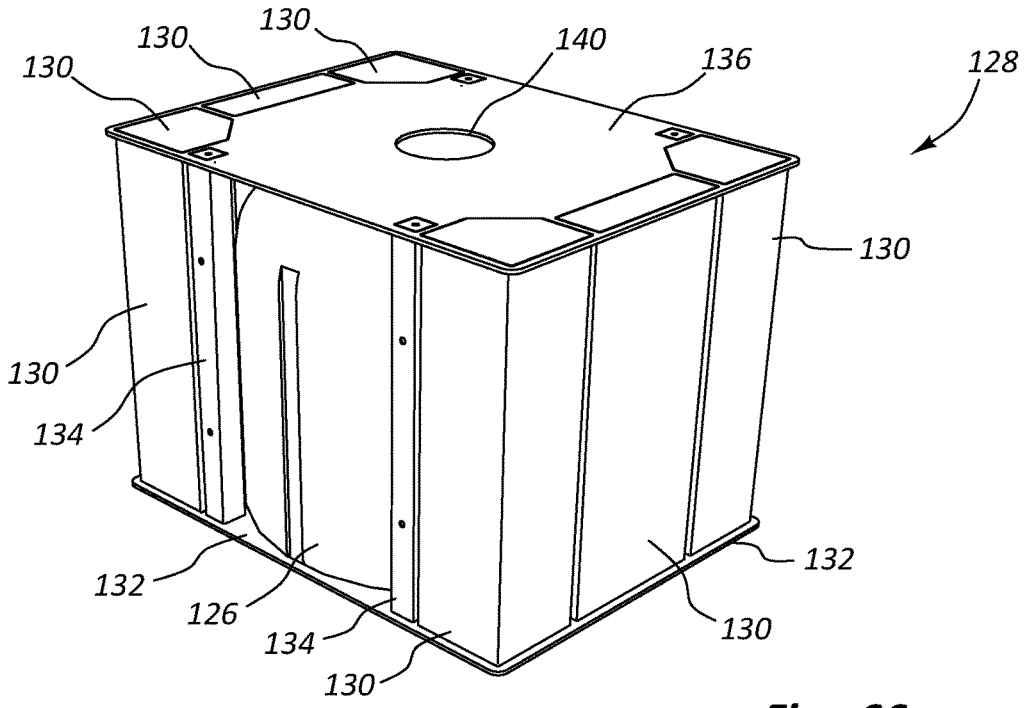
FIG. 66 is a perspective view of the assembled support framework in FIG. 64 holding the HIC sub-container.
Figure 67:
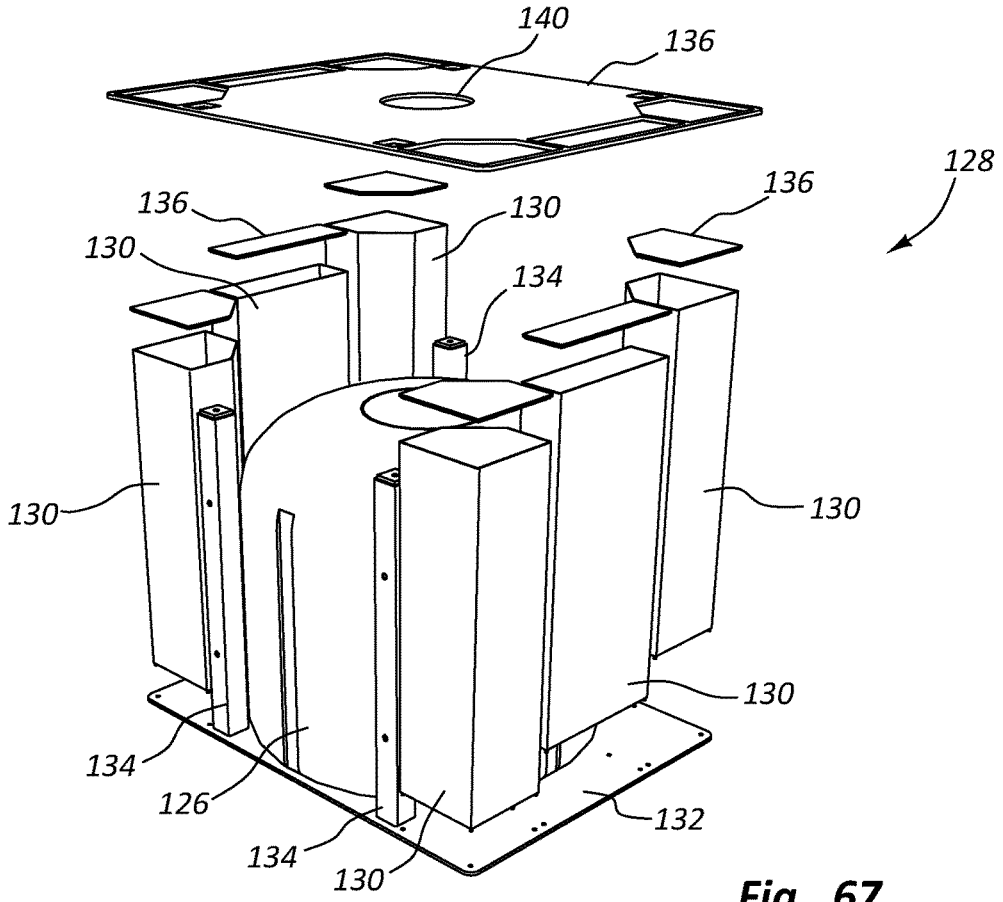
FIG. 67 is an exploded, perspective view of the support framework and sub-containers shown in FIG. 66.

FIGS. 66-67 show the support framework 128 in FIGS. 64-65 enclosing the HIC sub-container 126 filled with radioactive waste. The support framework 128 includes a plurality of auxiliary bins 130 positioned on the ends of the support framework 128. The bins 130 are coupled to the support base 132 and top insert 136. In one embodiment, the top insert 136 includes multiple pieces which close the tops of the auxiliary bins 130 and/or fit over the HIC sub-container 126.

Figure 68:
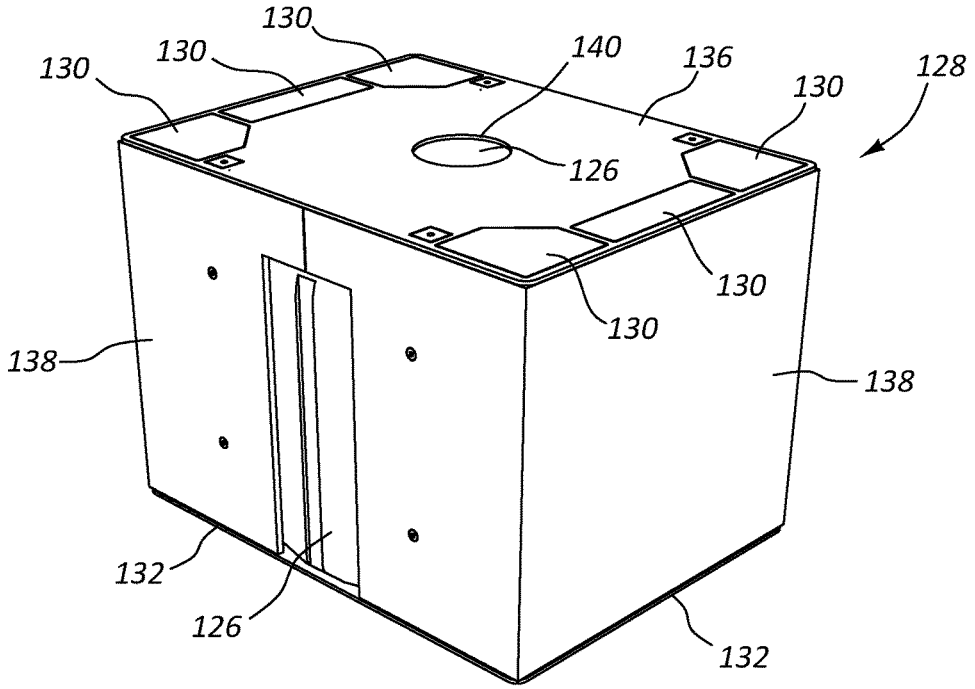
FIG. 68 is a perspective view of the assembled support framework shown in FIG. 66 with additional shielding members coupled to the exterior.
Figure 69:
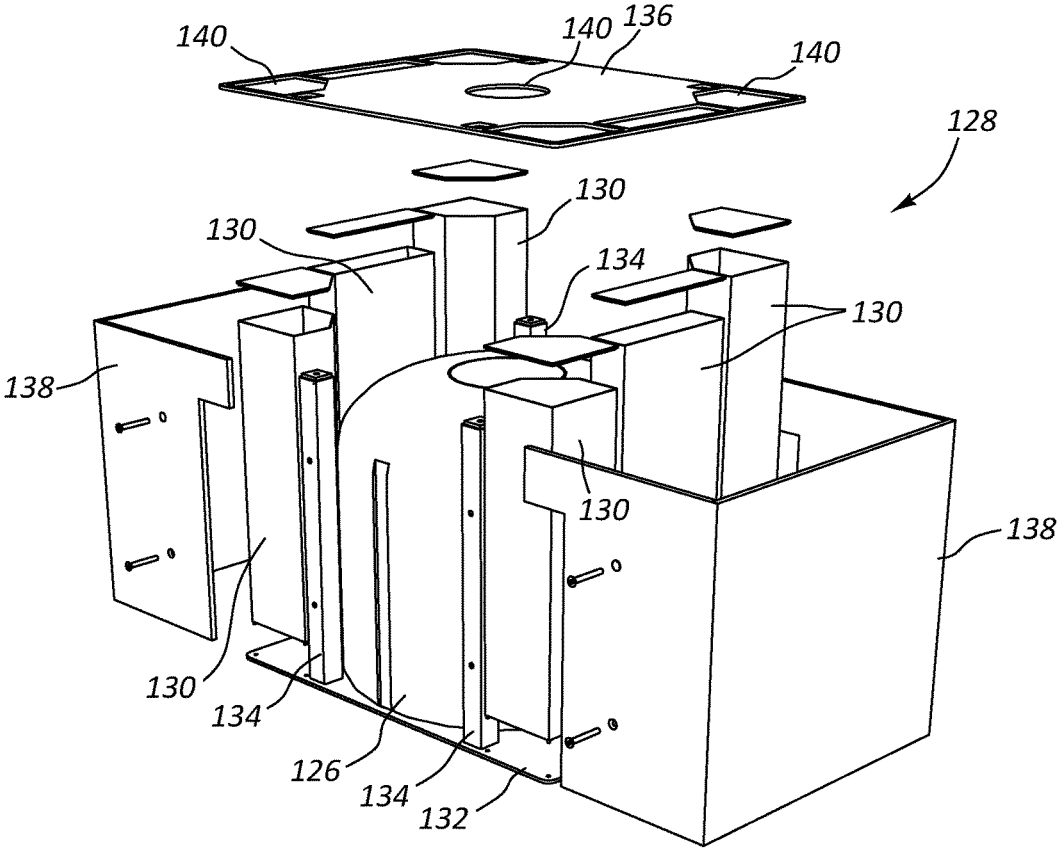
FIG. 69 is an exploded, perspective view of the support framework and shielding members shown in FIG. 68.

FIGS. 68-69 show the support framework 128 in FIGS. 66-67 with shielding members 138 coupled to the exterior of the support framework 128. The shielding members 138 include two U-shaped shielding members that face each other and almost enclose the entire HIC sub-container 126.

Figure 70:
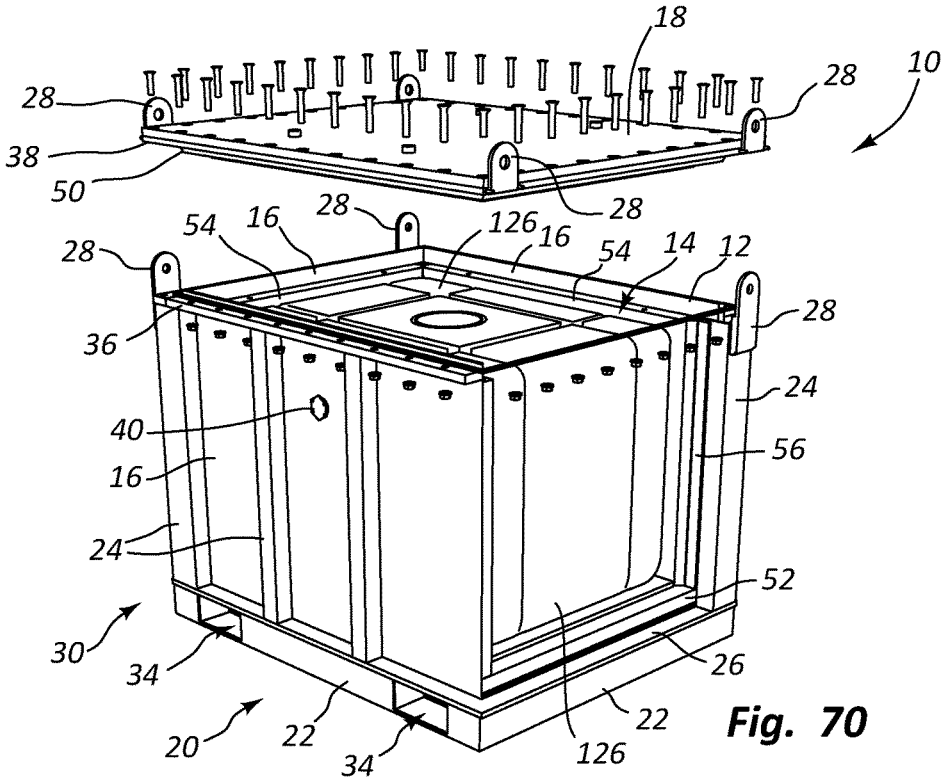
FIG. 70 is a perspective view of the modular container shown in FIG. 1 with the lid raised and the cavity including four inch (102 mm) shielding inserts and a single sub-container (cuboidal HIC sub-container) filled with radioactive waste.
Figure 71:
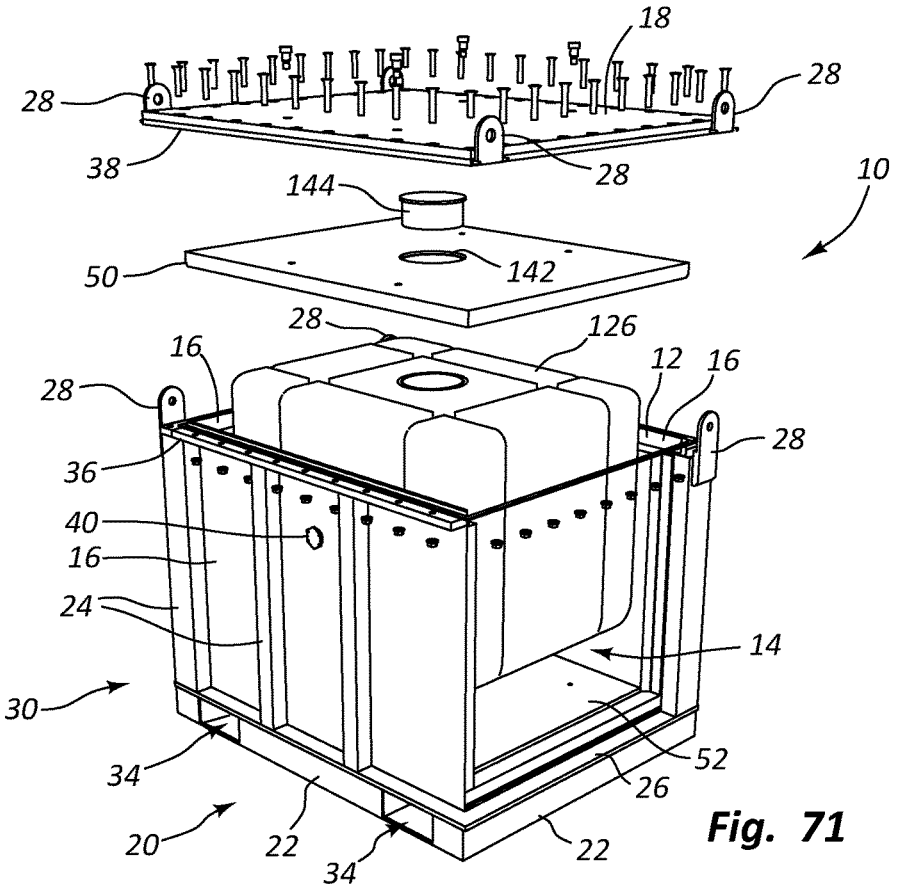
FIG. 71 is an exploded, perspective view of the modular container shown in FIG. 70 with the lid raised and the contents of the cavity exploded.

FIGS. 70-71 show another embodiment of the modular container 10 having 4 inch (102 mm) shielding inserts 50, 52, 54, 56 loaded with a cuboidal HIC (high-integrity-container) sub-container 126 filled with radioactive waste. The sub-container 126 is held in position by the support framework 128. The cuboidal shape of the HIC sub-container 126 makes better use of the available space in the cavity 14 of the modular container 10.

It should be appreciated that the HIC sub-containers 126 can be placed in the modular container 10 without the use of any shielding inserts depending on the activity level of the waste. Also, other sub-containers 126 such as bulk liquid transfer sub-containers can be put in the modular container 10 as well.

Advanced Gas-Cooled Reactor (AGR) Fuel

An AGR fuel bundle includes uranium oxide fuel pellets positioned in stainless steel clad pins separated by spacers and enclosed in a graphite sleeve. The spent AGR fuel bundles are dismantled by removing the graphite sleeve, extracting the fuel pins from the spacers, and consolidating the fuel pins into a slotted can that is about the same size as the original fuel bundle. The slotted cans are then stored in a pool.

The modular container 10 can be configured to hold the spent AGR fuel. The Grade A modular container variant 70 is preferable due to the high activity of the AGR spent fuel. It should be appreciated that other grades of the modular container 10 can also be used if the activity of the AGR spent fuel is low enough.

Figure 72:
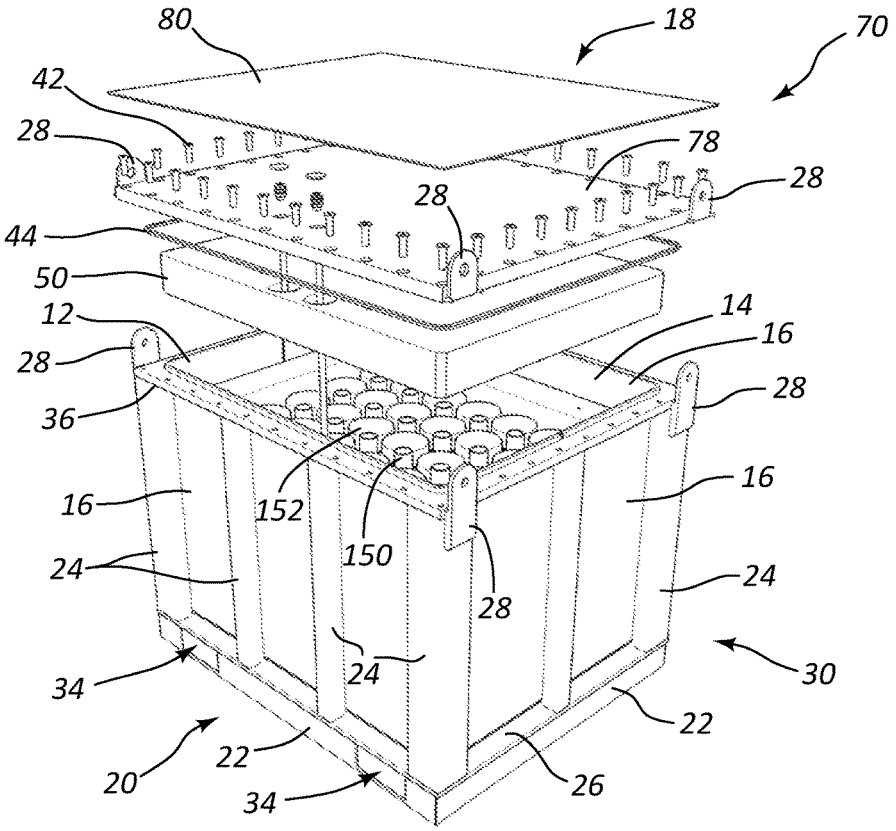
FIG. 72 is a perspective view of the Grade A modular container shown in FIG. 11 with the lid raised and the cavity including shielding inserts and a loading basket filled with spent AGR fuel.

FIG. 72 shows one embodiment of the Grade A modular container variant 70 filled with a loading basket 150 full of spent AGR fuel 152, which can be in the form of intact fuel bundles or slotted cans with consolidated fuel pins. The Grade A modular container variant 70 can be configured to hold any amount spent AGR fuel 152. For example, it can be configured to hold approximately 20 to approximately 28 intact fuel bundles or slotted cans.

The Grade A modular container variant 70 can include any amount of suitable shielding. In one embodiment, the Grade A modular container variant 70 includes 9-12 inch (228 mm to 305 mm) thick shielding inserts 50, 52, 54, 56.

The loading basket 150 is removable from the Grade A modular container variant 70. The loading basket 150 includes a box 154 and dividers 156 (alternatively referred to as divider plates). The box 154 includes lifting members 162 that facilitate handling the loading basket 150. The box 154 can also include holes 158 in the bottom to allow it to drain if it is loaded in a pool. Likewise, the dividers 156 can include recesses, holes or indentations 160 that allow water to flow underneath the divider plates 156 and out the holes 158 in the box 154.

Figure 73:
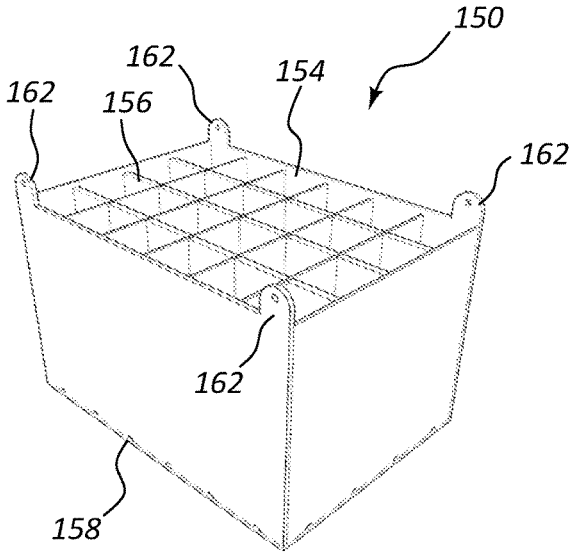
FIG. 73 is a perspective view of one embodiment of the loading basket that can be used with the Grade A modular container shown in FIG. 72.
Figure 74:
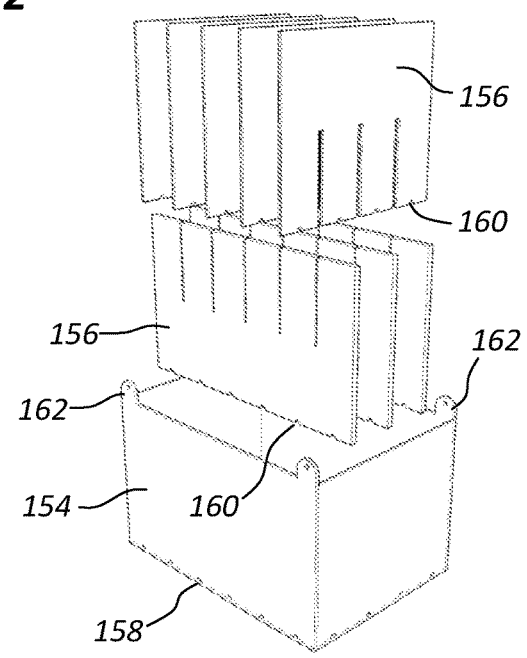
FIG. 74 is an exploded, perspective view of the loading basket shown in FIG. 73.
Figure 75:
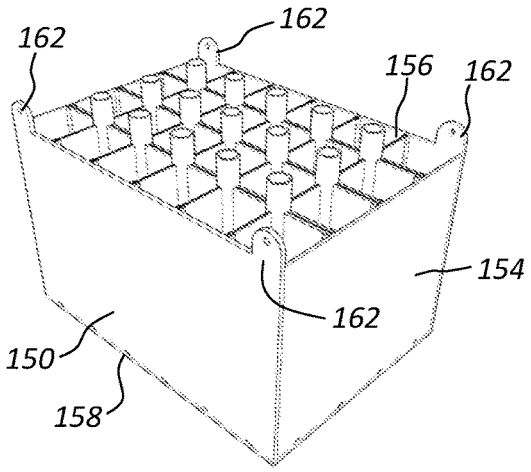
FIG. 75 is a perspective view of the assembled loading basket shown in FIG. 72

FIGS. 73-74 show one embodiment of the loading basket 150 that is configured to be used with less reactive spent AGR fuel 152, for example low enriched consolidated fuel pins. In this embodiment, the box 154 and the dividers 156 are made of stainless steel (any of the stainless steels mentioned in this document) and fit together in the manner shown in FIG. 74. The box 154 and dividers 156 can be secured together using any suitable fastening technique such as welding or bolting.

Figure 76:
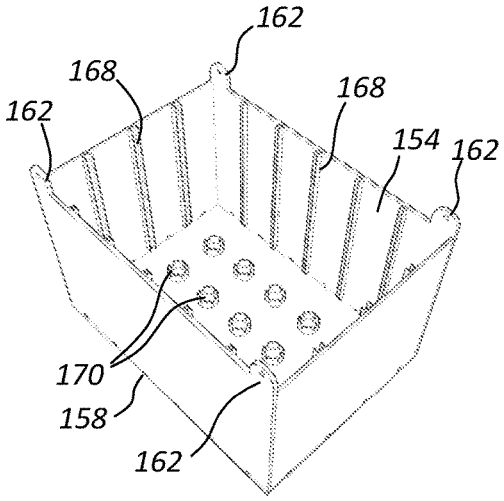
FIG. 76 is a perspective view of the box from the loading basket shown in FIG. 75.
Figure 77:
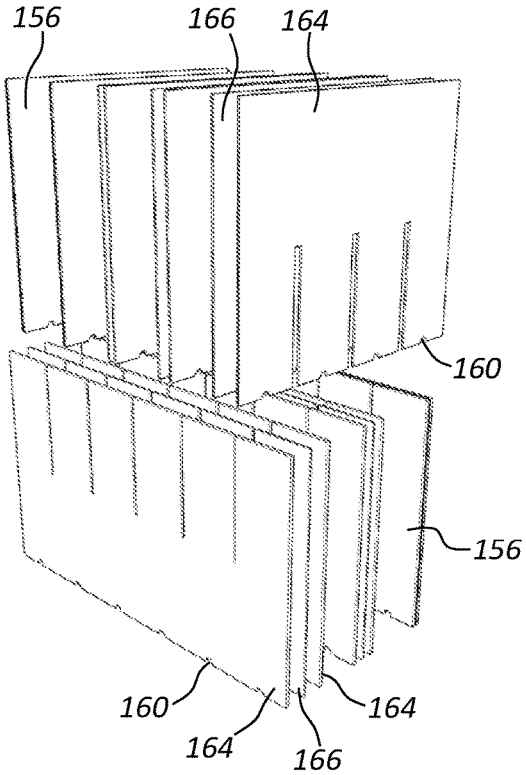
FIG. 77 is a perspective view of the dividers from the loading basket shown in FIG. 75 expanded to show the different layers.
Figure 78:
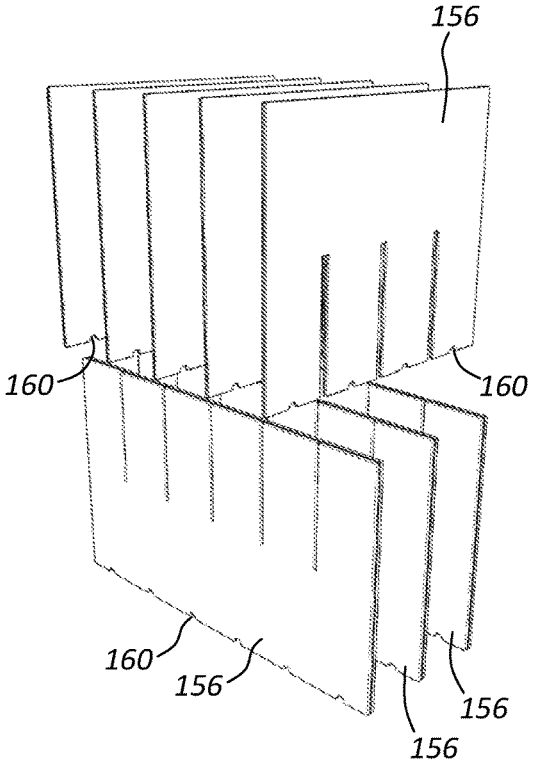
FIG. 78 is a perspective view of the dividers from the loading basket shown in FIG. 75 and how they fit together.

FIGS. 75-84 show another embodiment of the loading basket 150 that is configured to be used with more reactive spent AGR fuel 152. In this embodiment, the dividers 156 are made of one or more outer layers 164 (e.g., a first outer layer and a second outer layer) of structural material such as stainless steel and an inner layer 166 (a first inner layer or neutron absorbing layer) of boron containing material such as borated aluminum. The structural material provides structural support to the dividers 156 and the borated material provides neutron capture capability for criticality safety. As shown in FIG. 77, the dividers 156 can include one, two, or more total layers of material (structural material plus borated material).

Figure 79:
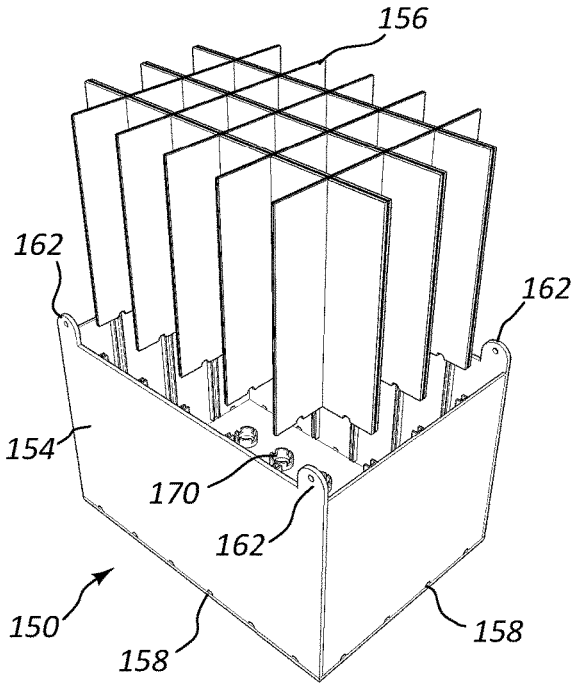
FIG. 79 is a perspective view of the dividers just before they are put in the box to form the loading basket shown in FIG. 75.
Figure 80:
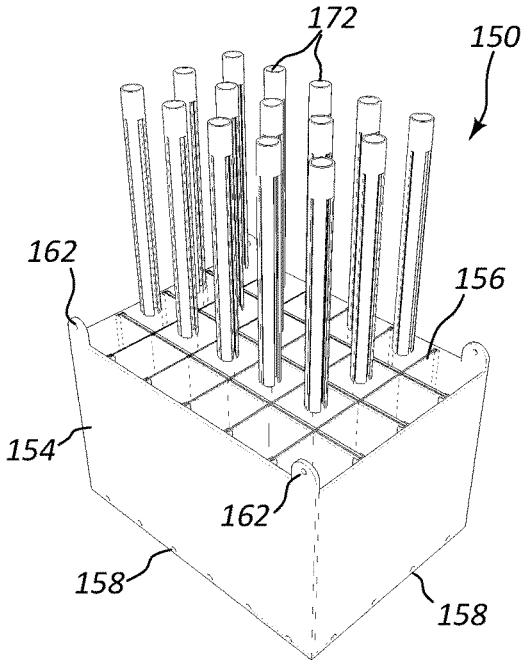
FIG. 80 is a perspective view of the tubular support members just before they are placed over the intersections of the dividers in the box to form the loading basket shown in FIG. 75.
Figure 81:
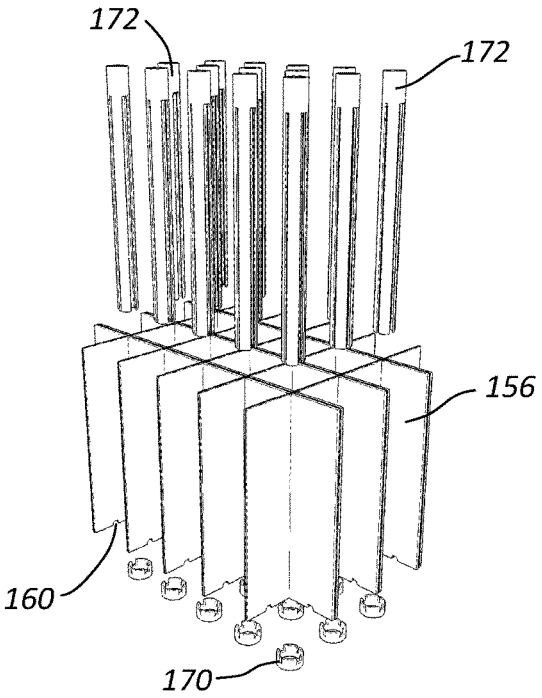
FIG. 81 is a perspective view of the tubular support members and how they fit over the intersections of the dividers and engage collars on the bottom.
Figure 82:
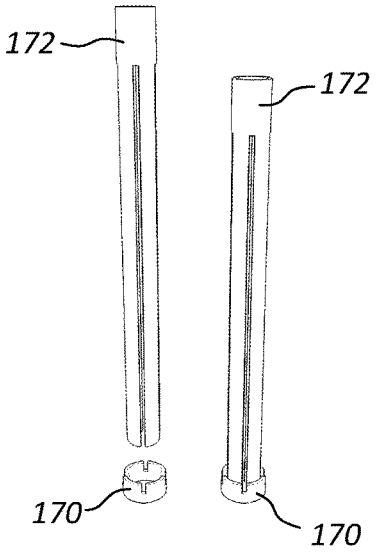
FIG. 82 is a perspective view of the tubular support members and corresponding collars that fit on the bottom of the tubular support members.
Figure 83:
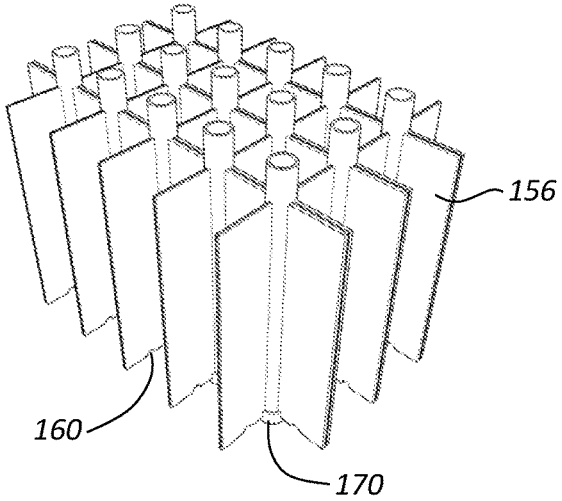
FIG. 83 is a perspective view of the assembled dividers and tubular support members from the loading basket shown in FIG. 75.

Referring to FIG. 76, the box 154 includes channels 168 coupled to the interior walls of the box 154 and sized to receive the edges of the dividers 156. FIG. 79 shows the manner in which the dividers 156 fit into the channels 168 in the box 154. The box 154 also includes collars 170 positioned in the bottom of the box 154. The collars 170 are sized to receive the bottom ends of slotted tubular support members 172 (alternatively referred to as spines) in the manner shown in FIGS. 81-83.

The channels 168 and the tubular support members 172 hold the dividers 156 and, consequently, the spent AGR fuel 152 in place in the loading basket 150. This method of securing the dividers 156 in place avoids fastening or welding any of the borated materials in the dividers 156.

Figure 84:
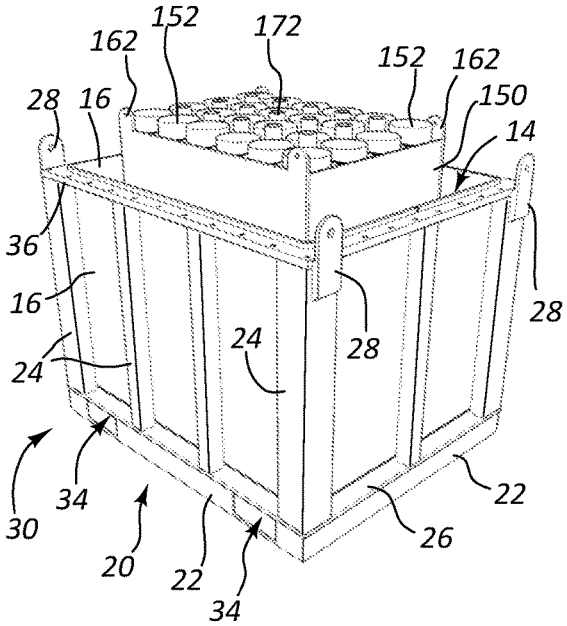
FIG. 84 is a perspective view of the loading basket shown in FIG. 75 filled with the spent AGR fuel being lowered into the Grade A modular container.
Figure 85:
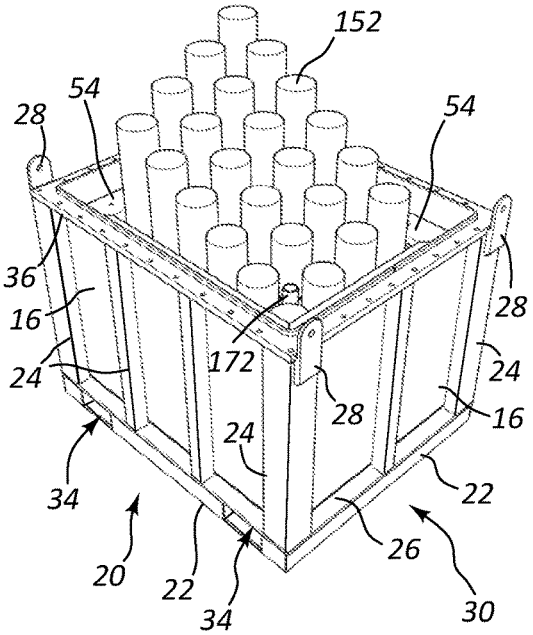
FIG. 85 is a perspective view of the loading basket shown in FIG. 75 positioned in the Grade A modular container and being successively filled with the spent AGR fuel.

The spent AGR fuel 152 can be loaded into the Grade A modular container variant 70 using any suitable method and in any suitable environment (wet or dry loading). In one embodiment, the spent AGR fuel 152 is loaded into the loading basket 150, which is then loaded into the Grade A modular container variant 70 as shown in FIG. 84. In another embodiment, the loading basket 150 is first loaded into the Grade A modular container variant 70 and then the spent AGR fuel 152 is loaded into the loading basket 150 as shown in FIG. 85.

It should be appreciated that the loading basket 150 and/or the Grade A modular container variant 70 can be loaded with the spent AGR fuel 152 in a pool or out of a pool. Referring back to FIG. 72, one embodiment of a procedure to close and seal the Grade A modular container variant 70 includes remotely placing the lid shielding insert 50 over the cavity 14, remotely placing the lid plate 78 on the main body 30 (sealing member 44 is preinstalled in lid grooves 83) and bolting it in place, draining, drying and inerting the cavity using the ports 82, 84, installing and welding the covers 92 over the ports 82, 84, installing the cover plate 80 over the structural lid 78, and welding the mating surfaces together as shown in FIGS. 16-17.

Bare Magnox Fuel

Magnox fuel elements have metallic uranium fuel rods in graphite blocks positioned in a magnesium outer casing closed at the ends by magnesium end fittings. The spent uranium fuel rods are currently extracted from the casings and consolidated for reprocessing but this may not continue.

The modular container 10, and especially the Grade A modular container variant 70, can be configured to hold the spent bare Magnox fuel. It should be appreciated that other grades of the modular container 10 can also be used if the activity of the spent bare Magnox fuel is low enough. It should also be appreciated that much of the description provided above in connection with the spent AGR fuel applies to the bare Magnox fuel unless noted otherwise. For example, the description of the holes 158, 160 and their function should be considered to apply to both situations.

Figure 86:
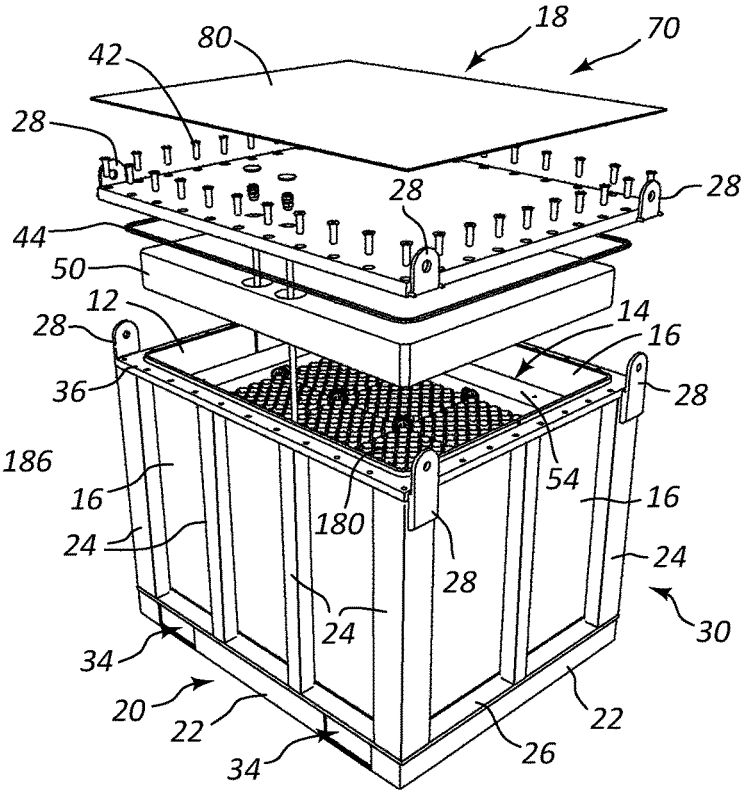
FIG. 86 is a perspective view of the Grade A modular container shown in FIG. 11 with the lid raised and the cavity including shielding inserts and a loading basket filled with spent bare Magnox fuel.
Figure 87:
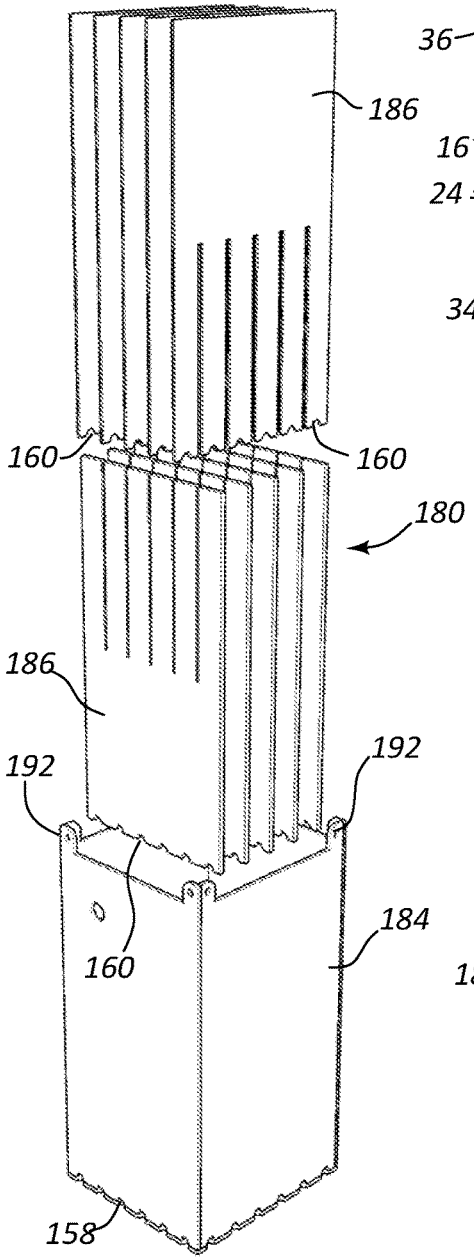
FIG. 87 is an exploded, perspective view of the loading basket shown in FIG. 86.
Figure 88:
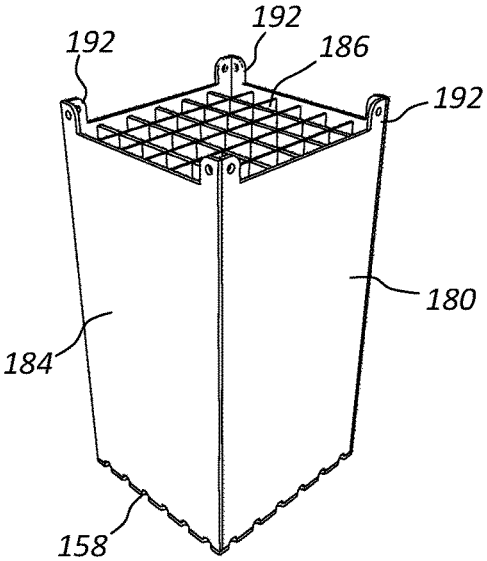
FIG. 88 is a perspective view of the loading basket shown in FIG. 86 with the dividers positioned inside.
Figure 89:
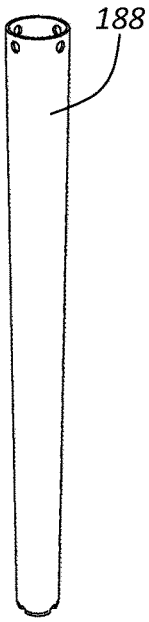
FIG. 89 is a perspective view of a tube that is configured to hold spent bare Magnox fuel in the loading basket shown in FIG. 86.
Figure 90:
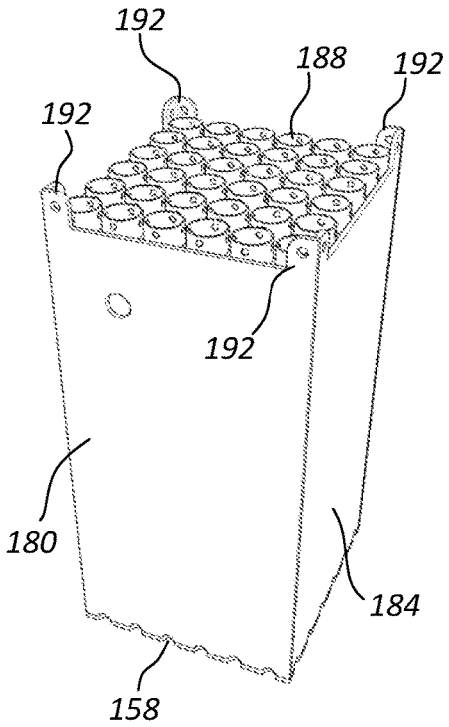
FIG. 90 is a perspective view of the assembled loading basket shown in FIG. 86

FIG. 86 shows one embodiment of the Grade A modular container variant 70 filled with a loading basket 180 full of spent bare Magnox fuel (not shown). The Grade A modular container variant 70 can be configured to hold any amount of spent bare Magnox fuel. The Grade A modular container variant 70 can include any amount of suitable shielding. In one embodiment, the Grade A modular container variant 70 includes 9-12 inch (228 mm to 305 mm) thick shielding inserts 50, 52, 54, 56.

The loading basket 180 is removable from the Grade A modular container variant 70. The loading basket 180 includes a box 184 and dividers 186 (alternatively referred to as divider plates). The box 184 includes lifting members 192 that facilitate handling the loading basket 180. The box 184 can also include holes 158 in the bottom to allow it to drain if it is loaded in a pool. Likewise, the dividers 186 can include recesses, holes or indentations 160 that allow water to flow underneath the divider plates 186 and out the holes 158 in the box 184.

FIGS. 87-90 show one embodiment of the loading basket 180 that is configured to be used with spent bare Magnox fuel. The box 184 and the dividers 186 can be made of stainless steel (any of the stainless steels mentioned in this document) and fit together in the manner shown in FIG. 87. The box 184 and dividers 186 can be secured together using any suitable fastening technique such as welding or bolting.

The loading basket 180 includes tubes 188 that fit inside the cavities formed by the intersecting dividers 186. The tubes 188 are configured to hold the spent bare Magnox fuel. The bare Magnox fuel can be loaded into the tubes 188 before or after the tubes are put in the loading basket 180.

Figure 91:
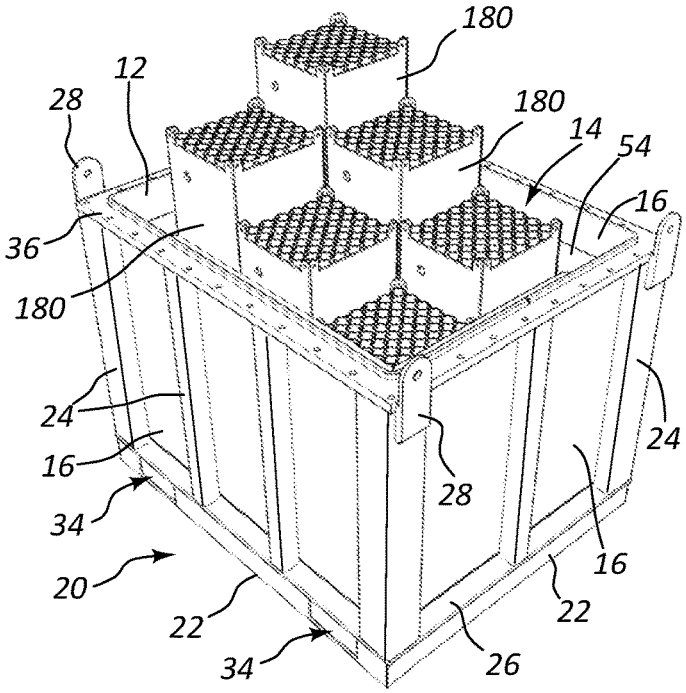
FIG. 91 is a perspective view of the loading basket shown in FIG. 86 filled with spent bare Magnox fuel being lowered into the Grade A modular container.
Figure 92:
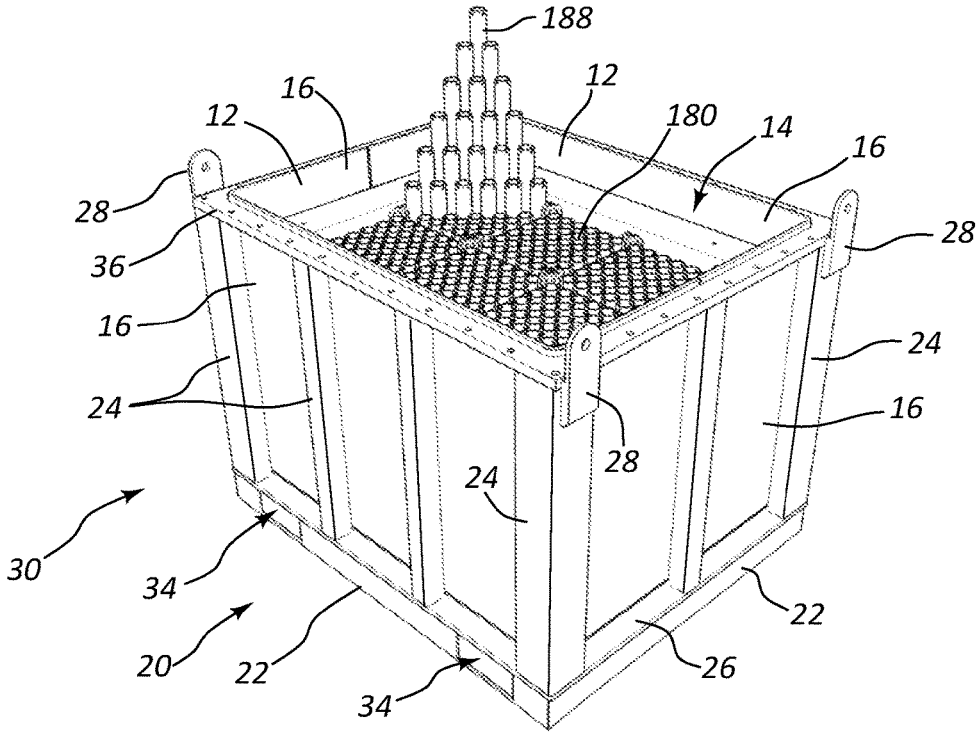
FIG. 92 is a perspective view of the loading basket shown in FIG. 86 positioned in the Grade A modular container and being successively filled with spent bare Magnox fuel.

The spent bare Magnox fuel can be loaded into the Grade A modular container variant 70 using any suitable method. In one embodiment, the spent bare Magnox fuel is loaded into the loading basket 180, which is then loaded into the Grade A modular container variant 70 as shown in FIG. 91. In another embodiment, the loading basket 180 is first loaded into the Grade A modular container variant 70 and then the spent bare Magnox fuel is loaded into the loading basket 180 as shown in FIG. 92.

Canned Magnox Fuel and Other Canned High Level Waste

Canned spent Magnox fuel 200 and other forms of canned HLW can be put in the Grade A modular container variant 70. Canned Magnox fuel 200 is prepared by removing the fuel rods from the casing and enclosing the fuel rods in an overpack can. Other forms of canned waste include vitrified HLW such as non-fuel bearing components, fission product, and actinide waste.

Before describing the canned Magnox fuel 200 in greater detail, it should be appreciated that the above descriptions relating to AGR waste and bare Magnox fuel apply to this section unless noted otherwise. The Grade A modular container variant 70 can be configured to hold the canned spent Magnox fuel 200, although other grades of the modular container 10 can also be used if the activity is low enough.

Figure 93:
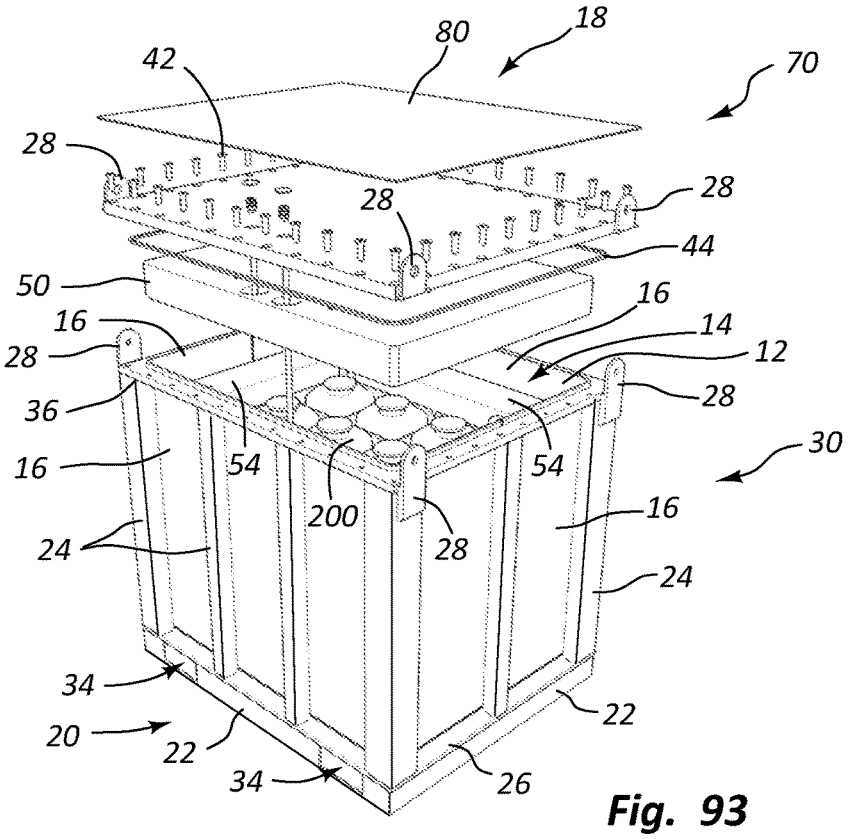
FIG. 93 is a perspective view of the Grade A modular container shown in FIG. 11 with the lid raised and the cavity including shielding inserts and spent canned Magnox fuel.

FIG. 93 shows one embodiment of the Grade A modular container variant 70 filled with spent canned Magnox fuel 200. The Grade A modular container variant 70 can be configured to hold any amount of canned Magnox fuel 200. The Grade A modular container variant 70 can include any amount of suitable shielding. In one embodiment, the Grade A modular container variant 70 includes 9-12 inch (228 mm to 305 mm) thick shielding inserts 50, 52, 54, 56.

Figure 94:
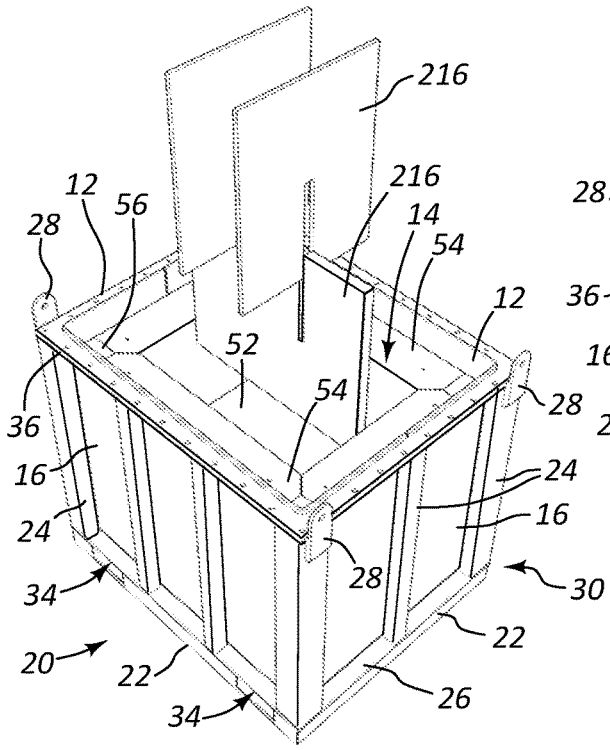
FIGS. 94-95 are perspective views of the Grade A modular container shown in FIG. 93 with dividers positioned in the cavity.
Figure 95:
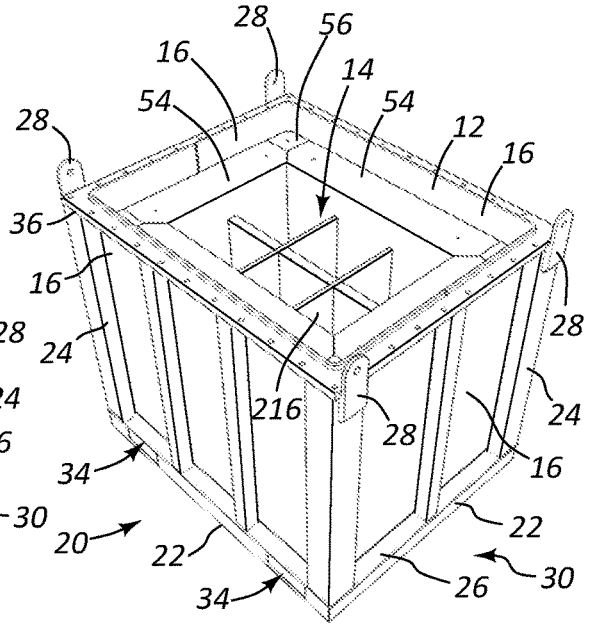
Figure 96:
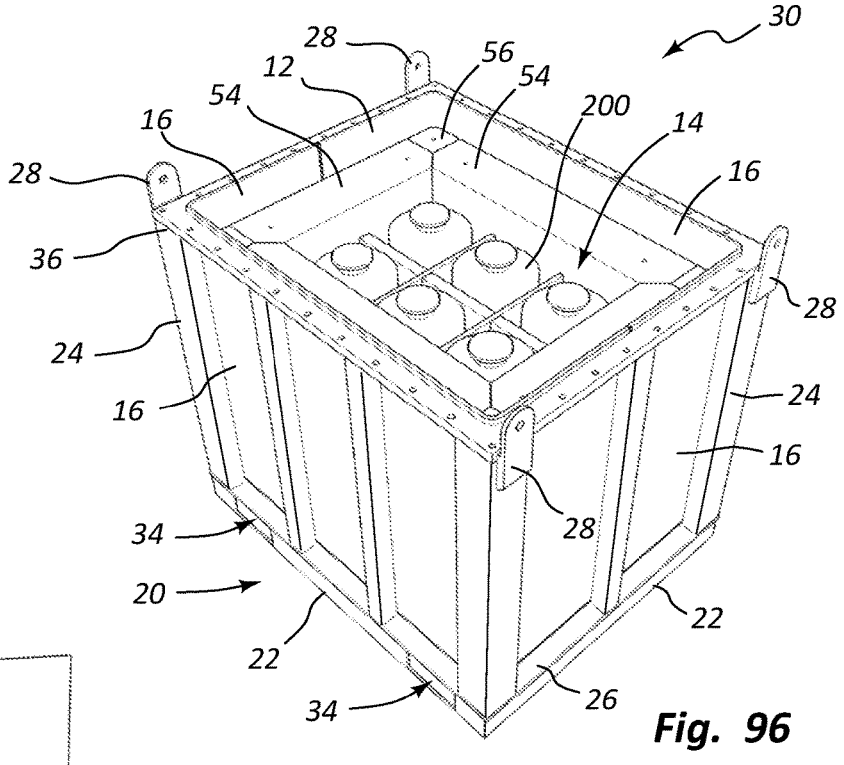
FIG. 96 is a perspective view of the main body of the Grade A modular container shown in FIG. 93 filled with spent canned Magnox fuel.

The canned Magnox fuel 200 can be positioned in the modular container 70 in a variety of different ways. In one embodiment, intersecting dividers 216 (alternatively referred to as divider plates) are positioned directly in the cavity 14 as shown in FIGS. 94-95. The canned Magnox fuel 200 is placed in the individual cavities formed by the dividers 216 as shown in FIG. 96. In this embodiment, a removable loading basket is not used.

Figure 97:
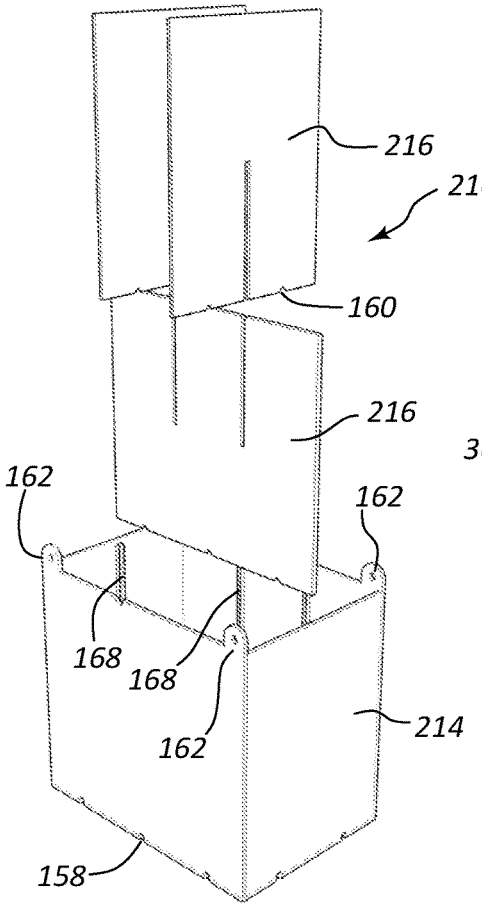
FIG. 97 is an exploded, perspective view of one embodiment of a loading basket that can be used with the Grade A modular container shown in FIG. 93.

In another embodiment, a removable loading basket 210 is used to hold the canned Magnox fuel 200 in the Grade A modular container 70. The loading basket 210 includes a box 214 and intersecting dividers 216 as shown in FIG. 97. The box 214 and dividers 216 can be configured similarly to the boxes described previously (e.g., with channels 168, made of same materials, and the like).

Figure 98:
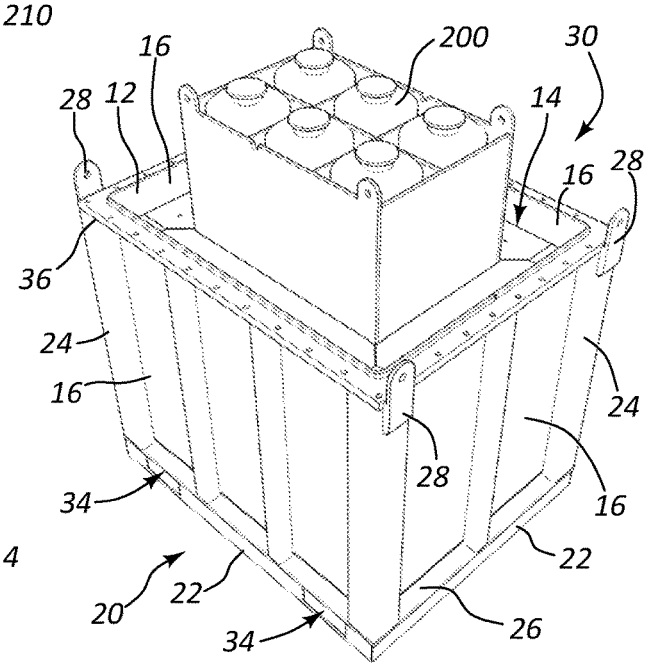
FIG. 98 is a perspective view of the loading basket shown in FIG. 97 filled with spent canned Magnox fuel being lowered into the Grade A modular container.
Figure 99:
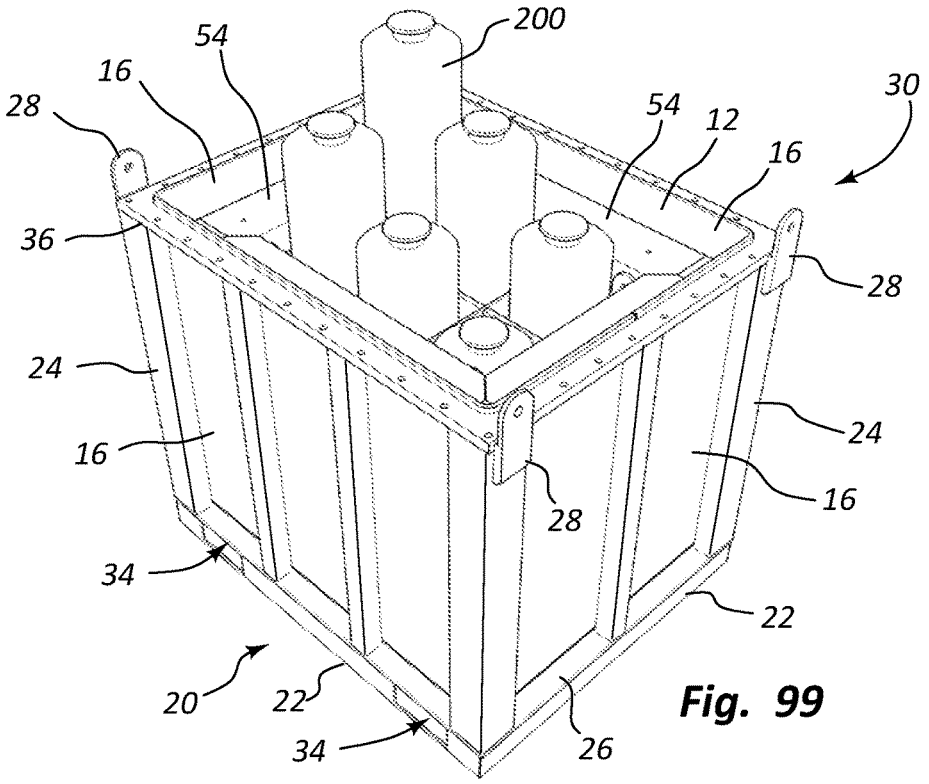
FIG. 99 is a perspective view of the loading basket shown in FIG. 97 positioned in the Grade A modular container and being successively filled with spent canned Magnox fuel.

The spent canned Magnox fuel 200 can be loaded into the Grade A modular container variant 70 using any suitable method. In one embodiment, the canned Magnox fuel 200 is loaded into the loading basket 210, which is then loaded into the Grade A modular container variant 70 as shown in FIG. 98. In another embodiment, the loading basket 210 is first loaded into the Grade A modular container variant 70 and then the canned Magnox fuel 200 is loaded into the loading basket 210 as shown in FIG. 99.

CANDU Fuel

Figure 104:
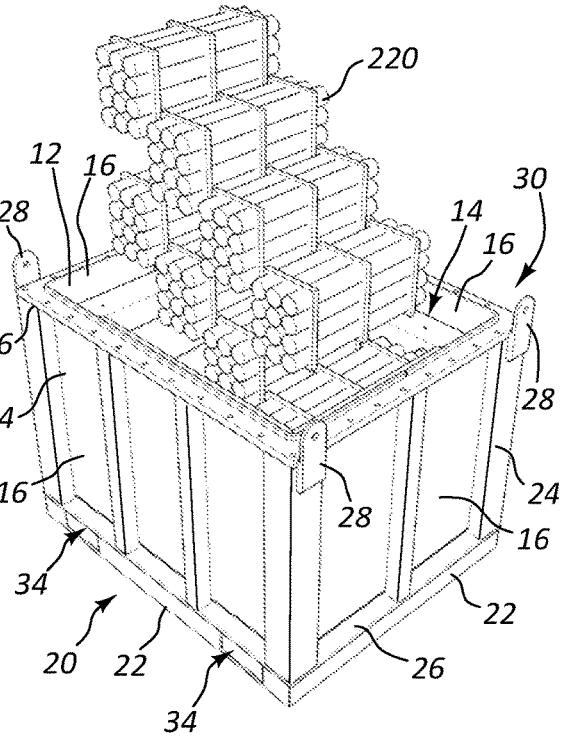
FIG. 104 is a perspective view of the loading basket shown in FIG. 97 positioned in the Grade A modular container and being successively filled with spent CANDU fuel.

CANDU fuel is used in a CANDU (CANada Deuterium Uranium) reactor which is a Canadian invented pressurized, heavy water reactor. CANDU fuel 220 is in the form of bundles grouped together in magazines as shown in FIG. 104. Each magazine includes a 4×3 array of bundles. It should be appreciated that the above descriptions of handling and containerizing other types of spent fuel apply equally to the CANDU fuel 220.

Figure 100:
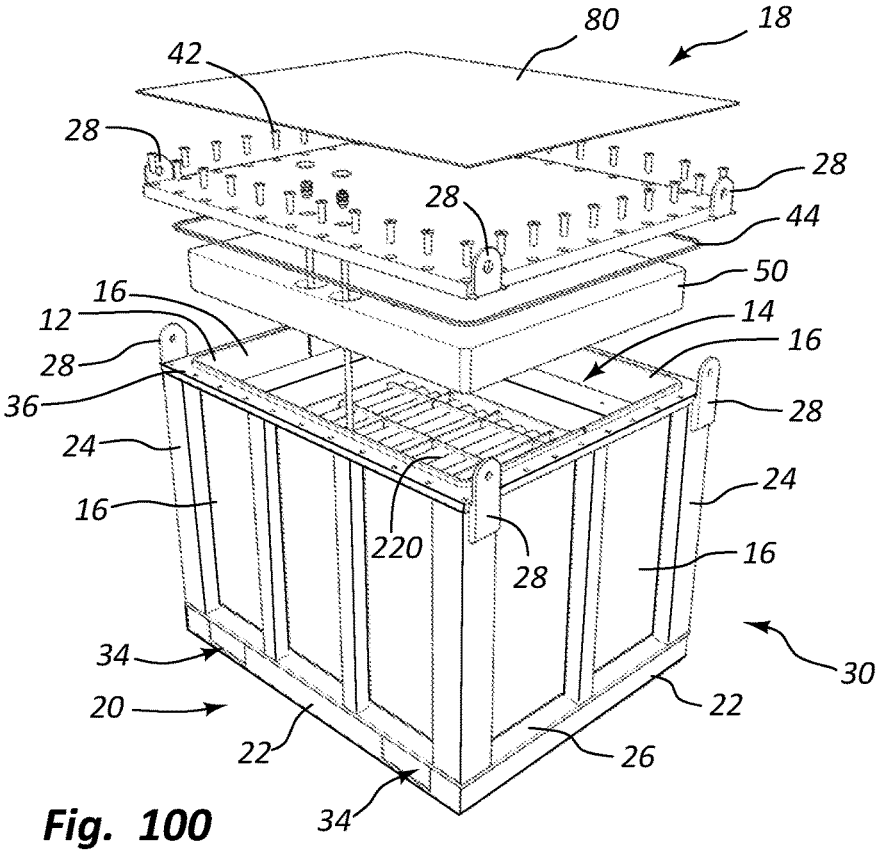
FIG. 100 is a perspective view of the Grade A modular container shown in FIG. 11 with the lid raised and the cavity including shielding inserts and spent CANDU fuel.
Figure 101:
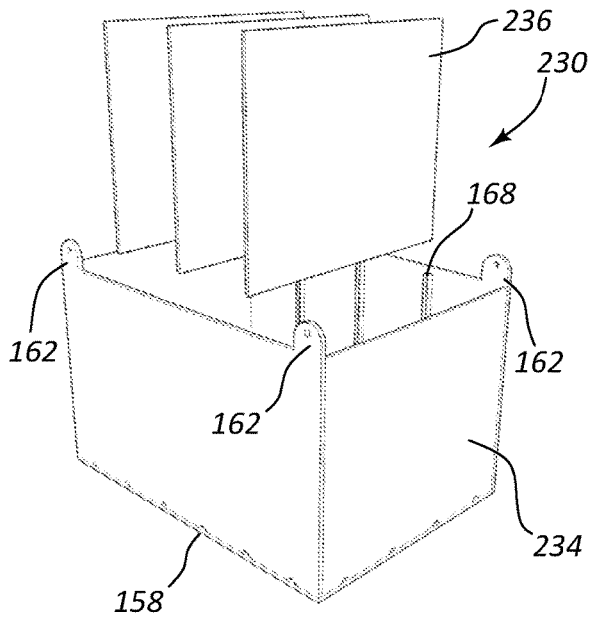
FIG. 101 is an exploded, perspective view of one embodiment of a loading basket that can be used to hold CANDU fuel in the Grade A modular container shown in FIG. 100.
Figure 102:
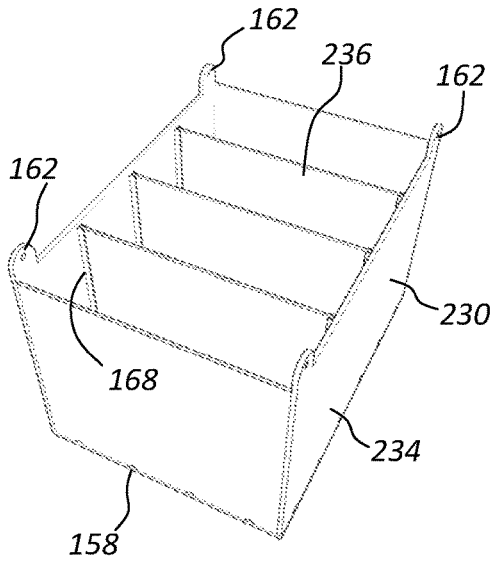
FIG. 102 is a perspective view of the loading basket shown in FIG. 101 with the dividers positioned inside.

FIG. 100 shows one embodiment of the Grade A modular container variant 70 filled with a loading basket 230 full of spent CANDU fuel 220. The Grade A modular container variant 70 can be configured to hold any amount spent CANDU fuel 220. For example, it can be configured to hold approximately 5 to 10 magazines of CANDU fuel 220, which each hold 12 CANDU fuel bundles.

The Grade A modular container variant 70 can include any amount of suitable shielding. In one embodiment, the Grade A modular container variant 70 includes 9-12 inch (228 mm to 305 mm) thick shielding inserts 50, 52, 54, 56.

The loading basket 230 is removable from the Grade A modular container variant 70. The loading basket 230 includes a box 234 and dividers 236 (alternatively referred to as divider plates). The dividers 236 are positioned parallel to each other in the box 234 and do not intersect. The dividers 236 fit in the channels 168 on the interior walls of the box 234.

Figure 103:
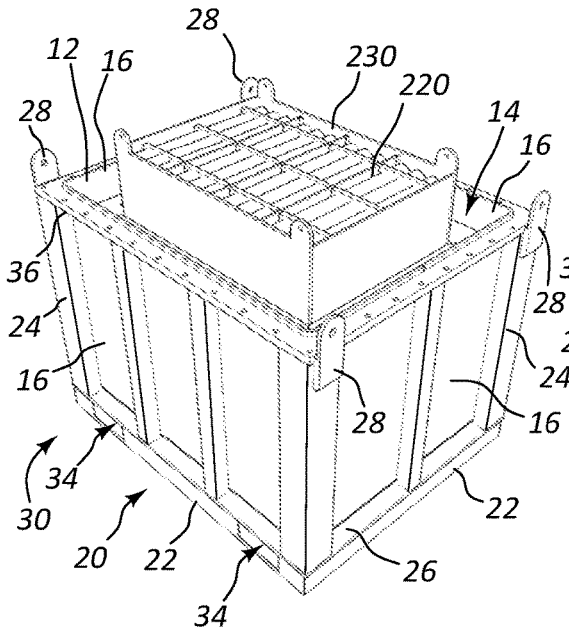
FIG. 103 is a perspective view of the loading basket shown in FIG. 102 filled with spent CANDU fuel being lowered into the Grade A modular container.

The spent CANDU fuel 220 can be loaded into the Grade A modular container variant 70 using any suitable method. In one embodiment, the spent CANDU fuel 220 is loaded into the loading basket 230, which is then loaded into the Grade A modular container variant 70 as shown in FIG. 103. In another embodiment, the loading basket 230 is first loaded into the Grade A modular container variant 70 and then the spent CANDU fuel 220 is loaded into the loading basket 230 as shown in FIG. 104.

Research Reactor Fuel

The modular container 10 can also be used to package spent research reactor fuel. Examples of suitable research reactor fuel include MTR fuel and TRIGA fuel. MTR fuel includes metallic uranium fuel plates clad in aluminum. TRIGA fuel is similar in that it is metallic uranium fuel plates clad in aluminum or stainless steel. It should be appreciated that the above descriptions of handling and containerizing other types of spent fuel apply equally to research reactor fuel unless noted otherwise.

Figure 105:
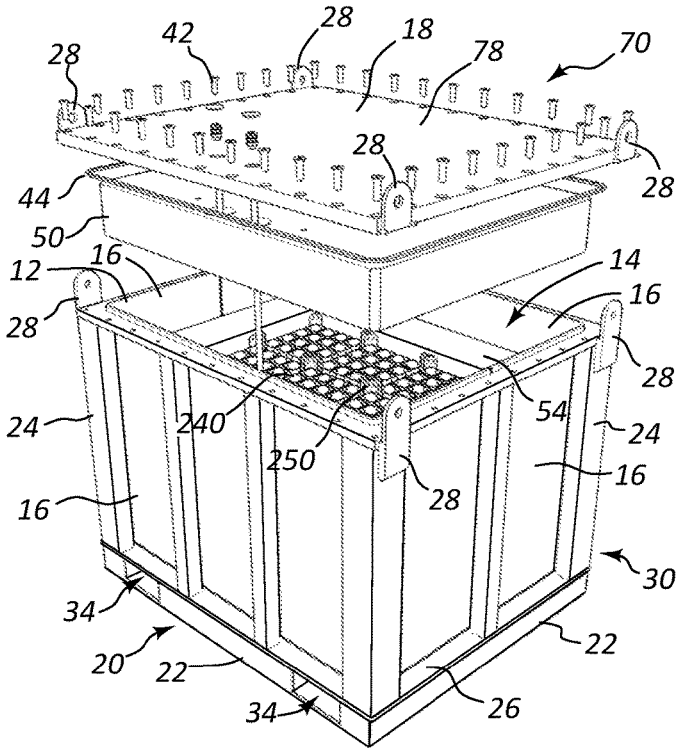
FIG. 105 is a perspective view of the Grade A modular container shown in FIG. 11 with the lid raised and the cavity including shielding inserts and loading baskets filled with spent MTR research fuel.

FIG. 105 shows one embodiment of the Grade A modular container variant 70 filled with multiple loading baskets 250 full of spent MTR fuel 240. The Grade A modular container variant 70 can be configured to hold any amount spent MTR fuel 240. For example, it can be configured to hold 2-10 loading baskets 250 full of spent MTR fuel 240.

Figure 112:
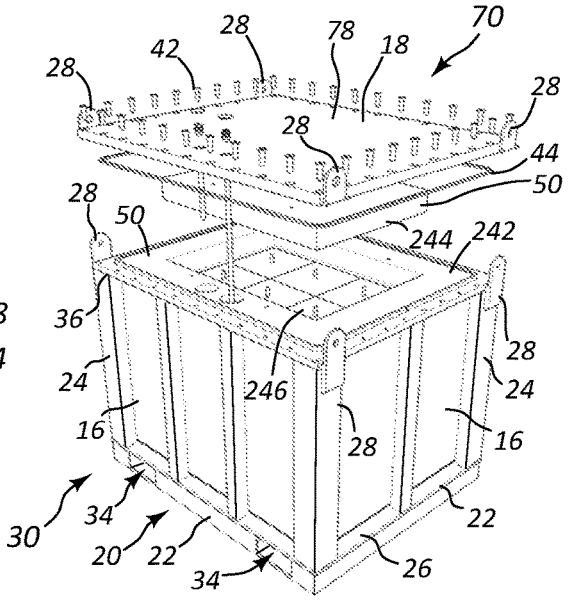
FIG. 112 is a perspective view of the Grade A modular container filled with loading baskets full of MTR fuel just before the lid is closed.
Figure 113:
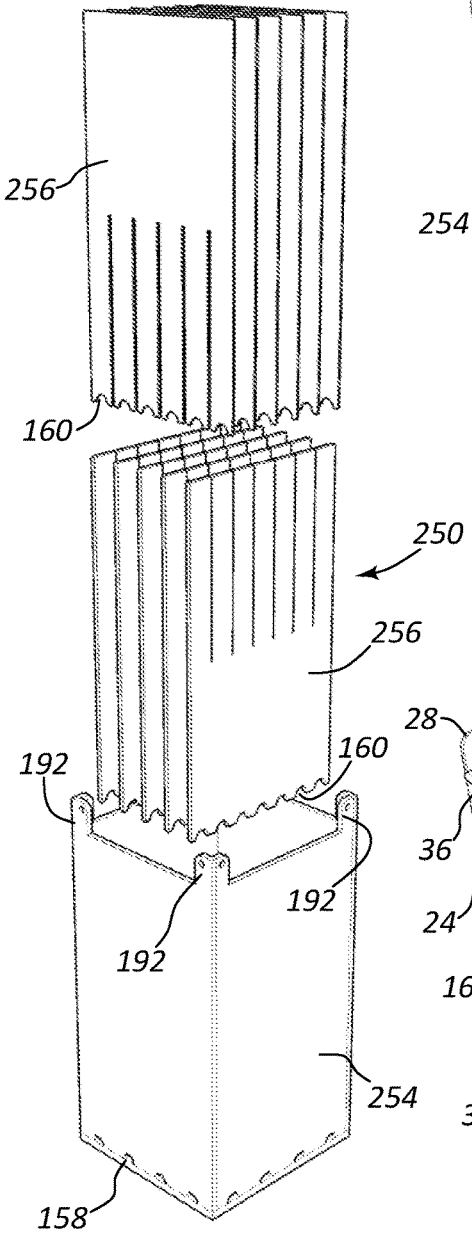
FIG. 113 is an exploded, perspective view of one embodiment of a loading basket that can be used to hold spent TRIGA fuel in the Grade A modular container shown in FIG. 105.
Figure 114:
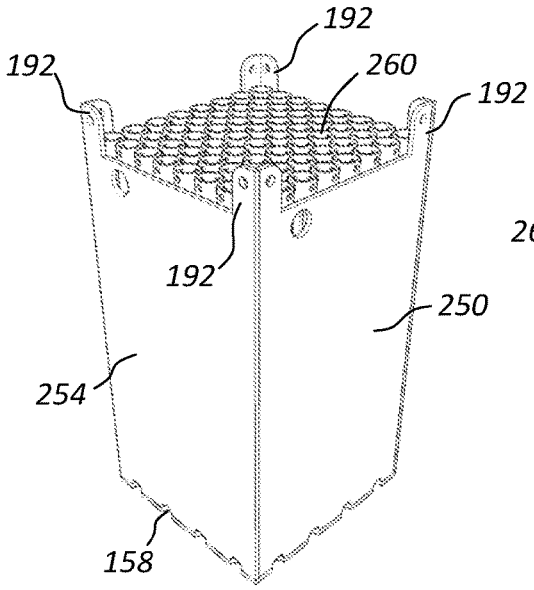
FIG. 114 is a perspective view of the assembled loading basket shown in FIG. 106 filled with tubes configured to hold spent TRIGA fuel.
Figure 115:
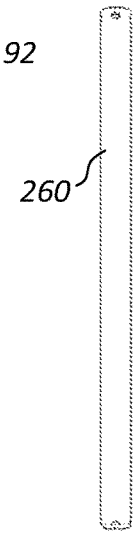
FIG. 115 is a perspective view of a tube that is configured to hold spent TRIGA fuel in the loading basket shown in FIG. 114.
Figure 116:
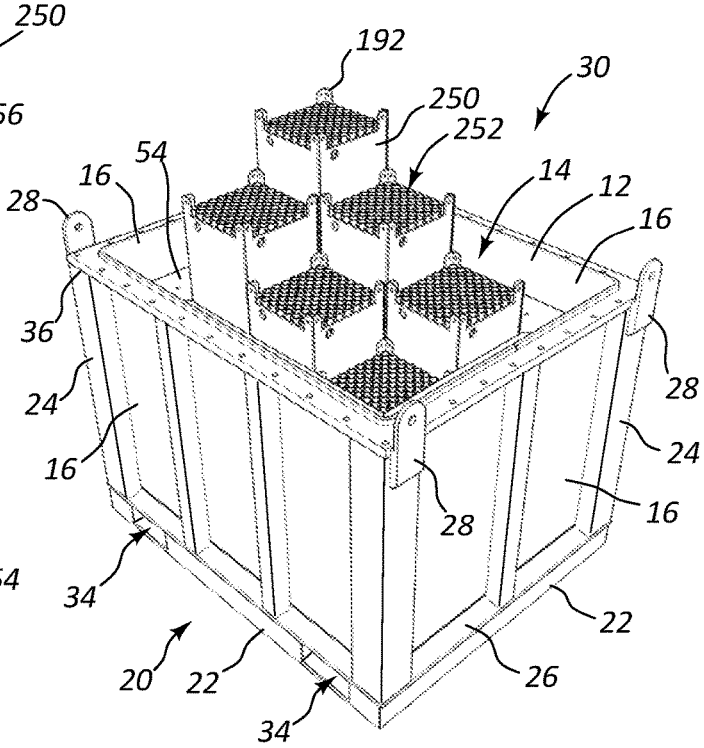
FIG. 116 is a perspective view of multiple loading baskets shown in FIG. 114 filled with spent TRIGA fuel being lowered into the Grade A modular container.
Figure 117:
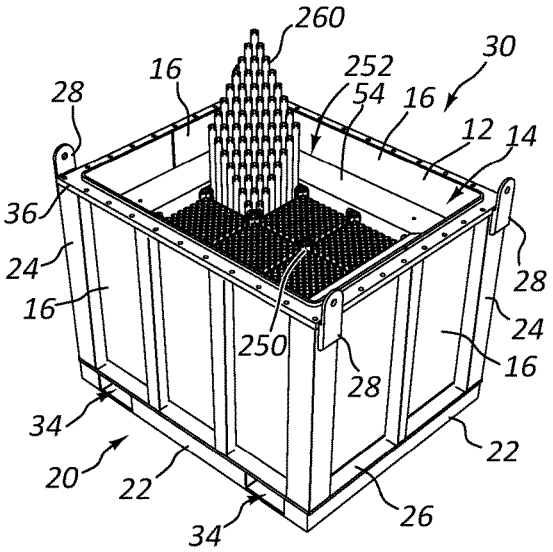
FIG. 117 is a perspective view of multiple loading baskets shown in FIG. 114 positioned in the Grade A modular container and being successively filled with spent TRIGA fuel.
Figure 118:
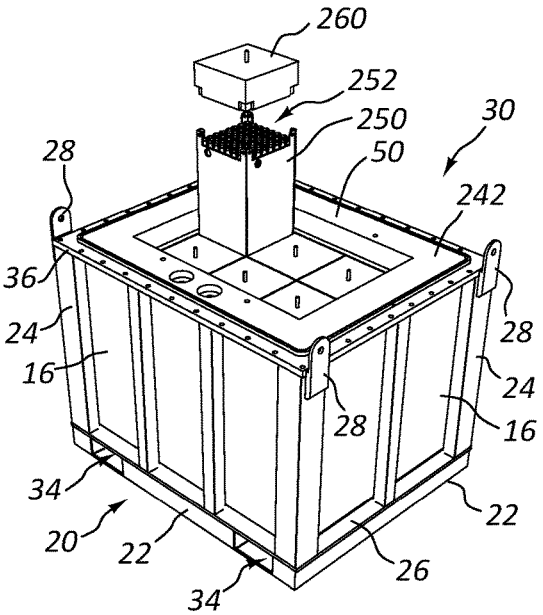
FIG. 118 is a perspective view of multiple loading baskets shown in FIG. 114 positioned in the Grade A modular container and individually covered by a shielding insert plug.

The Grade A modular container variant 70 can include any amount of suitable shielding. In one embodiment, the Grade A modular container variant 70 includes 9-12 inch (228 mm to 305 mm) thick shielding inserts 50, 52, 54, 56. The lid shielding insert 50 can be a monolithic slab as shown in FIG. 105 or it can be segmented into different sections as shown in FIG. 112. The lid shielding insert 50 in FIG. 112 is divided into two sections with one section 242 extending around the circumference of the cavity 14 adjacent to the walls 16 and another section 244 covers the spent MTR fuel 240.

Figure 106:
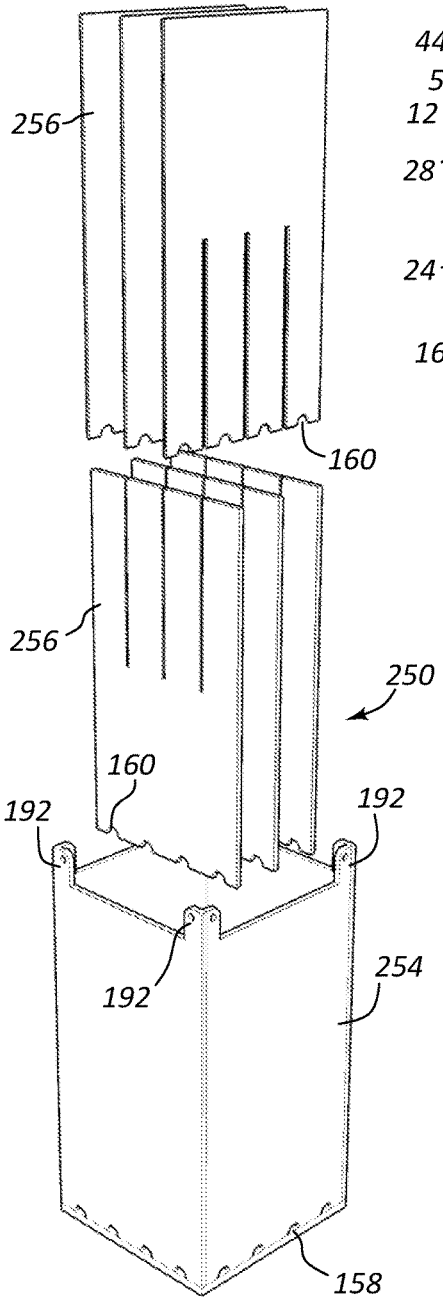
FIG. 106 is an exploded, perspective view of one embodiment of a loading basket that can be used to hold spent MTR fuel in the Grade A modular container shown in FIG. 105.

The loading basket 250 is removable from the Grade A modular container variant 70. The loading basket 250 includes a box 254 and dividers 256 (alternatively referred to as divider plates) as shown in FIG. 106. The dividers 256 intersect each other in the box 254 to form a number of cavities or compartments.

Figure 107:
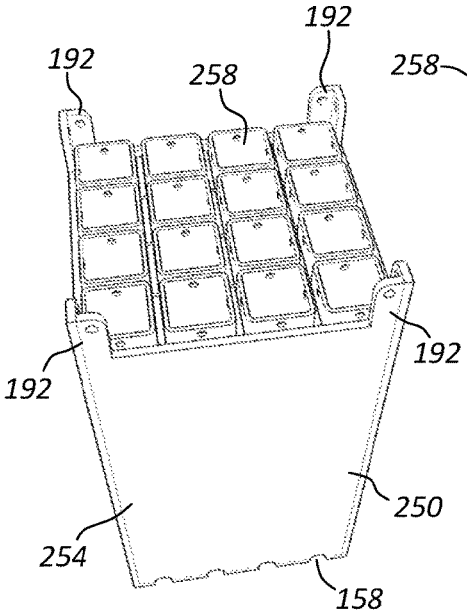
FIG. 107 is a perspective view of the assembled loading basket shown in FIG. 106 filled with tubes configured to hold spent MTR fuel.
Figure 108:
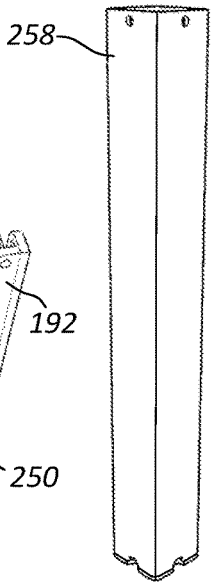
FIG. 108 is a perspective view of a tube that is configured to hold spent MTR fuel in the loading basket shown in FIG. 107.

The loading basket 250 includes tubes 258 that fit inside the cavities formed by the intersecting dividers 256 as shown in FIG. 107. The tubes 258 are configured to hold the spent MTR fuel 240. The MTR fuel 240 can be loaded into the tubes 258 before or after the tubes are put in the loading basket 250.

Figure 109:
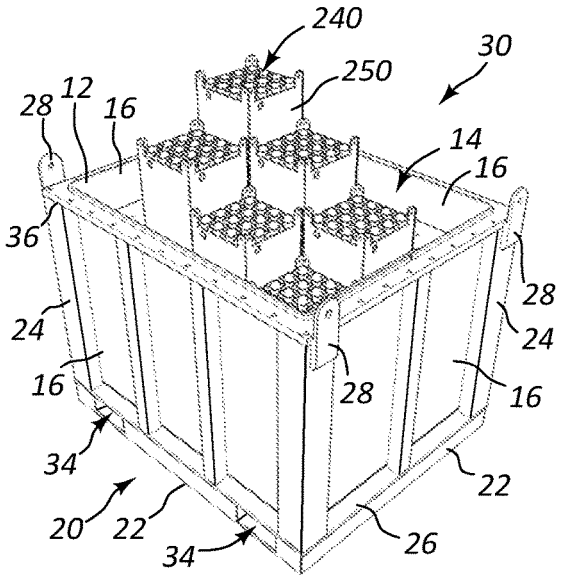
FIG. 109 is a perspective view of multiple loading baskets shown in FIG. 107 filled with spent MTR fuel being lowered into the Grade A modular container.
Figure 110:
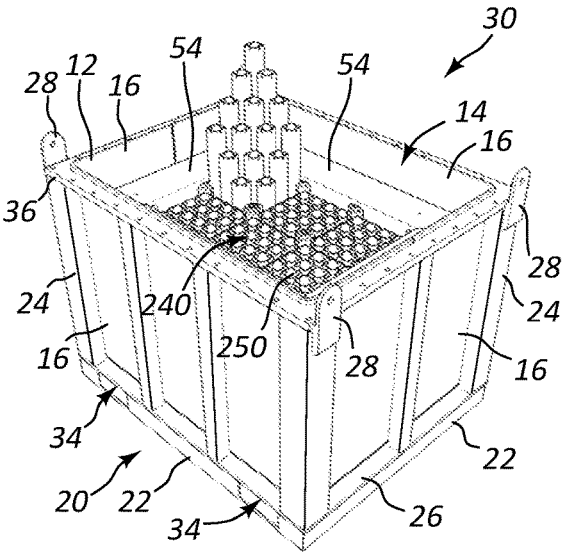
FIG. 110 is a perspective view of multiple loading baskets shown in FIG. 107 positioned in the Grade A modular container and being successively filled with spent MTR fuel.

The spent MTR fuel 240 can be loaded into the Grade A modular container variant 70 using any suitable method. In one embodiment, the spent MTR fuel 240 is loaded into the loading basket 250, which is then loaded into the Grade A modular container variant 70 as shown in FIG. 109. In another embodiment, the loading basket 250 is first loaded into the Grade A modular container variant 70 and then the spent MTR fuel 240 is loaded into the loading basket 250 as shown in FIG. 110.

Figure 111:
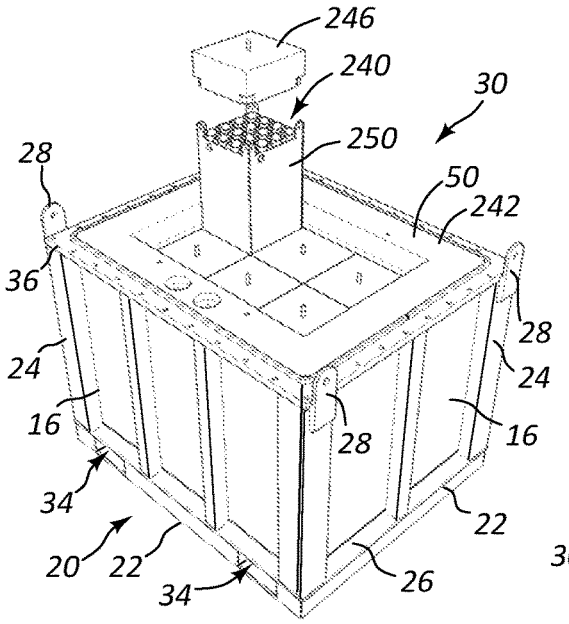
FIG. 111 is a perspective view of multiple loading baskets shown in FIG. 107 positioned in the Grade A modular container and individually covered by a shielding insert plug.

In one embodiment, a separate shielding insert 246 (alternatively referred to as a shield plug) is provided to cap or cover each loading basket 250 as shown in FIG. 111. The use of separate shielding inserts 246 helps reduce exposure to the MTR fuel 240 as it is loaded and/or unloaded from the cavity of the Grade A modular container variant 70. Once the Grade A modular container variant 70 has been loaded, it can be closed in the manner shown in FIG. 112.

FIGS. 113-118 show one embodiment for packaging TRIGA fuel 252. This embodiment is similar to the embodiment shown in FIGS. 105-112 for MTR fuel 240 except that the TRIGA fuel 252 uses smaller tubes 260, which means the loading basket 250 can be configured to hold more of the tubes 260.

Storage

The modular container 10 includes numerous features that make it easy to move and efficiently stack. For example, the modular container 10 includes lifting members 28 that can be remotely engaged by a crane. The modular container 10 also includes openings 34 (alternatively referred to as forklift pockets) that capture the forks of a forklift to reduce the likelihood of the modular container 10 tipping over when it is moved. The lifting members 28 are positioned to facilitate stacking alignment and capture. The fasteners 42 for the structural lid 18 are flush with the structural lid 18 to reduce interference and/or damage that may occur during stacking. The modular container 10 also has a self-supporting configuration.

Figure 119:
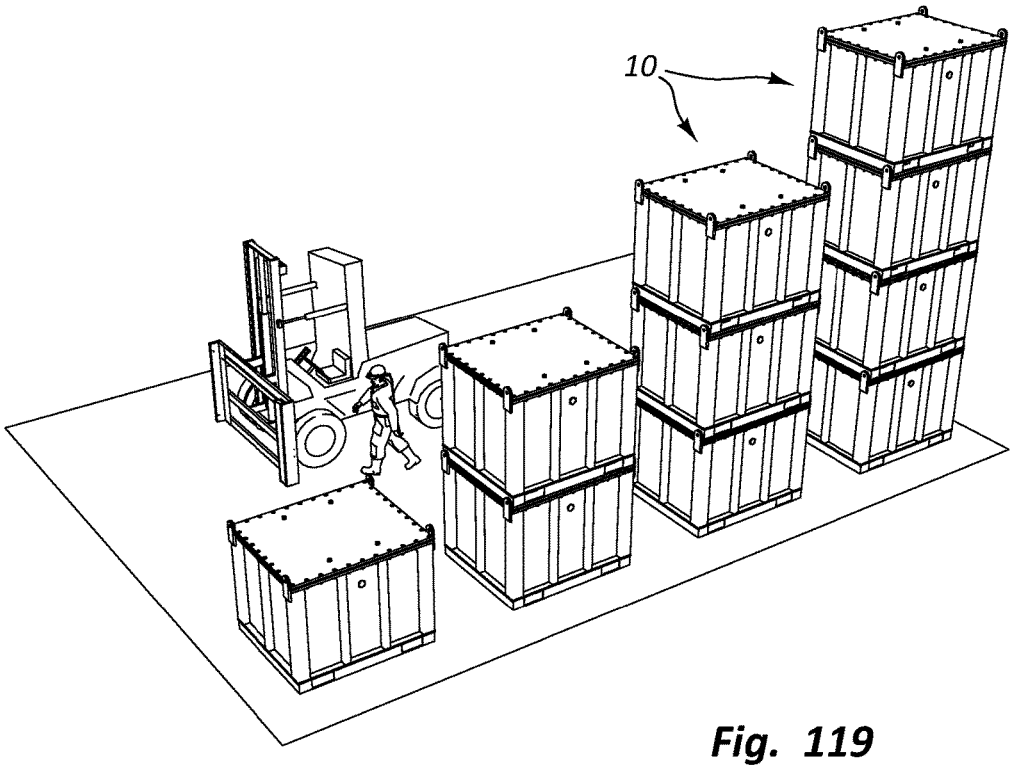
FIG. 119 is a perspective view showing the modular container stacked one high, two high, three high, and four high.

Referring to FIG. 119, the modular container 10 is configured to be stackable. In one embodiment, the modular container 10 is sufficiently strong to allow at least two modular containers 10 to be stacked on top of each other or, desirably, at least three modular containers 10 to be stacked on top of each other or, suitably, at least four modular containers 10 to be stacked on top of each other. The modular container 10 has a comparatively low center of gravity and a large aspect ratio that enhance stability for lateral loadings such as seismic loads. The modular container 10 is also designed to mitigate radiological consequences of an accidental drop or tip over.

The modular container 10 can be used for interim storage of radioactive waste at the same site where it is generated or at a distant site. The modular container 10 can be stored outdoors on a concrete pad or indoors in a suitable facility.

Figure 120:
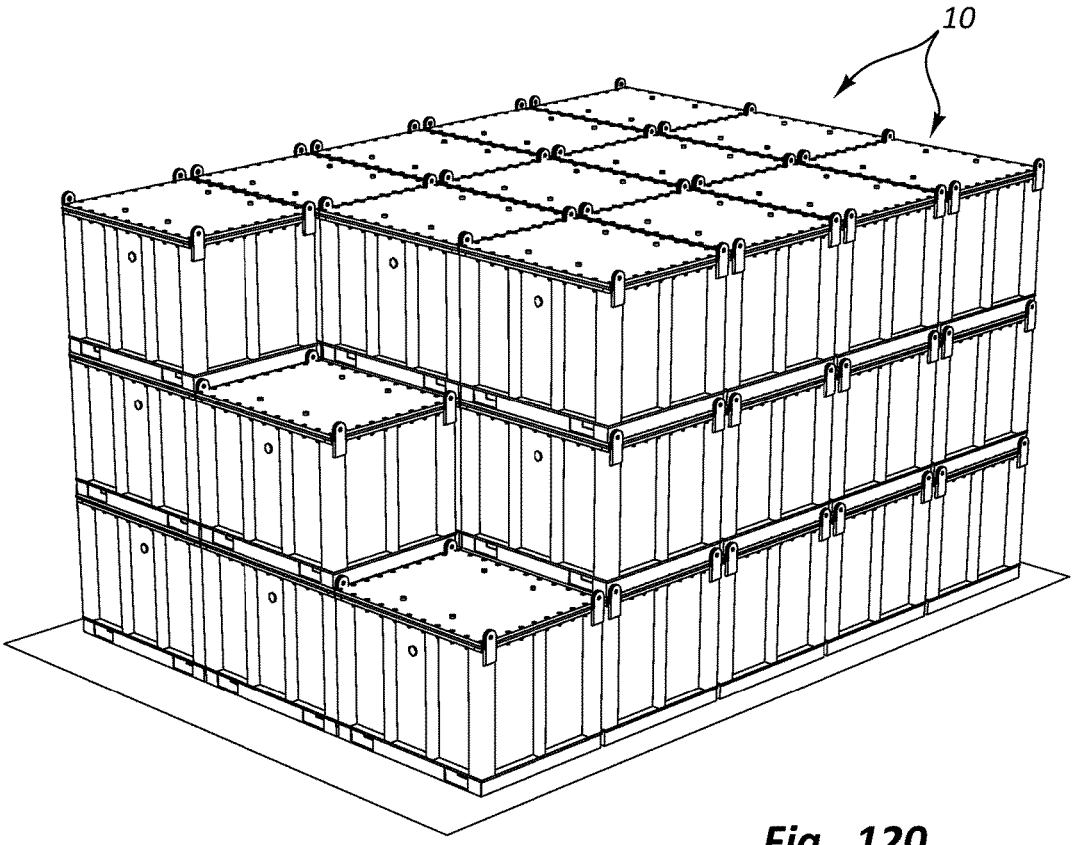
FIG. 120 is a perspective view showing the modular container stacked in interim storage or final disposal.

Referring to FIG. 120, the cuboidal embodiment of the modular container 10 substantially reduces the costs for interim storage compared to conventional cylindrical containers. The cuboidal container provides greater volume efficiency which reduces the total number of containers required by 23% or more for the same waste inventory volume. It also increases the stacking/packing density by up to 27% because the interstitial spaces between the modular containers 10 can be fully utilized. The increased stacking/packing density allows the pad/building footprint for the storage array to be reduced by a factor of two or more. Also, closely packing the modular containers 10 increases self-shielding, which reduces the radiation exposure. The following table shows the interim storage criteria that the modular container 10 is compliant with.

TABLE 8

Typical Interim Storage Criteria for the Modular Container

| Design Condition | Interim Storage Criteria Description | Interim Storage Criteria |
|---|---|---|
| Design Life | Maintain structural, confinement and shielding integrity without degradation | 25 years minimum |
| Environmental Conditions | Normal ambient temperature variations | 0° F. to 100° F. |
| | Off-normal ambient temperature variations | −40° F. to 125° F. |
| | Solar insolation per 10CFR71.71(c)(1) | Averaged over 24-hour day |
| Gas Generation | Maximum internal pressure for container with filtered vent | Atmospheric |
| | Maximum internal pressure for unvented container (Grade B, Grade A) | 70 to 175 kPa (10 to 25 psig) |
| Dead Loads | Maximum container weight | 35 tonnes (38.6 tons) |
| Live Loads | Stacking to maximum of three containers high; weight of two containers above | 2X maximum container weight + 15% |
| Wind Loads | Pressure due to off-normal design basis wind speed (ASCE 7) | 150 mph |
| Handling Loads | Not exceed minimum yield strength of container structural material | 3X maximum container weight |
| | Not exceed ultimate tensile strength of container structural material | 5X maximum container weight |
| Drop Loads | Single accidental drop from height of 15 feet (4.6 meters) onto flat 12 inch (300 mm) thick reinforced concrete slab on compacted fill | Free drop in the most damaging orientation |
| Fire Accident | Hydrocarbon fuel/air fire with average emissivity of 0.9 | 5 minutes @ 800° C. (1475° F.) |
| Flooding | External hydrostatic pressure due to head of water | 50 feet (15 meters) |
| | Kinematic stability for flood water flow (NRC Reg. Guide 1.59) | 21 feet/sec (6.4 m/s) |
| Tornado | Tornado wind kinematic stability | Per NRC Reg. Guide 1.76 |
| | Tornado missile impact effects | Per NUREG-0800 |
| Earthquake | Container stack to remain kinematically stable when subjected to DBE horizontal ground motion accelerations in both orthogonal directions (NRC Reg. Guide 1.60) | 0.25 g horizontal<br>Vertical 2/3 of horizontal |
| External Dose Rate | External surfaces at time of loading | 2.0 MSv/hr (200 mrem/hr) |
| | 1 meter from external surfaces post accident conditions | 10 mSv/hr (1 Rem/hr) |
| Surface Contamination | Maximum removable contamination on container exterior surfaces | 4 Bq/cm$^2$ beta-gamma<br>0.4 Bq/cm$^2$ alpha averaged over 300 cm$^2$ |
| Heat Output | Maximum heat load per unit volume of waste | 2 kW/m$^3$ |
| Residual Liquids | Solid waste - maximum free liquid by volume | 1% |
| | Wet waste - maximum free water by volume | 5% |
| Confinement | Leak tightness (unvented) (Grade B, Grade A) | $10^{-4}$ cm$^3$/sec to $10^{-6}$ cm$^3$/sec |

Transport

The modular container 10 can be used to transport radioactive waste in a variety of ways depending on the characteristics of the waste. The modular container 10 allows the determination of the transport packaging to be made at the time of shipment rather than at the time of loading. This simplifies front-end loading and closure operations for placement in interim storage. Future regulatory changes won't impact the already fabricated and loaded containers because they can packaged for transport according to the then applicable regulations.

Figure 121:
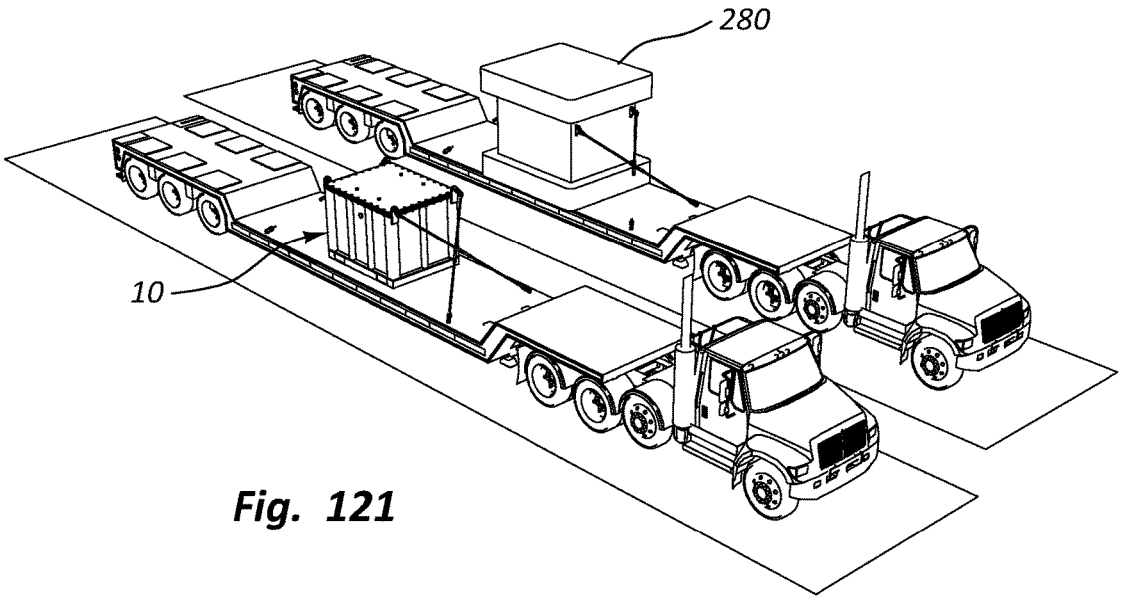
FIG. 121 is a perspective view showing various ways the modular container can be transported.

The modular container 10 can be used without modification to transport radioactive waste that meets Type A or IP-2 requirements as shown in FIG. 121. The modular container 10 can be transported immediately after it is loaded or following sufficient decay in interim storage to be within applicable limits. The modular container 10 can include ports for leak testing the enclosure prior to transport. The configuration of the structural lid 18 allows the one or more sealing members 44 to be replaced prior to transport if needed.

In general, Type A packaging is used to transport radioactive material with higher concentrations of radioactivity than those shipped in industrial packaging. Type A packaging is typically constructed of steel, wood, or fiberboard, and has an inner containment vessel made of glass, plastic, or metal surrounded with packing material made of polyethylene, rubber, or vermiculite. The modular container 10 in all of its grades satisfies Type A packaging requirements, which are out lined in 49 CFR 173.412. As a result, it also meets the requirements of 49 CFR 173.411 for an IP-2 packaging.

Examples of material typically shipped in Type A Packages include nuclear medicines (radiopharmaceuticals), radioactive waste, and radioactive sources used in industrial applications. Type A packaging and its radioactive contents must meet standard testing requirements designed to ensure that the package retains its containment integrity and shielding under normal transport conditions.

Type A packaging should withstand moderate amounts of heat, cold, reduced air pressure, vibration, impact, water spray, drop, penetration, and stacking tests. Type A packagings are not, however, designed to withstand the forces of an accident such as those defined for a more robust Type B transport packaging. The consequences of a release of the material in one of the Type A packages would not be significant since the quantity of material in this package is limited. Type A packaging is only used to transport amounts of radioactive material that are not life threatening or life-endangering.

In general, Type B packaging is used to transport material with the highest levels of radioactivity. Examples of material transported in Type B packaging include SNF, HLW, and high concentrations of other radioactive material such as cesium and cobalt. These package designs must withstand all Type A tests and a series of tests that simulate severe or worst-case accident conditions. Accident conditions are simulated by performance testing and engineering analysis. Life-endangering amounts of radioactive material are required to be transported in Type B Packages. Requirements for Type B packaging can be found in 49 CFR 173.411, 49 CFR 73.413, and 10 CFR 71 (which also comply with IAEA T-SR-1).

The modular container 10 can be placed in a purpose built transport overpack 280 that is configured to accommodate one modular shielding container and to comply with Type B packaging requirements for waste that requires it. FIG. 121 shows the modular container 10 positioned in the transport overpack 280. This configuration has a number of advantages. One is that the demanding 10 CFR 71 and T-SR-1 requirements are satisfied primarily by the transport overpack 280 thereby separating the transport licensing from the design, production and deployment of the modular container 10. This makes it possible to change the design of the modular container 10 without requiring amendments to the transport license certificate of compliance. Also, container fabrication deviations can be dispositioned without requiring amendments to the transport license. The modular container 10 in its various configurations can be included in the Type B overpack license as contents specifications. This facilitates transport license renewal every five years.

Figure 123:
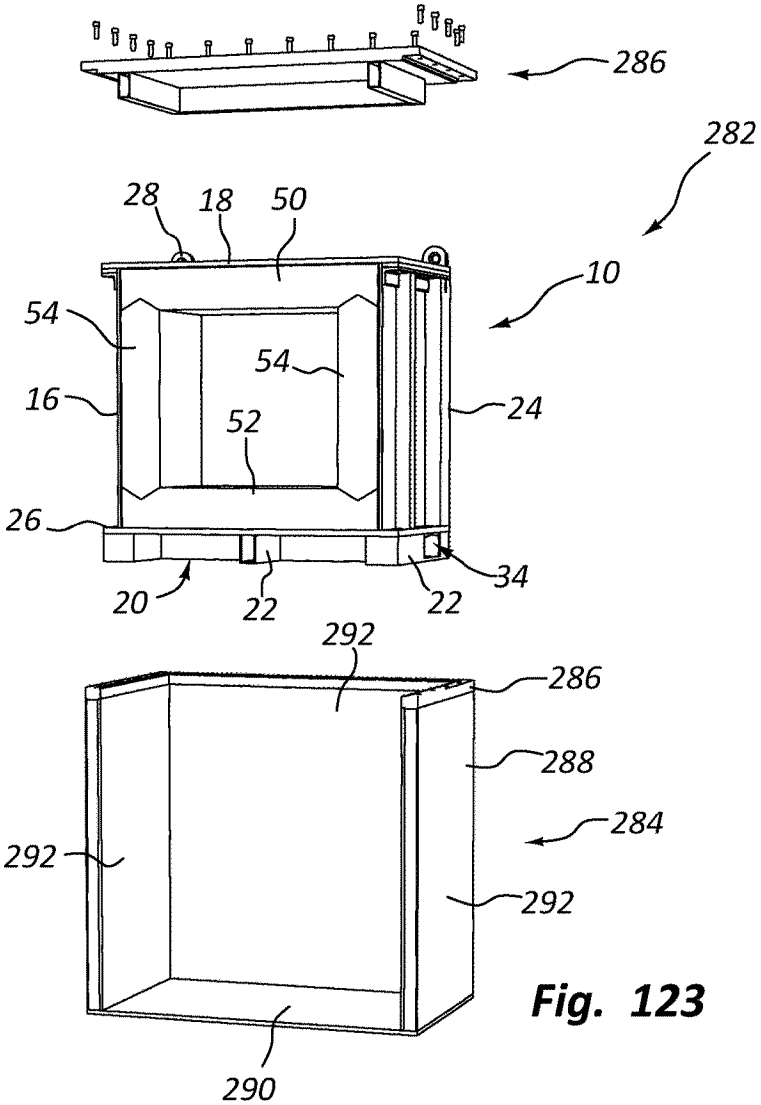
FIG. 123 is a cross-sectional, perspective view of the transport container and modular container shown in FIG. 122.
Figure 122:
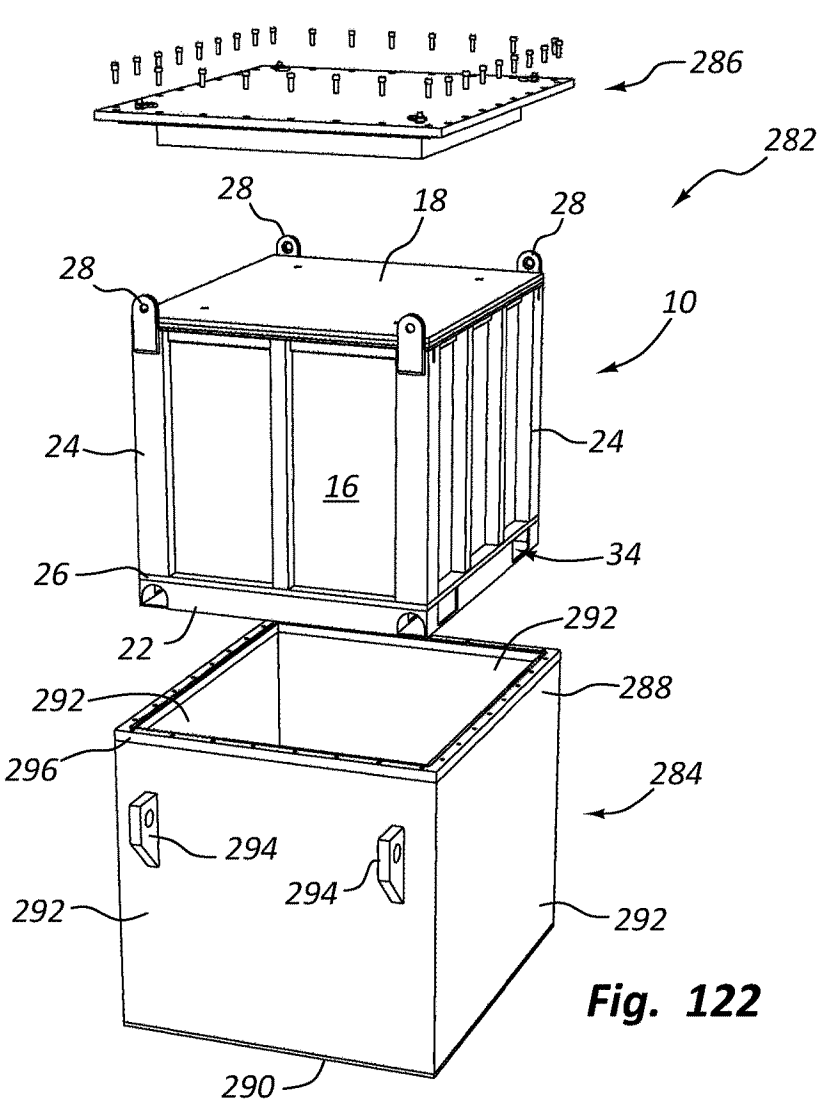
FIG. 122 is an exploded perspective view of a transport container configured to hold the modular container.
Figure 124:
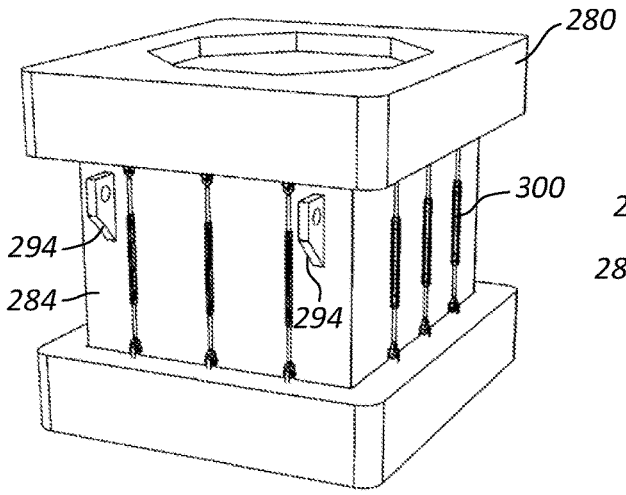
FIGS. 124-125 show top and bottom perspective views of one embodiment of a transport overpack that can be used to enclose the module container for transport.
Figure 125:
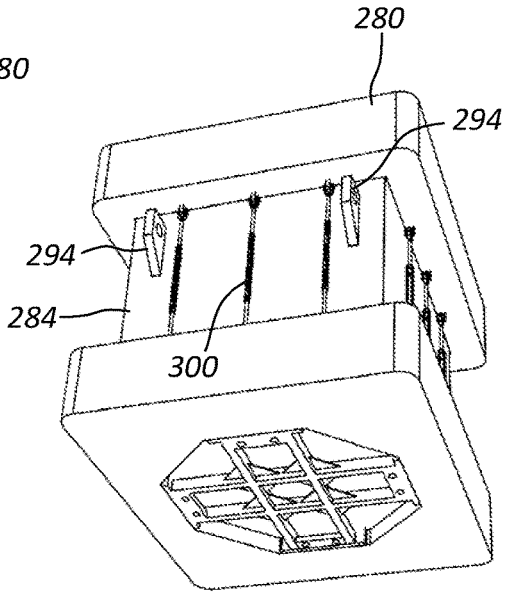
Figure 126:
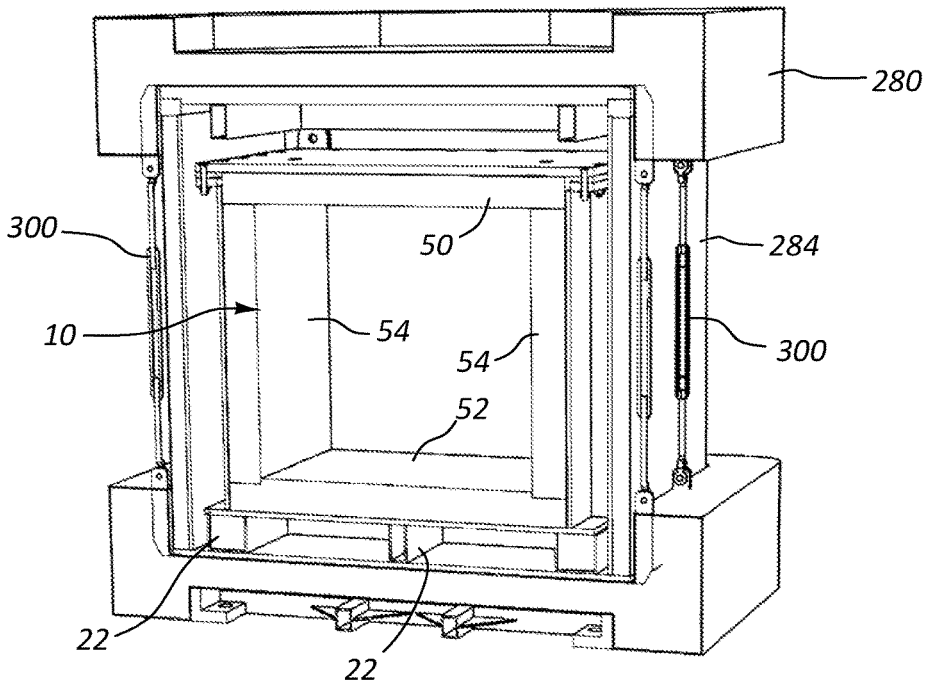
FIG. 126 shows a cross-sectional, perspective view of the transport overpack shown in FIGS. 124-125.

The transport overpack 280 includes a transport container 282 shown in FIGS. 122-123 and top and bottom impact limiters 298. The transport container 282 is configured to receive and enclose the sealed and closed modular container 10. The transport container 282 includes a main body 284 that holds that the modular container 10 and a lid 286 that closes the transport container 282. The main body 284 and the lid 286 form an enclosure envelope 288.

The main body 284 includes a base plate 290 and walls 292 that extend upward from the base plate 290. Lifting members 294 are coupled to the outside of the walls 292 to make it easy to handle and move the transport container 282. The lid 286 is coupled to a flange 296 that extends around the top edge of the main body 284 in a manner similar to how the structural lid 18 is coupled to the main body 30 (e.g., bolts and nuts, bolts in threaded holes, and so forth). Likewise, the lid 286 and the main body 284 can fit together and sealed in any of the ways disclosed in connection with the modular container 10.

The impact limiters 298 can be made of any of the same materials described above in connection with the impact limiters that can be added to the modular container 10. The impact limiters 298 are coupled together using heavy duty turnbuckles 300 that extend between the top and bottom impact limiters 298.

The transport overpack 280 can be configured to maintain containment function during transport. It does this by satisfying the applicable requirements, for example, a 10 m drop onto an unyielding surface as well as puncture, fire, and deep immersion requirements. The modular container 10 is designed to maintain shielding during transport.

The transport overpack 280 can be sealed and leak tested at the time of shipment. In one embodiment, the transport overpack provides leak tightness to $10^{-6}$ $cm^3$/sec via pressure drop test on interspace between the sealing members (e.g., O-rings made of butyl rubber) at a maximum normal operating pressure of approximately 50 psig.

The transport overpack 280 reduces waste packaging and transport costs. The transport overpack 280 can be reused and not every modular container 10 requires it. It is only necessary to maintain a small number of transport overpacks 280 at any given time. There is no need to incorporate costly Type B packaging on every modular container 10 because the entire waste stream may not be Type B or the modular container 10 may have decayed below Type B levels.

The decision to use the transport overpack 280 can be made on a case-by-case basis at the time of shipment rather than at the time of loading the modular container. The two-part lid for the modular container enables in-situ replacement of the one or more sealing members 44 prior to transport if it is needed to restore Type A capability following extended storage. Indeterminate or degraded modular containers 10 can be transported as Type B using the transport overpack 280. Future regulatory changes won't impact the modular containers 10 that are fabricated and loaded now.

The modular container 10 and transport overpack 280 are designed to meet legal weight and size requirements for truck shipment in all configurations. The heaviest Type A configuration (i.e., the modular container 10 alone) is 31.5 tonnes and can be moved by a truck with six axles. The heaviest Type B configuration (i.e., the modular container 10 and transport overpack 280) is 41.6 tonnes and can be moved by a truck with seven axles. The modular container 10 and/or transport overpack 280 can be secured directly to the vehicle without the need for a shipping skid as shown in FIG. 121. Also, there is generally no need for oversize or overweight permits. The modular container 10 and/or transport overpack 280 complies with all of the Type A and Type B transport requirements shown in the following table.

TABLE 9

Type A and Type B Transport Requirements the Packaging System Complies With

| Design Condition | Transport Criteria Description | Type A Transport Criteria (49 CFR 178.350 and IAEA TS-R-1) | Type B Transport Criteria (10 CFR 71 and IAEA TS-R-1) |
|---|---|---|---|
| Maximum Size | For highway to avoid oversize permitting<br>For secondary railway tunnel | Container alone<br>2.65 m W × 2.40 m H | Container + overpack<br>2.65 m W × 2.55 m H |
| Maximum Weight | Road to avoid overweight permitting<br>Rail for secondary railways | 35 tonnes (38.6 tons)<br>70 tonnes (77.2 tons) | 35 tonnes (38.6 tons)<br>70 tonnes (77.2 tons) |
| Temperature | Minimum to maximum ambient temperature range<br>Maximum container surface temperature | −29° C. to 38° C. normal<br>50° C. nonexclusive | −40° C. to 70° C. accident<br>85° C. exclusive |
| Handling Loads | ≤ yield strength of container structural material<br>≤ tensile strength of container structural material | 3X max. container weight<br>5X max. container weight | 3X max. container weight<br>5X max. container weight |
| Vibration | Accelerations in three orthogonal directions simultaneously | Per 49 CFR 178.608 | Per NUREG/CR-0128 |
| Tie-down | Tie-down attachments that are integral to container | 0.6 g vert., 0.3 g axial, 0.2 g trans. | 2 g vertical, 10 g axial, 5 g trans. |
| Dose Rate | Maximum container external surfaces<br>2 meters from transport vehicle | Type A quantities ≤ $A_2$<br>LSA and SCO with unshielded dose rate ≤ 1 R/hr at 3 m | 2.0 mSv/hr (200 mrem/hr)<br>0.1 mSv/hr (10 mrem/hr) |
| Surface Contamination | Maximum removable contamination on container exterior surfaces | 49 CFR 173.403 limits for SCOs<br>49 CFR 173.443 | 4 Bq/cm$^2$ beta-gamma<br>0.4 Bq/cm$^2$ alpha ave. over 300 cm$^2$ |
| Pressure | Maximum internal pressure for container with filtered vent<br>Maximum internal pressure for unvented container | Atmospheric<br>MNOP 70 kPa (10 psig) | Atmospheric<br>MNOP 700 kPa (100 psig) |
| Free Drop | Single accidental drop from the specified height onto flat unyielding surface | 1.2 m (4 foot) <11,000 kg<br>0.3 m (1 foot) >15,000 kg | 9.0 m (30 ft) |
| Crush | Drop of mass onto container | None | 500 kg (1,100 lbs) steel plate from 9.0 m (30 ft) |
| Penetration/ Puncture | Drop of cylindrical bar onto weakest part of container (Type A) or drop of container on puncture pin (Type B) | 3.2 cm (1.25") Ø<br>Mass of 6 kg (13.2 lbs)<br>Drop height 1 m (3.3 ft) | 15 cm (6") Ø<br>Mild steel<br>Drop height 1 m (3.3 ft) |
| Stacking | Container stack to remain kinematically stable when subjected to stacking loads | 5X mass of package or 13 kPa (1.9 psi) | None |
| Fire Accident | Hydrocarbon fuel/air fire with average emissivity of 0.9 | 10 minutes @ 800° C. (1475° F.) | 30 minutes @ 800° C. (1475° F.) |
| Immersion | Immersed under 15 m (50 ft) head of water for 8 hrs (Type B) | Water spray per 49 CFR 173.465 | 150 kPa (21.8 psig) |
| Containment | Leak tightness (unvented) | $10^{-4}$ cm$^3$/sec | $10^{-6}$ cm$^3$/sec |

Disposal

The modular container 10 is configured to be ready for disposal. Disposal of radioactive waste takes primarily two forms: (1) shallow land burial (see 10 CFR 61 or similar) and (2) deep geological repository (DGR) (per 10 CFR 63 or similar).

Figure 127:
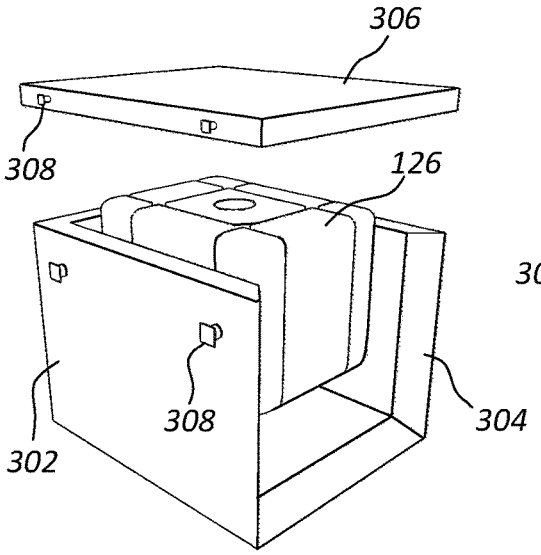
FIGS. 127-128 show a sub-container positioned in a disposal vault.
Figure 128:
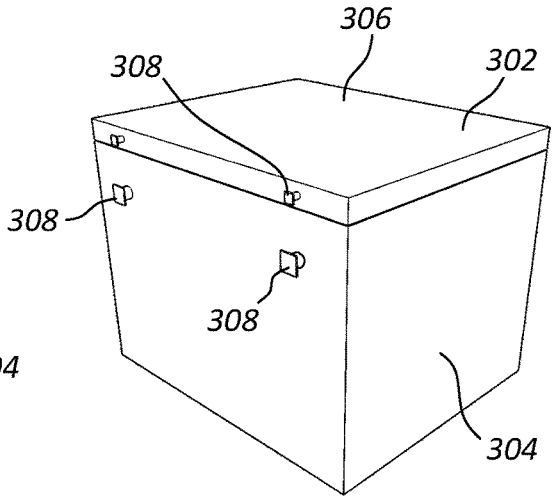

Shallow land burial is suitable primarily for Class B and C low level waste and/or waste with short lived isotopes. The radioactive waste can be disposed of by shallow land burial in one of the following ways. First, the sub-container(s) 126 and/or the support framework 128 can be removed from the modular container 10 and buried. Second, the sub-container(s) 126, the support framework 128, and/or the liner 124 can be placed in a vault 302 (e.g., concrete vault) and buried as shown in FIGS. 127-128. The vault 302 can include a main body 304 and a lid 306 as well as lifting members 308. Third, the modular container 10 is buried directly with or without modification, which is more prevalent for the Grade C modular container variant 120. The first two options allow the modular container 10 to be reused. It should be appreciated that the modular container 10 or the packaged waste container therein can have any number of configurations for disposal by shallow land burial.

Disposal in a deep geological repository usually requires disposal of the modular container 10. This type of disposal is suitable for spent nuclear fuel (SNF), greater than class C (GTCC) waste, intermediate level waste (ILW), high level waste (HLW), remote handled transuranic waste (RH-TRUW), and/or waste with long-lived isotopes. The modular container 10 alone or combined with an engineered barrier overpack satisfies the requirements for deep geological repository burial as set forth in the following table. Repository emplacement of the modular container 10 alone typically occurs for ILW, GTCC, and RH-TRUW packaged in the Grade B modular container variant 10. Repository emplacement of the modular container 10 in an engineered barrier overpack typically occurs for SNF and HLW packaged in the Grade A modular container variant 70. The engineered barrier overpack can be made of long term performance materials such as copper or Alloy-22 to provide a second confinement barrier to that of the modular container to mitigate the dispersion of radionuclides over the very long term. It should be appreciated that the modular container 10 or the packaged waste contained therein can have any number of configurations for disposal by repository emplacement.

requirements of the disposal site. For example, it may be desirable to reduce the total volume of metal in the DGR to reduce post closure gas generation due to long term corrosion of metals. This could be an important factor for DGRs with low natural pH and low rock permeability.

TABLE 10

Typical Deep Geological Repository (DGR) Container Requirements

| Design Condition | Typical DGR Criteria Description | Typical DGR Criteria |
|---|---|---|
| Design Life | Maintain structural, confinement and shielding integrity without degradation | 50 years minimum (DGR pre closure period) |
| Environmental Conditions | Ambient temperature variations (during DGR pre closure) | 15° C. to 25° C. |
| | Approximate relative humidity (during DGR pre closure) | 75% |
| Maximum Size | Maximum container length, width and height | 2.65 m W × 5.2 m L × 2.55 m H |
| Maximum Weight | Maximum container weight | 35 tonnes (38.6 tons) |
| Handling Loads | Not exceed minimum yield strength of container structural material | 3X maximum container weight |
| | Not exceed ultimate tensile strength of container structural material | 5X maximum container weight |
| Drift Size | Container stacks fit within finished dimensions of emplacement rooms | 7.4 m wide (min.) × 6.3 m high (min.) |
| | Minimum clearances from walls, between containers and from ceiling | 300 mm, 50 mm, and 1.2 m |
| Stackability | Stack to maximum height in stable, self supporting configuration up to 6 m | 2X maximum container weight +15% |
| External Dose Rate | External surfaces at time of emplacement | 2.0 mSv/hr (200 mrem/hr) |
| | 1 meter from external surfaces post accident conditions | 10 mSv/hr (1 Rem/hr) |
| Surface Contamination | Maximum removable contamination on container exterior surfaces | 4 Bq/cm$^2$ beta-gamma<br>0.4 Bq/cm$^2$ alpha averaged over 300 cm$^2$ |
| Heat Output | Maximum heat load per unit volume of waste - no restrictions | 0.1 W/m$^3$ |
| | Maximum heat load per unit volume of waste - with restrictions | 10 W/m$^3$ |
| Residual Liquids | Solid waste - maximum free liquid by volume | 1% |
| | Resin waste - maximum free water by volume | 5% |
| Gas Generation | Maximum internal pressure for container with filtered vent | Atmospheric |
| | Maximum internal pressure for unvented container (Grade B, Grade A) | 70 to 175 kPa (10 to 25 psig) |
| Impact Loads | Single accidental drop from the highest handling height (≤ 4.6 m (15 ft.)) onto flat 300 mm (12 inch) thick reinforced concrete floor on compacted fill | Free drop in the most damaging orientation |
| Seismic Event | Container stack to remain kinematically stable when subjected to horizontal ground motion acceleration in both orthogonal directions | 0.25 g horizontal<br>Vertical 2/3 of horizontal |
| Fire Accident | Hydrocarbon fuel/air fire with average emissivity of 0.9 (limit combustibles) | 10 minutes @ 800° C. (1475° F.) |
| Immersion | Immersed under 15 meter head of water for 8 hours (during DGR pre closure) | 150 kPa (21.8 psig) |
| Confinement | Leak tightness (unvented) (Grade B, Grade A) | $10^{-4}$ cm$^3$/sec to $10^{-6}$ cm$^3$/sec |

In one embodiment, the materials used to make the modular container 10 can be tailored for disposal conditions. For example, the Grade C modular container variant 120 can be made of coated carbon steel that is adequate for near surface land burial. The Grade A and B modular containers variants 10, 70 can be made of stainless steel that is suitable for DGR disposal. The modular container 10 can be a component of the DGR's engineered barrier system.

The robust enclosure envelope of the modular container 10 provides integrity through DGR pre-closure. The Grade A and B modular containers 10, 70 can provide a stable enclosure envelope for at least 25 years of interim storage followed by at least 50 years of pre-closure periods for the DGR. The stainless steel enclosure envelope extends the performance of the modular container. Also, there are no coatings that can degrade. The configuration of the structural lid 18 enables the structural lid 18 and/or sealing members 44 to be repaired or replaced prior to or following placement of the modular container 10 at the disposal site.

The composition of the shielding inserts 50, 52, 54, 56 in the modular container 10 can be adjusted according to the One way to reduce the volume of metal in the DGR is to use recycled waste metals as the shielding inserts 50, 52, 54, 56. This reduces the amount of metal because it avoids the need to package and dispose of such recycled waste metals in additional, separate containers. Another way to reduce the volume of metal in the DGR is to make the shielding inserts 50, 52, 54, 56 out of high density concrete. The enclosure envelope 12 can be made of low carbon stainless steel of various compositions to slow the corrosion rate. The modular container 10 can also be placed in an engineered barrier overpack made of long term performance material.

The cuboidal shaped modular container 10 reduces the required disposal space by a factor of two or more compared to conventional cylindrical containers. The cuboidal shaped modular container 10 has greater volume efficiency, which reduces the total number of containers by 23% or more for the same waste volume. Also, the stacking/packing density of the cuboidal shaped modular containers 10 is increased by 27% relative to conventional cylindrical containers because the interstitial spaces between the modular containers 10 are fully utilized.

Figure 129:
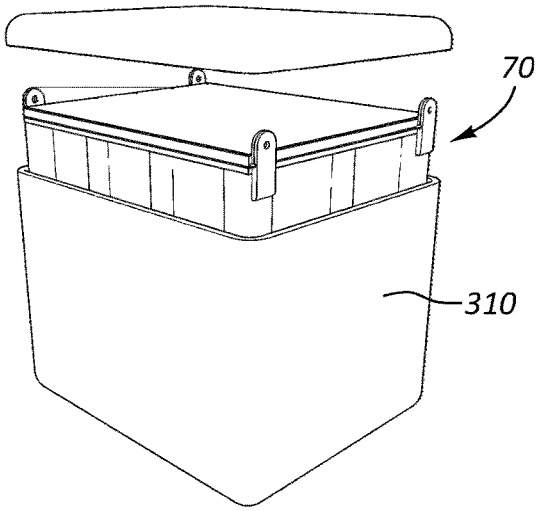
FIGS. 129-130 show the modular container positioned in a disposal overpack.
Figure 130:
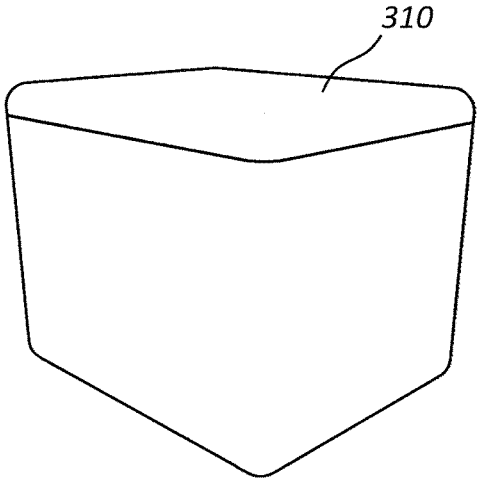

Referring to FIGS. 129-130, the modular container 70 with HLW and/or SNF can be placed in a disposal overpack 310 for repository disposal. The disposal overpack 310 can be an integrated component of the engineered barrier system.

The modular container 10 can be positioned in the deep geological repository in a variety of different ways. In one embodiment, the modular containers 10 are positioned horizontally and can be stacked or unstacked by itself or in an engineered barrier overpack. In another embodiment, the modular containers 10 are positioned in vertical bore holes and can be stacked or unstacked by itself or in an engineered barrier overpack. The bore hole voids can be filled with bentonite plugs and rings.

Figure 131:
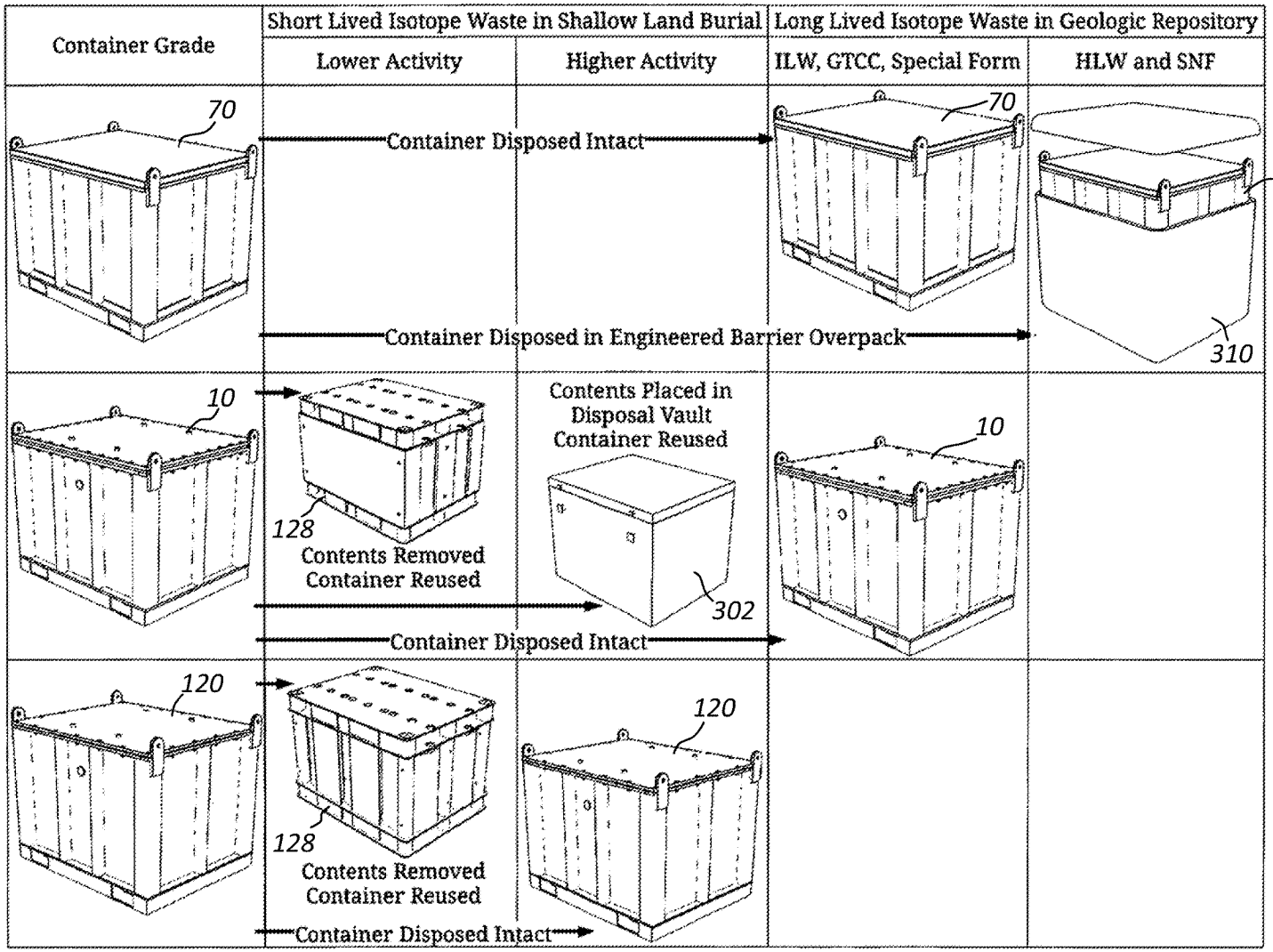
FIG. 131 shows a chart of the disposal pathways for the various grades of the modular container.

FIG. 131 shows the typical uses and disposal options for the different grades of the modular container 10.

Container Configurations

Moreover, the following tables show exemplary configurations of the modular container 10 and various storage, transport, and disposal options. Such configurations can be pre-qualified and cataloged for a range of applications to simplify adaptation and deployment by the end-user. It should be appreciated that the modular container 10 can have any number of configurations and applications.

TABLE 11

Exemplary Modular Container Configurations

| Waste Form | Waste Type | Modular Container Grade | Shielding Insert Thickness: None | 4 in | 6 in | 9 in | 12 in | Cavity Features: Liner | Support Framework | Shield Plates | Bins | Basket | Tubes |
|---|---|---|---|---|---|---|---|---|---|---|---|---|---|
| Solid waste | Activated hardware | B, C | | ● | ● | ● | ● | | | | | | |
| | Contaminated hardware | B, C | ● | ● | ● | | | | | | | | |
| | Granular material | B, C | ● | ● | ● | | | ● | | | | | |
| | GTCC | A | | | | ● | ● | | ● | | ● | ● | |
| Stabilized wet waste | 55 gal drums | B, C | | ● | ● | | | | ● | ● | ● | | |
| | 85 gal drums | B, C | | ● | ● | | | | ● | ● | ● | | |
| | 500 L drums | B, C | | ● | ● | | | | ● | ● | ● | | |
| | Cylindrical HIC | A, B, C | | ● | ● | | | | ● | ● | ● | | |
| | Cuboidal HIC | A, B, C | ● | ● | ● | | | | | | | | |
| | Bulk liquid transfer | A, B, C | ● | ● | ● | | | ● | ● | | | | |
| Spent nuclear fuel and HLW (also incorporates external neutron shielding panels) | AGR Fuel | A | | | | ● | | | | | | ● | |
| | Magnox fuel - bare | A | | | | ● | | | | | | ● | ● |
| | Magnox fuel - canned | Stretched A | | | | ● | | | | | | ● | |
| | UK HLW canisters | Stretched A | | | | ● | | | | | | ● | |
| | MTR fuel | A | | | | | ● | | | | | ● | ● |
| | TRIGA fuel | A | | | | | ● | | | | | ● | ● |
| | CANDU fuel | A | | | | ● | | | | | | ● | |
| Department of Energy waste | Sealed sources | A, B | | | | ● | | | | | | ● | ● |
| | Isotope Rx fuel | A | | | | ● | ● | | | | | ● | ● |
| | Production Rx fuel | A | | | | ● | ● | | | | | ● | ● |
| | U.S. HLW canisters | Stretched A | | | | ● | | | | | | ● | |
| | RH-TRU | A | | ● | ● | | | | | | | ● | |
| | CH-TRU | B | ● | ● | | | | | ● | | ● | | |

TABLE 12

Modular Container Loading, Storage, Transport, and Disposal Configurations

| Waste Form | Waste Type | Operational Mode Configuration: Wet/Dry Loading | Loading Option 1 | Loading Option 2 | Storage on Pad | Storage in Building | Transport Type | Disposal by Burial | Repository Disposal |
|---|---|---|---|---|---|---|---|---|---|
| Solid waste | Activated hardware | Wet or Dry | IC | IC | IC | IC | A or B | IC | IC |
| | Contaminated hardware | Dry | IC | IC | IC | IC | A or IP2 | IC | N/A |
| | Granular material | Dry | IL | IC | IC | IC | A or IP2 | ILV | IC |
| | GTCC | Wet or Dry | IC | IB | IC | IC | B | N/A | IC |
| Stabilized wet waste | 55 gal drums | N/A | IDSF | IC | IC | IDSF | A or IP2 | IDSF | IC |
| | 85 gal drums | N/A | IDSF | IC | IC | IDSF | A or IP2 | IDSF | IC |
| | 500 L drums | N/A | IDSF | IC | IC | IDSF | A or B | IDSF | IC |
| | Cylindrical HIC | N/A | IHSF | IC | IC | IHSF | A or B | IV | IC |
| | Cuboidal HIC | N/A | IH | IC | IC | IC | A or B | IV | IC |

TABLE 12-continued

| Modular Container Loading, Storage, Transport, and Disposal Configurations | | | | | | | | | |
|---|---|---|---|---|---|---|---|---|---|
| | | Operational Mode Configuration | | | | | | | |
| Waste Form | Waste Type | Wet/Dry Loading | Loading Option 1 | Loading Option 2 | Storage on Pad | Storage in Building | Transport Type | Disposal by Burial | Repository Disposal |
| | Bulk liquid transfer | N/A | IL | IC | IC | ILSF | A or B | N/A | N/A |
| Spent nuclear fuel and HLW | AGR Fuel | Wet or Dry | IB | IC | IC | IC | B | N/A | IC |
| | Magnox fuel - bare | Wet or Dry | IBT | IC | IC | IC | B | N/A | IC |
| | Magnox fuel - canned | Dry | IBT | IC | IC | IC | B | N/A | IC |
| | UK HLW canisters | Dry | IB | IC | IC | IC | B | N/A | IC |
| | MTR fuel | Wet or Dry | IBT | IC | IC | IC | B | N/A | IC |
| | TRIGA fuel | Wet or Dry | IBT | IC | IC | IC | B | N/A | IC |
| | CANDU fuel | Wet or Dry | IB | IC | IC | IC | B | N/A | IC |
| Department of Energy waste | Sealed sources | Dry | IBT | IC | IC | IC | B | N/A | IC |
| | Isotope Rx fuel | Wet or Dry | IBT | IC | IC | IC | B | N/A | IC |
| | Production Rx fuel | Wet or Dry | IBT | IC | IC | IC | B | N/A | IC |
| | U.S. HLW canisters | Dry | IB | IC | IC | IC | B | N/A | IC |
| | RH-TRU | Dry | IC | IC | IC | IC | B | N/A | IC |
| | CH-TRU | Dry | IDSF | IC | IC | IDSF | A or B | N/A | IDSF |

IC = in container
IL = in liner
IV = in vault
IH = in HIC
IB = in basket
IBT = in basket/tubes
IDSF = in drum/support framework
IHSF = in HIC/support framework
ILSF = in liner/support framework
ILV = in liner/vault It should be appreciated that some components, features, and/or configurations may be described in connection with only one particular embodiment, but these same components, features, and/or configurations can be applied or used with many other embodiments and should be considered applicable to the other embodiments, unless stated otherwise or unless such a component, feature, and/or configuration is technically impossible to use with the other embodiment. Thus, the components, features, and/or configurations of the various embodiments can be combined together in any manner and such combinations are expressly contemplated and disclosed by this statement.

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure the term shall mean," etc.).

References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope.

The subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be given their broadest interpretation in view of the prior art and the meaning of the claim terms.

As used herein, spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

All disclosed ranges are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

What is claimed is:

1. A modular container system for radioactive waste comprising:

a plurality of enclosure envelopes each of which defines a cavity configured to receive radioactive waste; and a plurality of modular shielding inserts configured to be positioned in the cavity of each of the plurality of enclosure envelopes;

wherein each of the plurality of enclosure envelopes has approximately the same size cavity;

wherein the plurality of enclosure envelopes have different grades to accommodate different activity levels of radioactive waste and/or containment requirements;

wherein the different grades of the plurality of enclosure envelopes differ structurally from each other; and wherein the plurality of modular shielding inserts include different grades of shielding inserts having different thicknesses and/or being made of different material to accommodate the different activity levels of radioactive waste.

2. The modular container system of claim 1 wherein each of the plurality of enclosure envelopes comprises a lid forming at least part of the enclosure envelope, wherein the lids for the plurality of enclosure envelopes have different grades to accommodate the different activity levels of radioactive waste and/or containment requirements.

3. The modular container system of claim 2 wherein the different grades of the lid vary structurally from each other.

4. The modular container system of claim 1 wherein at least one grade of the plurality of enclosure envelopes comprises a lid forming at least part of the enclosure envelope, wherein an interior side of the lid is coupled to a shielding insert and wherein the shielding insert can be decoupled from the lid from an exterior side of the lid.

5. The modular container system of claim 1 wherein at least one grade of the plurality of enclosure envelopes is made of stainless steel.

6. The modular container system of claim 1 wherein at least one grade of the plurality of enclosure envelopes is made of carbon steel.

7. The modular container system of claim 1 comprising:

a plurality of modular containers each of which includes a different grade of the plurality of enclosure envelopes; and a reusable transport overpack sized to enclose any of the plurality of modular containers during transport.

8. The modular container system of claim 1 wherein the plurality of enclosure envelopes includes a first enclosure envelope configured to be used with a first class of radioactive waste and a second enclosure envelope configured to be used with a second class of radioactive waste that is more radioactive than the first class of radioactive waste.

9. The modular container system of claim 8 wherein the plurality of enclosure envelopes includes a third enclosure envelope configured to be used with a third class of radioactive waste that is more radioactive than the second class of radioactive waste.

10. The modular container system of claim 1 wherein the plurality of modular shielding inserts includes a first set of modular shielding inserts configured to be used with radioactive waste having a first activity level and a second set of modular shielding inserts configured to be used with radioactive waste having a second activity level that is greater than the first activity level.

11. The modular container system of claim 1 wherein the plurality of modular shielding inserts includes a first set of modular shielding inserts configured to be used with a first class of radioactive waste and a second set of modular shielding inserts configured to be used with a second class of radioactive waste that is more radioactive than the first class of radioactive waste.

12. A modular container for radioactive waste comprising:

a main body;

a lid coupled to the top of the main body, the lid and the main body forming an enclosed cavity configured to receive radioactive waste; and a plurality of modular shielding inserts configured to be positioned in the cavity;

wherein the plurality of modular shielding inserts include different grades of shielding inserts having different thicknesses and/or being made of different material to accommodate different activity levels of radioactive waste; and wherein the plurality of modular shielding inserts are separate from any support frameworks used to hold radioactive waste that may be present in the modular container.

13. The modular container of claim 12 comprising a shielding insert coupled to an interior side of the lid, wherein the shielding insert can be decoupled from the lid from an exterior side of the lid.

14. The modular container of claim 12 wherein the plurality of modular shielding inserts includes a first set of modular shielding inserts configured to be used with radioactive waste having a first activity level and a second set of modular shielding inserts configured to be used with radioactive waste having a second activity level that is greater than the first activity level.

15. The modular container of claim 12 wherein the main body is made of stainless steel.

16. The modular container of claim 12 wherein the main body is made of carbon steel.

17. A modular container system comprising:

a plurality of the modular containers recited in claim 12 each of which includes a different grade of the lid and the main body to accommodate different activity levels of radioactive waste; and a reusable transport overpack sized to enclose any of the plurality of modular containers during transport.

18. A modular container system for radioactive waste comprising:

a plurality of standardized enclosure envelopes having different grades that differ structurally from each other to accommodate different activity levels of radioactive waste and/or containment requirements; and a plurality of modular shielding inserts configured to be positioned in the cavity of each of the plurality of standardized enclosure envelopes;

wherein each of the plurality of standardized enclosure envelopes defines a cavity configured to receive radioactive waste;

wherein the different grades of the plurality of standardized enclosure envelopes define approximately the same sized cavity; and wherein the plurality of modular shielding inserts include different grades of shielding inserts having different thicknesses and/or being made of different material to accommodate the different activity levels of radioactive waste.

19. The modular container system of claim 18 wherein each of the plurality of standardized enclosure envelopes comprises a lid forming at least part of the standardized enclosure envelope, wherein the lids for the plurality of standardized enclosure envelopes have different grades to accommodate the different activity levels of radioactive waste and/or containment requirements.

20. The modular container system of claim 19 wherein the different grades of the lids vary structurally from each other.

21. The modular container system of claim 18 wherein at least one grade of the plurality of standardized enclosure envelopes comprises a lid forming at least part of the standardized enclosure envelope, wherein an interior side of the lid is coupled to a shielding insert and wherein the shielding insert can be decoupled from the lid from an exterior side of the lid.

22. The modular container system of claim 18 wherein at least one grade of the plurality of standardized enclosure envelopes is made of stainless steel.

23. The modular container system of claim 18 wherein at least one grade of the plurality of standardized enclosure envelopes is made of carbon steel.

24. The modular container system of claim 18 comprising:

a plurality of modular containers each of which includes a different grade of the plurality of standardized enclosure envelopes; and a reusable transport overpack sized to enclose any of the plurality of modular containers during transport.

25. The modular container system of claim 18 wherein the plurality of enclosure envelopes includes a first enclosure envelope configured to be used with a first class of radioactive waste and a second enclosure envelope configured to be used with a second class of radioactive waste that is more radioactive than the first class of radioactive waste.

26. The modular container system of claim 25 wherein the plurality of enclosure envelopes includes a third enclosure envelope configured to be used with a third class of radioactive waste that is more radioactive than the second class of radioactive waste.

27. The modular container system of claim 18 wherein the plurality of modular shielding inserts includes a first set of modular shielding inserts configured to be used with radioactive waste having a first activity level and a second set of modular shielding inserts configured to be used with radioactive waste having a second activity level that is greater than the first activity level.

28. The modular container system of claim 18 wherein the plurality of modular shielding inserts includes a first set of modular shielding inserts configured to be used with a first class of radioactive waste and a second set of modular shielding inserts configured to be used with a second class of radioactive waste that is more radioactive than the first class of radioactive waste.

29. A modular container system for radioactive waste comprising:

a plurality of enclosure envelopes each of which defines a cavity configured to receive radioactive waste;

wherein each of the plurality of enclosure envelopes has approximately the same size cavity;

wherein the plurality of enclosure envelopes have different grades to accommodate different activity levels of radioactive waste and/or containment requirements;

wherein the different grades of the plurality of enclosure envelopes differ structurally from each other;

wherein at least one grade of the plurality of enclosure envelopes comprises a lid forming at least part of the enclosure envelope, an interior side of the lid being coupled to a shielding insert; and wherein the shielding insert can be decoupled from the lid from an exterior side of the lid.

30. The modular container system of claim 29 wherein each of the plurality of enclosure envelopes comprises a lid forming at least part of the enclosure envelope, wherein the lids for the plurality of enclosure envelopes have different grades to accommodate the different activity levels of radioactive waste and/or containment requirements.

31. The modular container system of claim 30 wherein the different grades of the lid vary structurally from each other.

32. The modular container system of claim 29 wherein at least one grade of the plurality of enclosure envelopes is made of stainless steel.

33. The modular container system of claim 29 wherein at least one grade of the plurality of enclosure envelopes is made of carbon steel.

34. The modular container system of claim 29 comprising:

a plurality of modular containers each of which includes a different grade of the plurality of enclosure envelopes;

a reusable transport overpack sized to enclose any of the plurality of modular containers during transport.

35. The modular container system of claim 29 wherein the plurality of enclosure envelopes includes a first enclosure envelope configured to be used with a first class of radioactive waste and a second enclosure envelope configured to be used with a second class of radioactive waste that is more radioactive than the first class of radioactive waste.

36. The modular container system of claim 35 wherein the plurality of enclosure envelopes includes a third enclosure envelope configured to be used with a third class of radioactive waste that is more radioactive than the second class of radioactive waste.

37. A modular container system for radioactive waste comprising:

a plurality of standardized enclosure envelopes having different grades that differ structurally from each other to accommodate different activity levels of radioactive waste and/or containment requirements;

wherein at least one grade of the plurality of standardized enclosure envelopes comprises a lid forming at least part of the standardized enclosure envelope, an interior side of the lid being coupled to a shielding insert; and wherein the shielding insert can be decoupled from the lid from an exterior side of the lid.

38. The modular container system of claim 37 wherein each of the plurality of enclosure envelopes comprises a lid forming at least part of the enclosure envelope, wherein the lids for the plurality of enclosure envelopes have different grades to accommodate the different activity levels of radioactive waste and/or containment requirements.

39. The modular container system of claim 38 wherein the different grades of the lid vary structurally from each other.

40. The modular container system of claim 37 wherein at least one grade of the plurality of enclosure envelopes is made of stainless steel.

41. The modular container system of claim 37 wherein at least one grade of the plurality of enclosure envelopes is made of carbon steel.

42. The modular container system of claim 37 comprising:

a plurality of modular containers each of which includes a different grade of the plurality of enclosure envelopes;

a reusable transport overpack sized to enclose any of the plurality of modular containers during transport.

43. The modular container system of claim 37 wherein the plurality of enclosure envelopes includes a first enclosure envelope configured to be used with a first class of radioactive waste and a second enclosure envelope configured to be used with a second class of radioactive waste that is more radioactive than the first class of radioactive waste.

44. The modular container system of claim 43 wherein the plurality of enclosure envelopes includes a third enclosure envelope configured to be used with a third class of radioactive waste that is more radioactive than the second class of radioactive waste.

* * * * *